US009168753B2

(12) United States Patent
Miyazawa

(10) Patent No.: US 9,168,753 B2
(45) Date of Patent: Oct. 27, 2015

(54) MAINTENANCE DEVICE FOR A FLUID EJECTION HEAD, A FLUID EJECTION DEVICE, AND A PRINTER

(71) Applicant: Seiko Epson Corporation, Tokyo (JP)

(72) Inventor: Hisashi Miyazawa, Okaya (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 14/346,555

(22) PCT Filed: Sep. 20, 2012

(86) PCT No.: PCT/JP2012/005982

§ 371 (c)(1),
(2) Date: Mar. 21, 2014

(87) PCT Pub. No.: WO2013/042366

PCT Pub. Date: Mar. 28, 2013

(65) Prior Publication Data

US 2014/0210907 A1 Jul. 31, 2014

(30) Foreign Application Priority Data

Sep. 22, 2011 (JP) ..... 2011-207192
Sep. 14, 2012 (JP) ..... 2012-202259

(51) Int. Cl.
*B41J 2/15* (2006.01)
*B41J 2/165* (2006.01)
*B41J 23/02* (2006.01)

(52) U.S. Cl.
CPC ..... *B41J 2/16532* (2013.01); *B41J 2/16505* (2013.01); *B41J 2/16538* (2013.01); *B41J 2/16544* (2013.01); *B41J 2/16547* (2013.01); *B41J 2/16585* (2013.01); *B41J 23/025* (2013.01)

(58) Field of Classification Search
CPC ..... B41J 2/16505; B41J 2/16511; B41J 2/16523; B41J 2/16538; B41J 2/1652; B41J 2/16535; B41J 2/16526
See application file for complete search history.

(56) References Cited

U.S. PATENT DOCUMENTS

| | | | |
|---|---|---|---|
| 5,504,508 | A | 4/1996 | Hashimoto |
| 2009/0051728 | A1 | 2/2009 | Miyazawa |
| 2011/0090281 | A1 | 4/2011 | Miyazawa et al. |
| 2011/0090282 | A1 | 4/2011 | Miyazawa |

FOREIGN PATENT DOCUMENTS

| | | | |
|---|---|---|---|
| JP | 06-191061 | A | 7/1994 |
| JP | 2001-030507 | A | 2/2001 |
| JP | 3155871 | B2 | 4/2001 |
| JP | 2004-299209 | A | 10/2004 |
| JP | 2007-276304 | A | 10/2007 |
| JP | 2008-195035 | A | 8/2008 |
| JP | 2009-045898 | A | 3/2009 |
| JP | 2011-104979 | A | 6/2011 |
| JP | 2011-104980 | A | 6/2011 |
| JP | 2011-131446 | A | 7/2011 |

*Primary Examiner* — Lamson Nguyen
(74) *Attorney, Agent, or Firm* — Nutter McClennen & Fish LLP; John J. Penny, Jr.; Joshua I. Rudawitz

(57) ABSTRACT

A maintenance device for a fluid ejection head has a small, compact switching mechanism that can appropriately switch drive force from a drive source and drive a suction pump and a wiper.

A maintenance device 40 has caps 64 (1) to 65 (4) and wipers 75 (1) to 75 (4), a suction pump 94 that suctions waste ink from the caps 64 (1) to 65 (4), a cap drive transfer mechanism 80 that moves the caps 64 (1) to 65 (4) in a cap movement direction V, a wiper-pump drive transfer mechanism 90 that moves the wipers and drives the suction pump 94, and a drive switching mechanism 100 that switches driving by the wiper-pump drive transfer mechanism 90 to drive the suction pump 94 or move the wipers according to the position of cap movement.

14 Claims, 38 Drawing Sheets

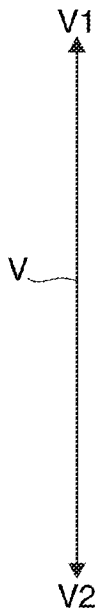

| No. | POSITION NAME | DESCRIPTION (SHARED HEIGHT) |
|---|---|---|
| 1 | CAPPING POSITION | CAPPING HEIGHT/HEIGHT AT WHICH CAPPING POSITION IS DETECTED |
| 2 | DEFECTIVE NOZZLE INSPECTION POSITION | HEIGHT FOR DEFECTIVE NOZZLE INSPECTION |
| 3 | FLUSHING POSITION | HEIGHT WHERE FLUSHING IS PERFORMED (FLUSHING HEIGHT) |
| 3a | PUMP SUCTION POSITION | PUMP/WIPER MOTOR POWER GOES TO PUMP SUCTION SIDE ABOVE THIS HEIGHT |
| 3b | WIPER MOVEMENT POSITION | PUMP/WIPER MOTOR POWER GOES TO WIPER MOVEMENT SIDE BELOW THIS HEIGHT |
| 4 | WIPING POSITION | HEIGHT WHEN WIPING, AND HEIGHT AT WHICH WIPER IS MOVED AFTER WIPER IS RAISED |
| 5 | START VERTICAL MOVEMENT POSITION OF THE WIPER UNIT | WIPER UNIT ALSO MOVED VERTICALLY BELOW THIS HEIGHT (ONLY CAP UNIT MOVES ABOVE THIS HEIGHT) |
| 6 | WIPER AVOIDANCE POSITION | HEIGHT OF MOVEMENT WHEN WIPER IS UPRIGHT (SCATTERING PREVENTION HEIGHT) |
| 7 | WIPER MOVEMENT POSITION | HEIGHT OF NORMAL WIPER MOVEMENT/HEIGHT AT WHICH WIPER CLEANER WIPES INK FROM WIPER |
| 8 | CARRIAGE MOVEMENT POSITION | HEIGHT AT WHICH CARRIAGE CAN MOVE |
| 9 | CAP HOME DETECTION POSITION | CAP UNIT STANDBY POSITION |
| 10 | VALVE SELECTION POSITION (HEAD 2) | SUCTION VALVE SELECTION HEIGHT (HEAD 2) |
| 11 | WIPER RAISING POSITION | HEIGHT TO WHICH WIPER IS RAISED FOR WIPING |
| 12 | VALVE SELECTION POSITION (HEAD 1) | SUCTION VALVE SELECTION HEIGHT (HEAD 1) |

FIG. 24

| No. | POSITION NAME |
|---|---|
| ①&⑦ | ALL VALVES OPEN POSITION |
| ②&⑧ | ALL VALVES OPEN POSITION |
| ③ | VALVE 1-4 POSITION |
| ④ | VALVE 1-3 POSITION |
| ⑤ | VALVE 1-2 POSITION |
| ⑥ | VALVE 1-1 POSITION |
| ⑨ | VALVE 2-3 POSITION |
| ⑩ | VALVE 2-4 POSITION |
| ⑪ | VALVE 2-1 POSITION |
| ⑫ | VALVE 2-2 POSITION |

| No. | POSITION NAME |
|---|---|
| ⑬ | WIPER RAISING POSITION FOR WIPING HEAD UNITS 2-2 & 2-4 |
| ⑭ | WIPER RAISING POSITION FOR WIPING HEAD UNITS 2-1 & 2-3 |
| ⑮ | WIPER RAISING POSITION FOR WIPING HEAD UNITS 1-2 & 1-4 |
| ⑯ | WIPER RAISING POSITION FOR WIPING HEAD UNITS 1-1 & 1-3 |

| No. | POSITION NAME |
|---|---|
| ⑱ | START WIPING POSITION FOR HEAD UNITS 1-4 & 2-4 |
| ⑲ | START WIPING POSITION FOR HEAD UNITS 1-3 & 2-3 |
| ⑳ | START WIPING POSITION FOR HEAD UNITS 1-2 & 2-2 |
| ㉑ | START WIPING POSITION FOR HEAD UNITS 1-1 & 2-1 |
| ㉒ | STANDBY POSITION DURING SUCTION |
| ㉓ | START SUCTION SELECTION POSITION |
| ㉔ | WIPER CLEANING POSITION |

MAINTENANCE DEVICE FOR A FLUID EJECTION HEAD, A FLUID EJECTION DEVICE, AND A PRINTER

TECHNICAL FIELD

The present disclosure relates to a maintenance device that performs maintenance preventing nozzle clogging and adherence of foreign matter to the fluid ejection head used in a printer or other fluid ejection device, and to a printer or other fluid ejection device having the maintenance device.

BACKGROUND ART

A fluid ejection device ejects drops of fluid from the nozzles of a fluid ejection head to dispense, coat, or print with the fluid, for example. The fluid ejection device also has a fluid ejection head maintenance device to prevent the nozzles from clogging.

An inkjet printer is a known example of a fluid ejection device. An inkjet printer has a maintenance device for the inkjet head, which is a fluid ejection head. To keep the nozzle face of the inkjet head in a constantly good working condition, the maintenance device performs an inkjet head maintenance operation while in a standby mode and during printing. As known from the literature, the maintenance operations of the maintenance device include capping the nozzle face, suctioning ink from the cap or ink nozzles, and wiping the nozzle face.

Capping is an operation that covers the nozzle face of the inkjet head and seals the nozzle face while waiting to print. This prevents ink in the ink nozzles (fluid ejection nozzles) in the nozzle face from drying, and the nozzles from clogging. Ink suction is an operation that drives a suction pump while the nozzle face of the inkjet head is capped to suction and discharge ink in the nozzles or ink in the cap. Wiping is an operation that uses a wiper to wipe ink (fluid), paper chaff, dust, and other foreign matter from the nozzle face of the inkjet head.

Such maintenance devices are described in patent documents 1 to 5 below. The maintenance devices disclosed in patent documents 3 and 4 are capable of selectively wiping and selectively suctioning plural nozzle rows.

CITATION LIST

Patent Literature

Patent document 1: JP-A-2007-276304
Patent document 2: JP-A-2011-104979
Patent document 3: JP-A-2001-30507
Patent document 4: JP-A-2009-45898
Patent document 5: Japan Patent No. 3155871

SUMMARY

Technical Problem

Fluid ejection heads comprising plural head units are also known from the literature. One example is a line inkjet head that has plural head units. In the line inkjet head thus comprised, the nozzle rows of the plural head units form a nozzle row of a length covering the printing width of the print medium.

The maintenance device of a line inkjet head may be located at a position removed from the printing position of the inkjet head. In this event, the inkjet head is moved from the printing position to a position opposite the maintenance device, and stopped in this position. Parts on the maintenance device side are then operated to perform maintenance operations on the stationery inkjet head such as nozzle capping, ink suction, and wiping.

The maintenance device must perform plural maintenance operations on the inkjet head in the stationery state. This complicates the drive mechanism used to perform the maintenance operations, and can easily increase the size of the device. As a result, there is a strong desire for a small, compact maintenance device drive mechanism.

A configuration that uses a small number of motors to perform operations including driving the ink suction pump and moving the wiper is therefore desirable. Using parts such as a cylindrical cam or intermittent gear for transmitting power, the path of power transmission from a single power source can be changed according to the angle of rotation of the cylindrical cam or intermittent gear, for example. However, the configuration of a power transmission mechanism using a cylindrical cam or intermittent gear is complex, and the setup cannot be easily changed to, for example, change the timing when power transmission changes.

With consideration for the foregoing, an object of the present disclosure is to provide a maintenance device for a fluid ejection head that can perform a plurality of maintenance operations on a stationery printhead by means of a small, compact mechanism.

Solution to Problem

A maintenance device of a fluid ejection head according to the disclosure has:

a cap that caps the nozzle face of the fluid ejection head;

a wiper that wipes the nozzle face;

a suction pump that suctions ink from the cap;

a cap drive transfer mechanism that moves the cap relative to the nozzle face;

a wiper-pump drive transfer mechanism that moves the wiper and drives the suction pump; and a drive switching mechanism that changes driving by the wiper-pump drive transfer mechanism to drive the suction pump or to move the wiper according to the position of cap movement.

The ink suction pump is driven after the cap covers the nozzle face. The wiper is driven after the cap is removed from the nozzle face. Therefore, the drive switching mechanism can appropriately switch the wiper-pump drive transfer mechanism based on the position of cap movement. Driving either the suction pump or the wiper can be changed based on the position of the cap, which moves linearly bidirectionally, without using a cylindrical cam or intermittent gear. When the suction operation and wiping operation start and stop can be managed and changed easily.

The drive switching mechanism can be configured using a planetary gear speed reducer as described next. That is, the drive switching mechanism includes a drive motor that rotates a drive shaft, a planetary gear speed reducer that has an internal gear or a planetary gear, and speed reduces rotation of the drive shaft of the drive motor and causes the internal gear or planetary gear to turn, and a latch mechanism that stops rotation of the internal gear or planetary gear of the planetary gear speed reducer according to the position of cap movement.

The maintenance device of the disclosure has a wiper support structure configured as follows so that the wiping pressure of the wiper can be kept constant.

Specifically, the maintenance device has a wiper frame that supports and moves the wiper;

a device frame that supports the wiper frame;

an elastic member that is disposed to the device frame and supports the wiper frame;

a cap support member that supports the cap and is moved by the cap drive transfer mechanism; and an engaging unit that is disposed to the wiper frame, engages the cap support member, and moves the wiper frame with the cap support member.

The wiper frame is supported movably by the elastic member on the device frame. Therefore, the wiper frame is attached to the device frame in a floating state by the elastic force of the elastic member.

The elastic member presses the wiper frame floating on the device frame to the nozzle face of the fluid ejection head, or the surface of carriage on which the fluid ejection head is mounted. Even if the wiper frame is tilted to the nozzle face of the fluid ejection head, the wiper frame can be adjusted to parallel to the nozzle face. The wiper frame can therefore be held parallel to the nozzle face when pressed to the nozzle face.

As a result, a specific gap is held between the nozzle face and the wiper on the wiper frame. When the wiper is pressed to and wipes the nozzle face, the distal end parts of the wiper are pressed with specific force to the nozzle face. The wiping pressure of the wiper is stable, there is little variation in the wiping condition at different parts of the distal ends of the wiper, and wiping performance is improved.

The fluid ejection head may be composed of plural head units similarly to a line fluid ejection head. In this event, plural wipers that respectively wipe the nozzle faces of the plural head units are disposed to the wiper frame. The wiper frame is long in the wiper movement direction, that is, in the direction of the nozzle row of the nozzle face. If the wiper frame is tilted to the wiper movement direction, the distance between the wiper and nozzle face changes when wiping. The nozzle face cannot be wiped with constant wiping pressure. In this situation, using a wiper frame that floats on the device frame is effective.

The maintenance device of the disclosure is configured as described below so that the plural wipers that wipe the nozzle face can be selected using movement of the wiper.

The maintenance device of the disclosure has a first wiper engaging member that is disposed to a first position in the direction the wiper moves, engages the wiper when the wiper frame moves in a direction away from the nozzle face, and changes the wiper from a first position to a second position that differs from the first position; a second wiper engaging member that is disposed to a second position different from the first position in the direction the wiper moves, engages the wiper when moving in a direction away from the nozzle face, and changes the wiper from a first position to a second position that differs from the first position; and a third wiper engaging member that is disposed to a third position different from the first position and the second position in the direction the wiper moves, engages the wiper and the second wiper when the wiper moves to the third position, and changes these from the second position to the first position.

When the wiper is in the first position and the wiper frame moves in the direction away from the nozzle face, the wiper engages the first wiper engaging member and changes from the first position (a retracted position, for example) to the second position (an upright position, for example). If the wiper is in the second position and the wiper frame moves in the direction away from the nozzle face, the second wiper changes from the first position to the second position. Therefore, the position of both wipers can be selectively changed, and nozzle faces in different positions can be selectively wiped. More specifically, the wiper that wipes a nozzle face can be selected. In addition, by moving first and second wipers from the second position to a third position, they can be returned to the first position (the retracted position, for example).

Next, the maintenance device of the disclosure has a second cap that caps a nozzle face at a different position than the nozzle face capped by the cap; and the cap support member supports the cap and the second cap. In this case, the cap support member preferably supports a first cap pressure member that presses the cap to the nozzle face, and a second cap pressure member that presses the second cap to the nozzle face. This configuration is advantageous when plural caps are densely disposed in a confined space.

The maintenance device of the disclosure is configured as described next so that ink can be selectively suctioned from the plural caps capping the nozzle faces using movement of the caps and wipers.

The maintenance device of the disclosure has a first ink suction path that moves ink suctioned in the cap;

a second ink suction path that moves ink suctioned in the second cap;

a first valve that opens and closes the first ink suction path;

a second valve that is disposed to a different position than the first valve in the wiper movement direction, and opens and closes the second ink suction path; and a valve selector that moves in the wiper movement direction, moves to a position opposite the first valve or a position opposite the second valve, and opens and closes the first valve or second valve.

The operation of selecting the valve used for the selective suction operation is achieved by movement of the caps and movement of the wipers. Therefore, a selective suction operation can be achieved by a small, compact mechanism without using parts such as a cylindrical cam, intermittent gear, or rocker member to change the selection.

The wiper of a maintenance device of the disclosure has a convex surface; and the maintenance device has a wiper cleaner with a concave surface that contacts the convex surface of the wiper and cleans the convex surface of the wiper.

When the second wiper is provided, the second wiper has a convex surface; and the wiper cleaner has a concave surface that contacts the convex surface of the second wiper.

The maintenance device of the disclosure has a wiper cleaner elastic support member that is disposed to the wiper frame and supports the wiper cleaner.

The maintenance device of the disclosure prevents ink from scattering from the wiper when wiping ends. The maintenance device of the disclosure therefore has a control unit that drives the cap drive transfer mechanism and separates the wiper from the nozzle face after driving the wiper-pump drive transfer mechanism and wiping the nozzle face with the wiper.

The wiper is pressed against the nozzle face to wipe the nozzle face. The wiper is then moved parallel to the nozzle face by the wiper-pump drive transfer mechanism and wipes the nozzle face. The wiper is pressed against the nozzle face and elastically deformed. When wiping ends, the elastically deformed wiper is moved in the direction away from the nozzle face by the cap drive transfer mechanism. By appropriately setting the speed of wiper movement, the distal end parts of the elastically deformed wiper pressed against the nozzle face can avoid forcefully returning elastically to the original shape. Ink or other foreign matter wiped from the nozzle face sticks to the distal end parts of the wiper. Because these parts return gradually to the original shape, the ink or other foreign matter that was wiped from the nozzle face can be prevented from being scattered to the surrounding area.

When the wiper is separated from the nozzle face, the wiper is preferably removed in a direction at an angle to the nozzle face after wiping ends. The direction in which the wiper separates from the nozzle face is set appropriately according to the direction of deflection in the distal end parts of the wiper when the wiper is pressed against the nozzle face. As a result, scattering of ink droplets when the wiper separates from the nozzle face can be minimized.

The distal end parts of the wiper pressed against the nozzle face are generally deflected in the direction opposite the wiping direction when wiping ends. In this case, the direction in which the wiper separates from the nozzle face is set to a direction inclined to the vertical in the reverse of the wiping direction. When the wiper separates from the nozzle face, the distal end parts return elastically to the original shape without the point of contact between the distal end parts of the wiper moving relative to the nozzle face. Scattering ink or other foreign matter accumulated on the distal end parts of the wiper pressed to the nozzle face can therefore be prevented when the wiper separates from the nozzle face.

Next, a fluid ejection device of the disclosure has:

a fluid ejection head having a nozzle face in which nozzles that eject ink are disposed;

a maintenance device including a cap that caps the nozzle face of the fluid ejection head, and a wiper that wipes the nozzle face;

a suction pump that suctions ink from the cap;

a cap drive transfer mechanism that moves the cap relative to the nozzle face;

a wiper-pump drive transfer mechanism that moves the wiper and drives the suction pump; and a drive switching mechanism that changes driving by the wiper-pump drive transfer mechanism to drive the suction pump or to move the wiper according to the position of cap movement.

A printer of the disclosure has:

an inkjet head that has a nozzle face in which nozzles that eject ink are disposed, and ejects ink onto a recording medium;

a maintenance device including a cap that caps the nozzle face of the inkjet head, and a wiper that wipes the nozzle face;

a suction pump that suctions ink from the cap;

a cap drive transfer mechanism that moves the cap relative to the nozzle face;

a wiper-pump drive transfer mechanism that moves the wiper and drives the suction pump;

a drive switching mechanism that changes driving by the wiper-pump drive transfer mechanism to drive the suction pump or to move the wiper according to the position of cap movement;

a conveyance path that conveys the recording medium; and a conveyance mechanism that conveys the recording medium through the conveyance path.

A fluid ejection device according to the disclosure is not limited to devices such as inkjet printers, copiers, and fax machines that eject ink from a printhead or other fluid ejection head onto recording paper or other target medium to record on the recording paper or other medium, includes fluid ejection devices that eject or discharge fluids other than ink, and is used in a meaning including fluid consumption devices that eject or discharge small drops.

A fluid as used herein is any material that can be ejected or discharged from a fluid ejection device. These fluids include, for example, materials in the liquid phase state, high or low viscosity fluids, sols, gels, and other inorganic solvents, organic solvents, solutions, fluid resins, and granular materials such as liquid metal (molten metal). The fluid is also not limited to a single state of matter, and includes solutions, dispersions, and mixtures of particles of a solid functional material such as pigment or metal particles in a solvent. Typical examples of a fluid include ink and liquid crystals. In addition to common aqueous ink and solvent ink, ink includes gel ink, hot melt ink, and other liquid compositions.

Specific examples of a fluid ejection device include, for example, fluid ejection devices that eject fluid electrode materials and colorant materials in dispersion or solution form used in the manufacture of liquid crystal displays, EL (electroluminescent) displays, field emission displays, and color filters; fluid ejection devices that eject bio-organic materials used in biochip manufacture; fluid ejection devices used as precision pipettes that eject fluids as reagents; textile printers, and micro-dispensers. Fluid ejection devices also include fluid ejection devices that eject lubricating oil with pinpoint precision in timepieces, cameras, and other precision instruments; fluid ejection devices that eject transparent liquid resins such as UV-cured resin for producing half spherical lenses (optical lenses) used in optical communication devices; and fluid ejection devices that eject acid or alkaline etching solutions for etching circuit boards.

BRIEF DESCRIPTION OF DRAWINGS

FIG. 24 is a table showing cap positions in the cap movement direction.

DESCRIPTION OF EMBODIMENTS

A preferred embodiment of the disclosure is described below with reference to the accompanying figures.

General Configuration of an Inkjet Printer

Figure 1:
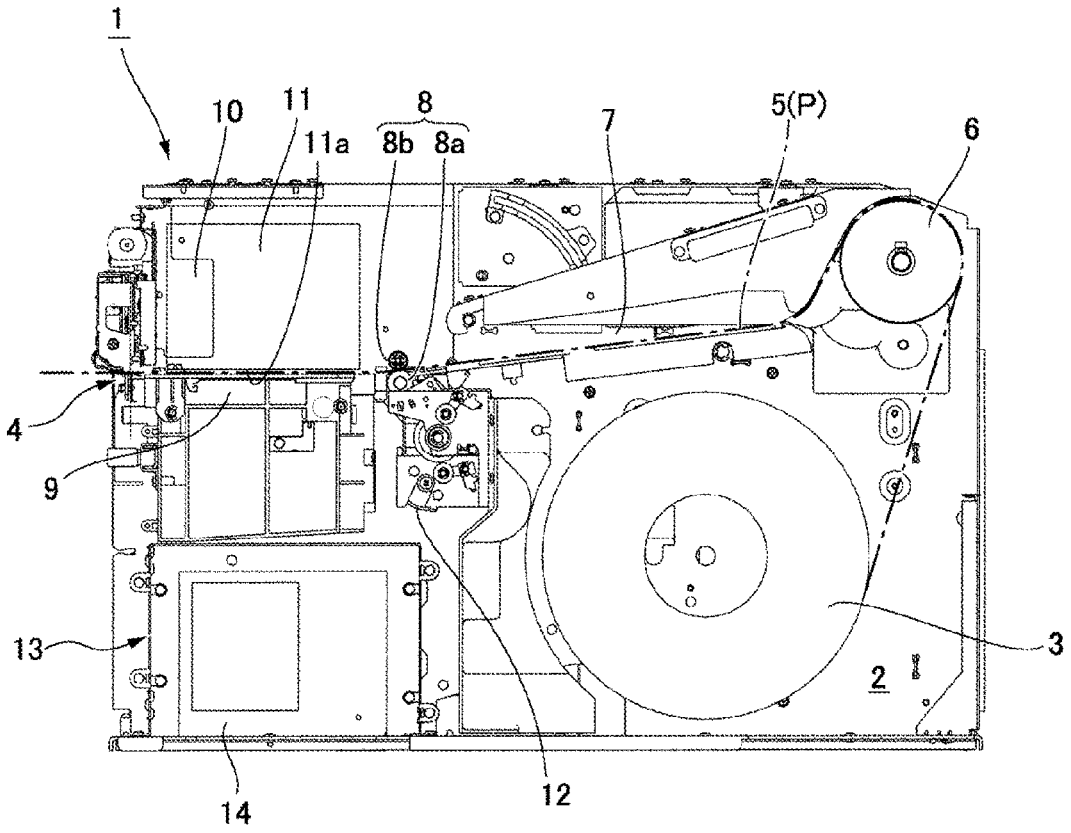
FIG. 1 is a vertical section view showing the general configuration of a printer.

FIG. 1 is a vertical section view showing the general configuration of an inkjet printer according to an embodiment of the disclosure. The inkjet printer 1 (also referred to below as simply printer 1) has a roll paper compartment 2, and a paper roll 3 made by winding continuous recording paper P into a roll is loaded in the roll paper compartment 2. A recording paper conveyance path 5 is formed inside the printer 1 from the roll paper compartment 2 to the paper exit 4 formed in the front of the printer.

A feed roller 6, paper guide 7, conveyance roller pair 8, and platen 9 are disposed to the recording paper conveyance path 5 from the upstream side to the downstream side in the recording paper conveyance direction. An inkjet head 11 mounted on a head carriage 10 is also disposed. The head carriage 10 moves the nozzle face 11*a* of the inkjet head 11 to a printing position on the recording paper conveyance path 5 opposite the platen 9, and to a home position removed from the recording paper conveyance path 5. The maintenance device 40 described below is disposed to the home position.

The conveyance roller pair 8 includes a drive roller 8*a* and a driven roller 8*b*. The drive roller 8*a* is driven forward and reverse by a paper feed motor 12. Ink is supplied to the inkjet head 11 from an ink cartridge 14 installed to an ink cartridge holder 13. In this embodiment, four colors of ink, black, cyan, magenta, and yellow, are supplied to the inkjet head 11. The inkjet head 11 is a line inkjet head.

The recording paper P delivered from the paper roll 3 in the roll paper compartment 2 is conveyed through the recording paper conveyance path 5. The inkjet head 11 prints on the recording paper P conveyed over the platen 9. After printing, the recording paper P is discharged to the front from the paper exit 4 at the front of the printer.

Figure 2A:
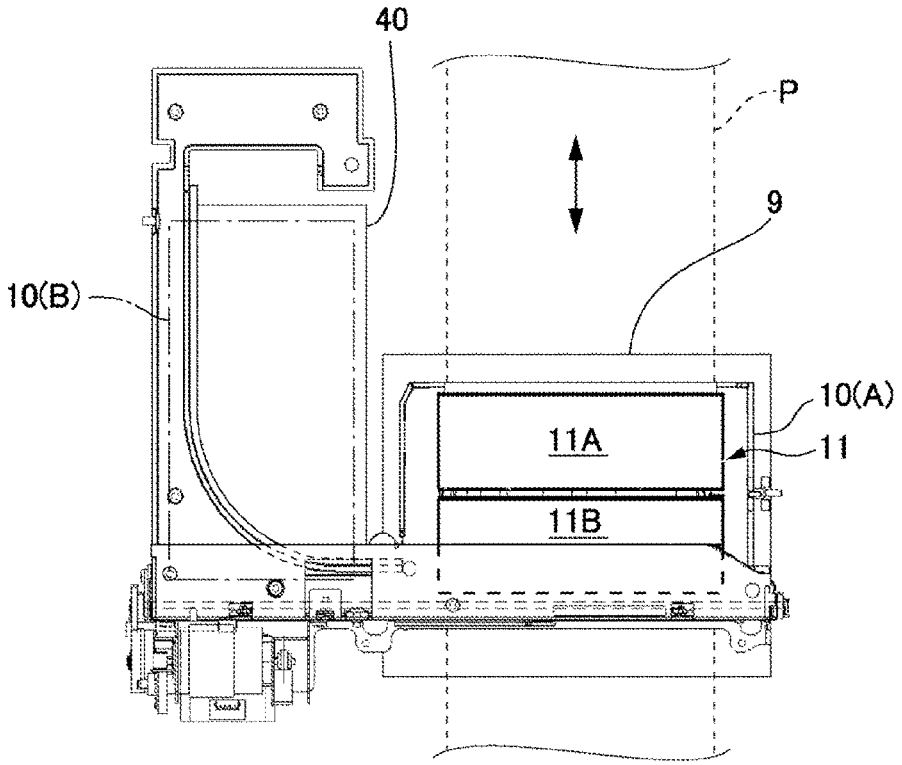
FIG. 2A describes the inkjet head and carriage.
Figure 2B:
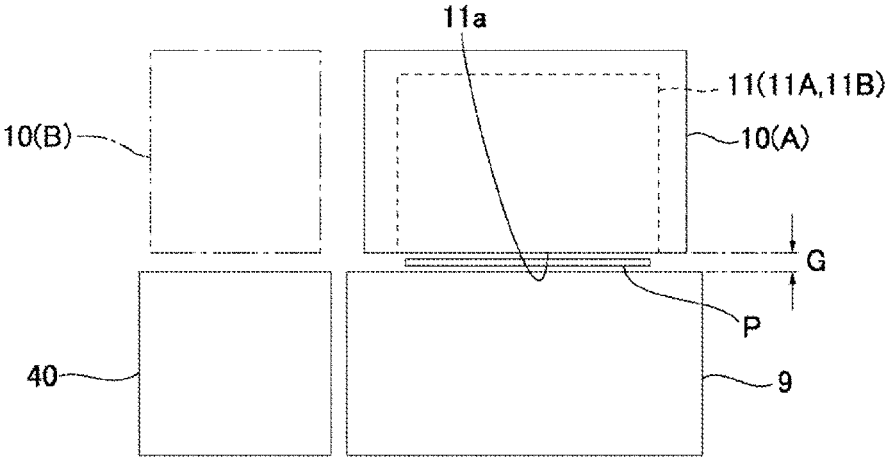
FIG. 2B describes the inkjet head and carriage.

FIG. 2A describes the relationship between the printing position and the home position of the inkjet head 11 when the printer 1 is seen from above, and FIG. 2B describes the relationship between the printing position and home position when seen from the front of the printer Described with further reference to FIG. 2A and FIG. 2B, the inkjet head 11 is a line inkjet head comprising plural inkjet heads. In this embodiment, the inkjet head 11 has a first head 11A and a second head 11B. The nozzle rows of the first and second heads 11A, 11B are long enough to cover the widthwise direction of the print area of the recording paper P (the width in the direction perpendicular to the recording paper P conveyance direction).

The first and second heads 11A, 11B of the line inkjet head are installed on the head carriage 10 with the nozzle faces 11*a* facing down. When the head carriage 10 is level, the nozzle faces 11*a* are level and facing down. A platen gap G of a preset dimension is formed between the surface of the platen 9 and the nozzle face 11*a* of each head 11A, 11B.

The maintenance device 40 is disposed beside the platen 9. The head carriage 10 moves the inkjet head 11 to the printing position A opposite the platen 9, and the home position B completely removed from the recording paper conveyance path 5 (the position indicated by a dot-dash line in FIG. 2A and FIG. 2B). At the home position B, the nozzle face 11*a* of the inkjet head 11 is opposite the maintenance device 40. At the printing position A, the inkjet head 11 is disposed with its long side in the transverse position in the direction perpendicular to the conveyance direction of the recording paper P. In this position, the ink nozzle row for each color disposed to the first and second heads 11A, 11B covers the widthwise direction of the print area of the recording paper P. In the home position B, the inkjet head 11 is in a position rotated 90 degrees to its position at the printing position A. More specifically, the inkjet head 11 is positioned with its long side in the longitudinal position aligned with the conveyance direction.

Figure 3:
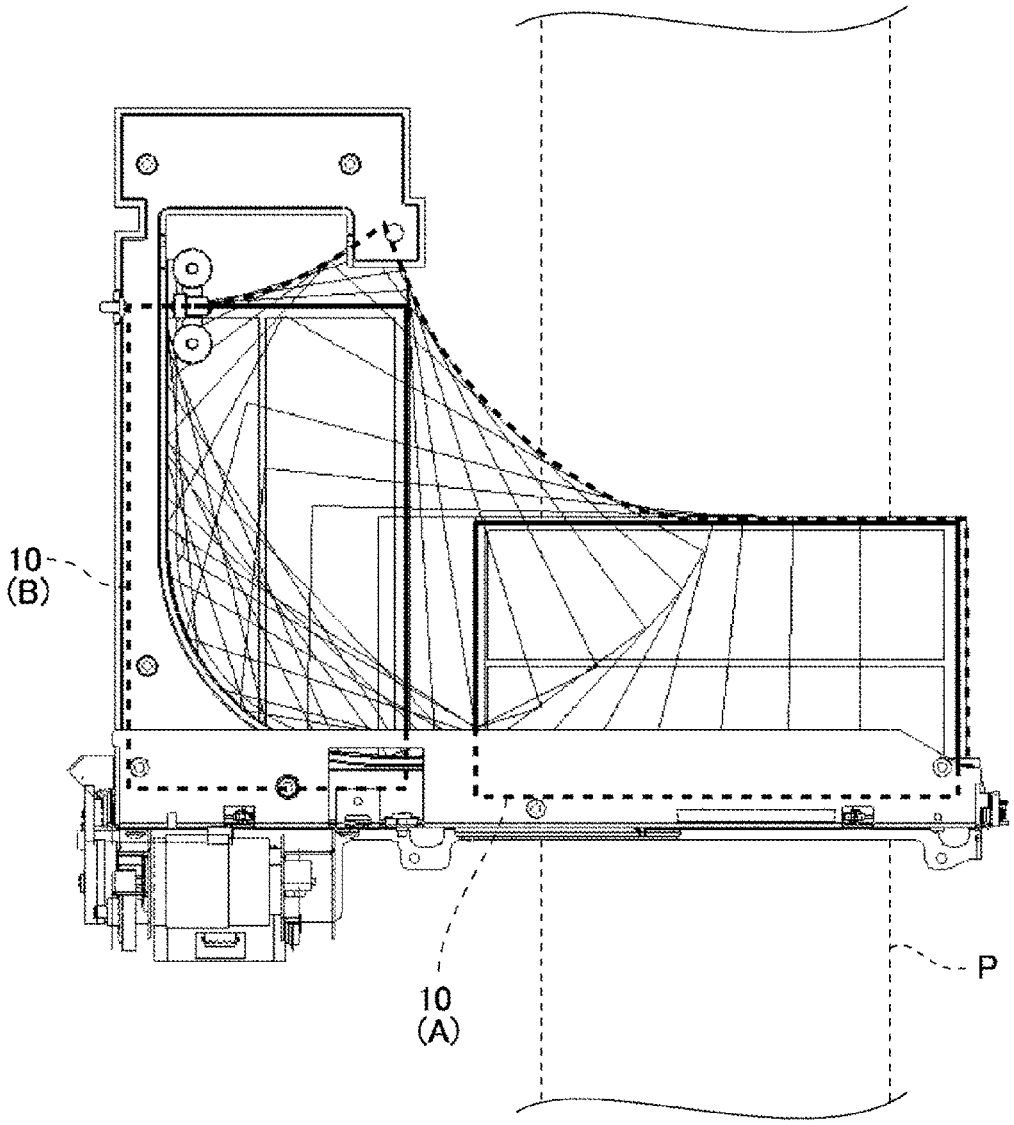
FIG. 3 describes the path of carriage movement.

FIG. 3 describes the path of movement of the head carriage 10 on which the inkjet head 11 is mounted. The printer 1 prints on the recording paper P by positioning and stopping the inkjet head 11 at the printing position A, and executing the ink ejection operation each time the recording paper P advances a specific pitch. When printing is completed, the printer 1 retracts the inkjet head 11 to the home position B removed from above the platen 9, and waits with the inkjet head 11 at the home position B.

The maintenance device 40 performs a maintenance operation that prevents or eliminates clogging of the ink nozzles of the inkjet head 11 while the inkjet head 11 is in the standby position. The maintenance device 40 raises a cap disposed at the top end to cap the nozzle face 11*a*. Ink is then discharged (flushed) from the ink nozzles of the inkjet head 11 into the cap of the maintenance device 40 as necessary. The maintenance device 40 also performs an operation that suctions ink from the cap. A wiper for wiping the nozzle face 11*a* is also disposed to the maintenance device 40. To resume printing, the cap and wiper are retracted to the down side, and the inkjet head 11 moves to the printing position A.

Figure 4:
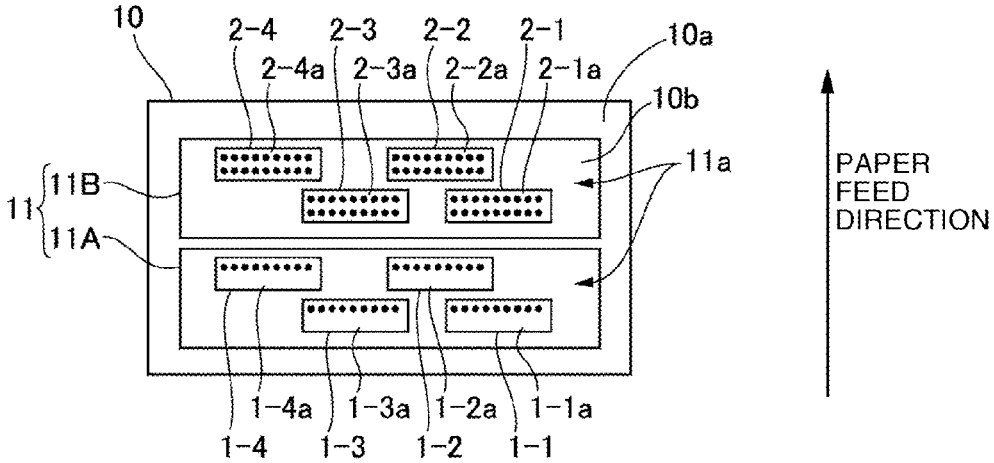
FIG. 4 describes the configuration of head units in the inkjet head.

FIG. 4 shows the nozzle face 11*a* of the inkjet head 11. This figure shows the nozzle configuration as seen from above the printer 1 looking through the nozzle face 11*a*. Four head units 1-1 to 1-4 with black and cyan ink nozzle rows are contained in the first head 11A. The four head units 1-1 to 1-4 are disposed in two rows with two head units each in the ink nozzle row direction. The head units 1-1 to 1-4 are staggered between the rows.

Four head units 2-1 to 2-4 with yellow and magenta ink nozzle rows are similarly contained in the second head 11B. The four head units 2-1 to 2-4 are disposed in two rows with two head units each in the ink nozzle row direction. The head units 2-1 to 2-4 are staggered between the rows. The configuration of caps in the maintenance device 40 described below is set to match the configuration of these eight head units 1-1 to 1-4, and 2-1 to 2-4.

The nozzle faces 1-1*a* to 1-4*a* of the head units 1-1 to 1-4, and the nozzle faces 2-1*a* to 2-4*a* of the head units 2-1 to 2-4, are surrounded by head cover surface 10*b*. The head cover surface 10*b* is surrounded by the bottom part 10*a* of the head carriage 10. The nozzle face 11*a* of the inkjet head 11 refers to these nozzle faces 1-1*a* to 1-4*a*, 2-1*a* to 2-4*a*.

General Configuration of the Maintenance Device

Figure 5A:
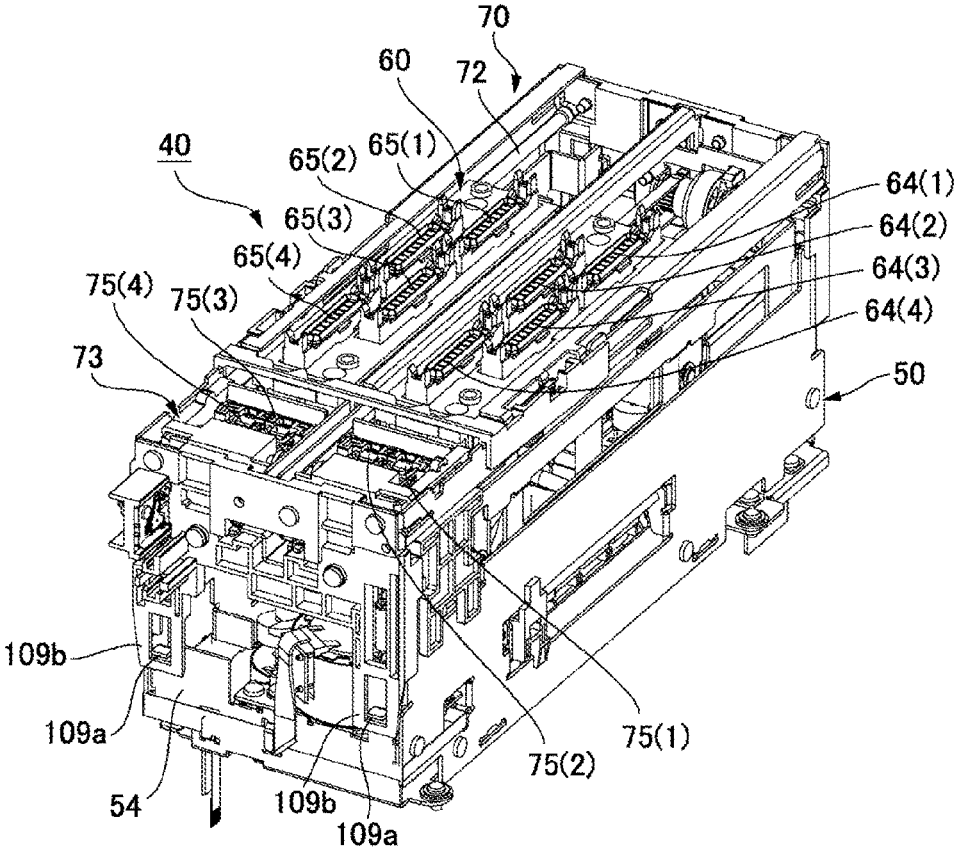
FIG. 5A is an oblique view of the maintenance device.
Figure 5B:
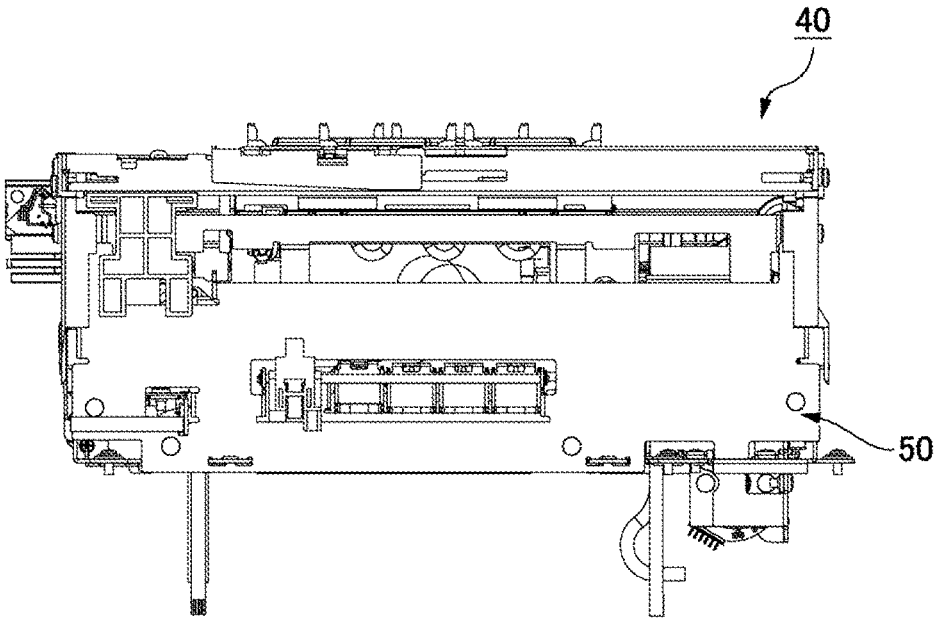
FIG. 5B is a side view of the maintenance device.
Figure 6:
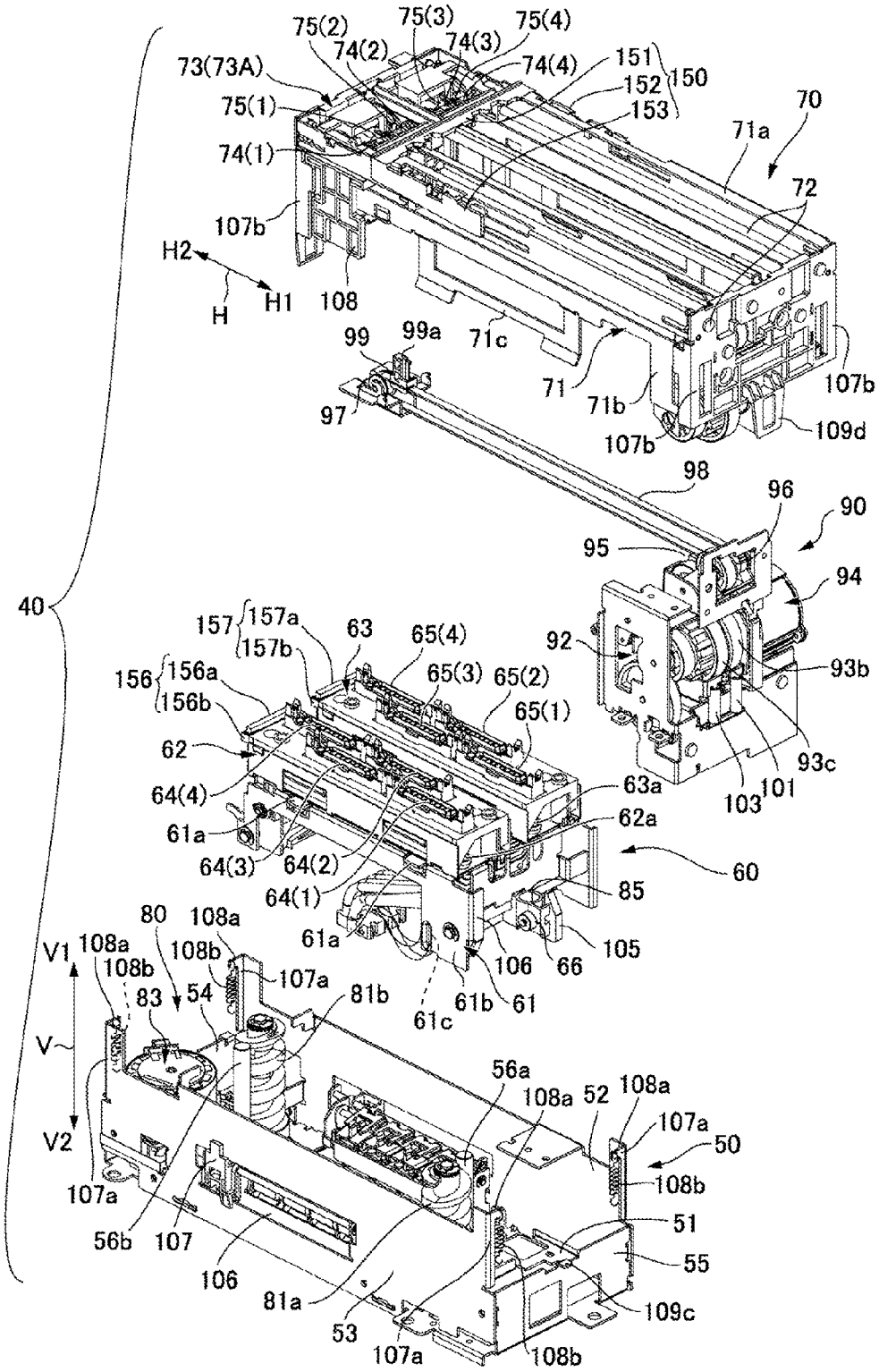
FIG. 6 is an exploded oblique view of main parts of the maintenance device.

FIG. 5A is an oblique view and FIG. 5B is a side view of the maintenance device 40. FIG. 6 is an exploded oblique view showing main parts of the maintenance device 40. The general configuration of the maintenance device 40 is described with reference to these figures. The direction the cap that caps the nozzle faces 1-1*a* to 1-4*a* moves is referred to below as the cap movement direction V, the direction in which the cap approaches the nozzle face in this cap movement direction V is called the capping direction V1, and the direction the cap moves away from the nozzle face is called the uncapping direction V2. The direction the wiper that wipes the nozzle faces 1-1*a* to 1-4*a* moves is called the wiper movement direction H, the direction the wiper moves when wiping the nozzle face is called the wiping direction H2 (wiper retraction direction H2), and the direction opposite the wiping direction is H1 (wiper advancing direction H1).

The maintenance device 40 is basically rectangular overall, and has a device frame 50, a cap unit 60, a wiper unit 70, an ink suction pump 94, a cap drive transfer mechanism 80, and a wiper-pump drive transfer mechanism 90. The cap unit 60, ink suction pump 94, cap drive transfer mechanism 80, and wiper-pump drive transfer mechanism 90 are disposed to the device frame 50.

The device frame 50 has a rectangular bottom panel 51, and side walls 52, 53 and end walls 54, 55 that respectively rise from the opposite long sides and opposite short sides of the bottom panel 51. Two guide posts 56*a*, 56*b* are attached perpendicularly to the bottom panel 51 of the device frame 50. The cap unit 60 can move along the guide posts 56*a*, 56*b*. The cap drive transfer mechanism 80 moves the cap unit 60 in the direction along the guide posts 56*a*, 56*b*, that is, in the cap movement direction V (capping direction V1 and uncapping direction V2).

The cap unit 60 has the same number (8) of caps 64 (1) to 64 (4), 65 (1) to 65 (4) as head units 1-1 to 1-4, 2-1 to 2-4. Caps 64 (1) to 64 (4), 65 (1) to 65 (4) cap the nozzle faces 1-1*a* to 1-4*a*, 2-1*a* to 2-4*a* of the head units 1-1 to 1-4, 2-1 to 2-4.

The ink suction pump 94 suctions ink from the caps 64 (1) to 64 (4), 65 (1) to 65 (4). Ink is thus suctioned from the ink nozzles of the capped head units 1-1 to 1-4, 2-1 to 2-4. The suctioned ink is recovered in a waste ink tank (not shown in the figure) disposed to the ink cartridge 14, for example.

The wiper unit 70 has four wipers 75 (1) to 75 (4) that wipe the nozzle faces 1-1*a* to 1-4*a*, 2-1*a* to 2-4*a* of the head units 1-1 to 1-4, 2-1 to 2-4. Wiper 75 (1) wipes the nozzle faces 1-1*a*, 1-3*a* of the head units 1-1, 1-3; wiper 75 (2) wipes the nozzle faces 1-2*a*, 1-4*a* of head units 1-2, 1-4; wiper 75 (3) wipes the nozzle faces 2-1*a*, 2-3*a* of head units 2-1, 2-3; and wiper 75 (4) wipes the nozzle faces 2-2*a*, 2-4*a* of head units 2-2, 2-4. The wipers 75 (1) to 75 (4) move bidirectionally in the wiper movement direction H along the long side of the maintenance device 40. The wiper movement direction H is parallel to the ink nozzle line of the inkjet head 11 at the home position B.

The wiper-pump drive transfer mechanism 90 has a drive motor 91 that drives the wiper unit 70 and ink suction pump 94. The wiper-pump drive transfer mechanism 90 also has a drive switching mechanism 100 (see FIG. 8A). The drive switching mechanism 100 switches to a state enabling moving the wiper or a state enabling driving the suction pump according to the position of the cap unit 60, that is, the position to which the caps 64 (1) to 64 (4), 65 (1) to 65 (4) move.

Configuration of Parts of the Maintenance Device

The specific configuration of parts of the maintenance device 40 is described next.

Cap Unit 60

Described with reference to FIG. 5A, FIG. 5B, and FIG. 6, the cap unit 60 has a cap frame 61, and first and second cap bases 62, 63 (cap support members) affixed to the cap frame 61. Four caps 64 (1) to 64 (4) are disposed to the first cap base 62, and four caps 65 (1) to 65 (4) are disposed to the second cap base 63. As may be needed, caps 64 (1) to 64 (4) are also referred to as caps 64, and caps 65 (1) to 65 (4) are referred to as caps 65.

Caps 64 (1) to 64 (4) have the same shape, and have a lip (cap opening edge) with a long, narrow rectangular profile that can cover and enclose the nozzle faces 1-1*a* to 1-4*a*, 2-1*a* to 2-4*a* of the head units 1-1 to 1-4, 2-1 to 2-4. Caps 64 (1), 64 (3) are disposed in line in the lengthwise direction thereof with a specific gap therebetween. Caps 64 (2), 64 (4) are also disposed in line in the lengthwise direction thereof with a specific gap therebetween. The caps 64 (1), 64 (3) in one cap row are staggered relative to the caps 64 (2), 64 (4) in the other cap row. The caps 64 (1) to 64 (4) are each supported on the first cap base 62 by a pair of spring members 62*a* (cap pressure members) such as a pair of compression springs (see FIG. 18A and FIG. 22A). The pair of spring members 62*a* are disposed between the lengthwise ends of each cap 64 (1) to 64 (4) and the bottom part of the first cap base 62.

The caps 65 (1) to 65 (4) on the second cap base 63 have the same shape as the caps 64 (1) to 64 (4), and are arranged in the same configuration. The caps 65 (1) to 65 (4) are each supported on the second cap base 63 by a pair of spring members 63*a* (cap pressure members) such as a pair of compression springs. The pair of spring members 63*a* are disposed at the lengthwise ends of the caps (1) to 65 (4).

Caps 64 (1) to 64 (4) respectively cap the head units 1-1 to 1-4 of the first head 11A of the inkjet head 11 shown in FIG. 4. Caps 65 (1) to 65 (4) respectively cap the head units 2-1 to 2-4 of the second head 11B shown in FIG. 4.

The cap unit 60 has a diagonal cap removal mechanism 160 as further described below (see FIG. 18A to FIG. 18C). In the operation whereby the caps 64 (1) to 64 (4), 65 (1) to 65 (4) respectively cap the nozzle faces 1-1*a* to 1-4*a*, 2-1*a* to 2-4*a* of the head units 1-1 to 1-4, 2-1 to 2-4, the diagonal cap removal mechanism 160 holds the lip face (the end surface of the cap opening edge) parallel to the nozzle face. In the uncapping operation, the diagonal cap removal mechanism 160 tilts the lip face to the nozzle face.

Wiper Unit 70

Described with reference to FIG. 5A, FIG. 5B, and FIG. 6, the wiper unit 70 has a rectangular wiper frame 71. A pair of guide shafts 72 extend parallel to the long side of the wiper frame 71 between the short side ends of the wiper frame 71. A wiper holder unit 73 is disposed slidably along the pair of guide shafts 72.

One lengthwise end of the wiper unit 70 is the home position 73A of the wiper holder unit 73. The wiper holder unit 73 can slide along the guide shafts 72 between the home position 73A and the opposite end of the wiper unit 70. The wiper movement direction H is the direction of wiper holder unit 73 movement determined by the guide shafts 72.

Four wiper holders 74 (1) to 74 (4) are disposed to the wiper holder unit 73. One wiper 75 (1) to 75 (4) is disposed to each of the wiper holders 74 (1) to 74 (4). As necessary, wiper holders 74 (1) to 74 (4) are also referred to as wiper holders 74, and wipers 75 (1) to 75 (4) as wipers 75.

Wiper 75 (1) wipes the nozzle faces of the two head units 1-1, 1-3 in the outside row of the first head 11A shown in FIG. 4. Wiper 75 (2) wipes the nozzle faces of the other two head units 1-2, 1-4. Likewise, wiper 75 (3) wipes the two head units 2-1, 2-3 on the inside row of second head 11B shown in FIG. 4. Wiper 75 (4) wipes the two remaining head units 2-2, 2-4.

Cap Drive Transfer Mechanism

Figure 7A:
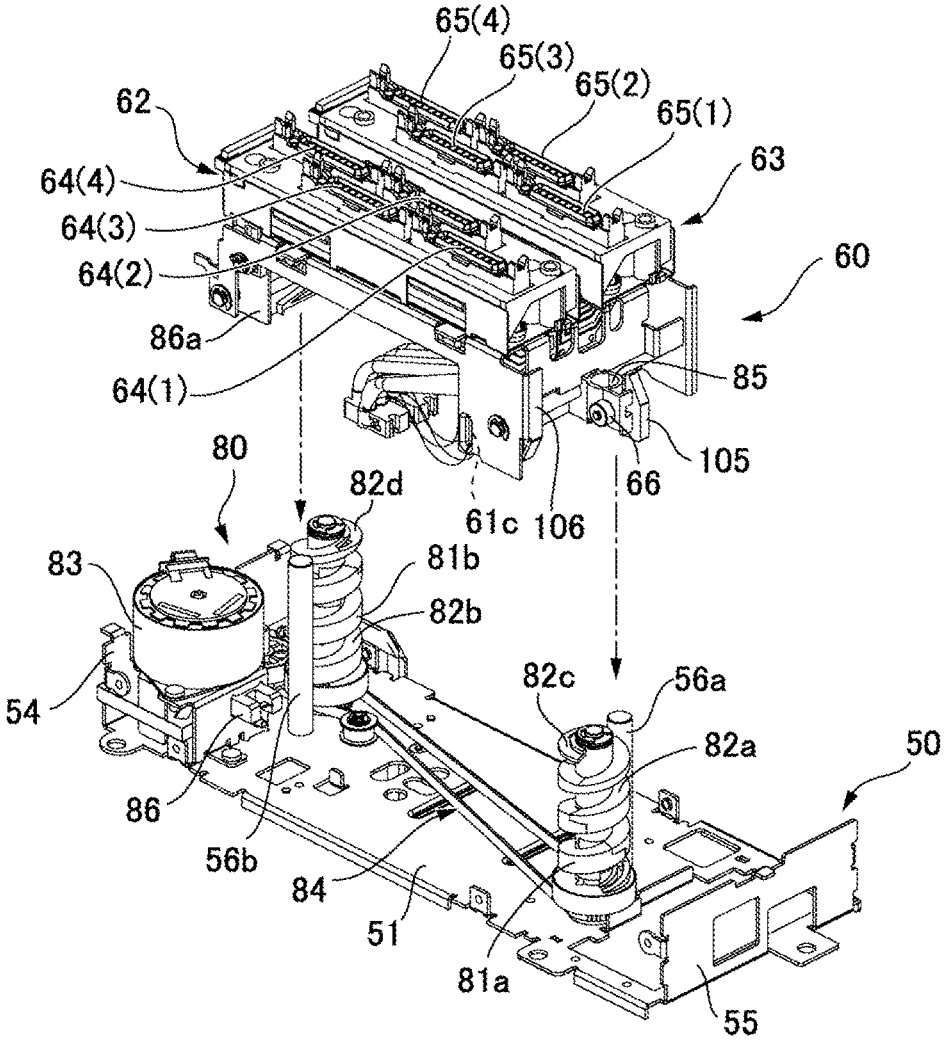
FIG. 7A is an exploded oblique view showing the cap drive transfer mechanism.
Figure 7B:
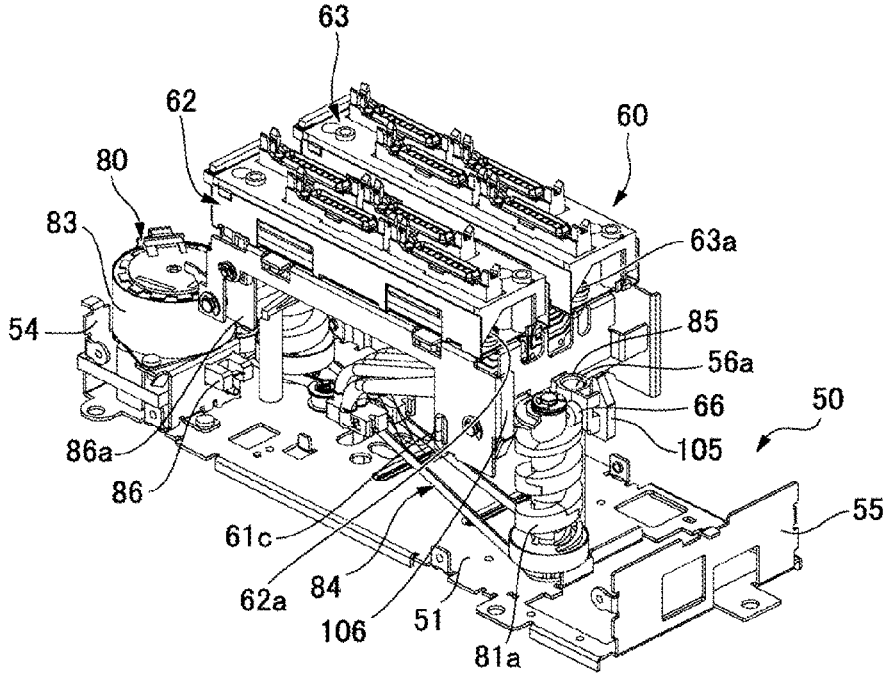
FIG. 7B is an oblique view showing the cap drive transfer mechanism.

FIG. 7A and FIG. 7B show the cap drive transfer mechanism 80 that moves the cap unit 60. FIG. 7A is an exploded view without the side walls 52, 53 of the device frame 50, and FIG. 7B is an oblique view with the cap unit 60 assembled to the device frame 50.

The cap drive transfer mechanism 80 has a pair of spiral cams 81*a*, 81*b* disposed to the device frame 50. The spiral cams 81*a*, 81*b* are disposed adjacent to the guide posts 56*a*, 56*b*. The spiral cams 81*a*, 81*b* are supported on the bottom panel 51 freely rotatably around a center axis perpendicular to the bottom panel 51. A spiral channel is formed in the direction of the center axis in the outside surface of the spiral cams 81*a*, 81*b*. The top side of each spiral channel is a cam surface 82*a*, 82*b* that extends at a specific pitch in a vertical spiral.

A pair of cam follower rollers 66 (only one roller 66 is shown in the figure) is disposed freely rotatably to the cap frame 61 of the cap unit 60. The rollers 66 can travel freely along the cam surface 82*a*, 82*b*. A guide hole 85 (only one guide hole 85 is shown in the figure) is formed at a position adjacent to each roller 66 in the cap frame 61. The guide posts 56*a*, 56*b* pass freely slidably through the guide holes 85. A motor 83 is located at one lengthwise end of the bottom panel 51. A motor disposed to the main part of the inkjet printer 1 can be used as the drive source instead of the motor 83. Torque from the motor 83 is transferred through a belt and pulley power transfer mechanism 84 to the spiral cams 81*a*, 81*b*. The spiral cams 81*a*, 81*b* rotate synchronously on their axes of rotation.

When the motor 83 turns, the pair of spiral cams 81*a*, 81*b* turn. The rollers 66 of the cap unit 60 riding on the spiral cam surfaces 82*a*, 82*b* roll along the cam surfaces 82*a*, 82*b*. As a result, the cap unit 60 moves in the cap movement direction V, in the top-bottom direction of the printer in this embodiment, guided by the pair of guide posts 56*a*, 56*b*. When the cap unit 60 moves up, that is, moves in the capping direction V1 toward the nozzle face 11*a* of the inkjet head 11 in the home position B, the caps 64 (1) to 64 (4), 65 (1) to 65 (4) cap the nozzle faces of the head units 1-1 to 1-4, 2-1 to 2-4 of the inkjet head 11 from below.

The position of the cap unit 60 in the cap movement direction V is controlled based on the output of a position detector 86. The position detector 86 is a photo interrupter, for example, and is disposed adjacent to the motor 83. An interrupter 86*a* is disposed to the cap frame 61 of the cap unit 60. When the cap unit 60 moves along the cap movement direction V in the uncapping direction V2, the output of the position detector 86 changes. The cap unit 60 is known to have reached the standby position based on this output. The position of the cap unit 60 can be controlled based on the output of the position detector 86 and the encoder pulse count of a rotary encoder (not shown in the figure) built in to the motor 83. More specifically, the position of the caps 64 (1) to 64 (4) and 65 (1) to 65 (4) in the cap movement direction V can be known.

Wiper-Pump Drive Transfer Mechanism 90

Figure 8A:
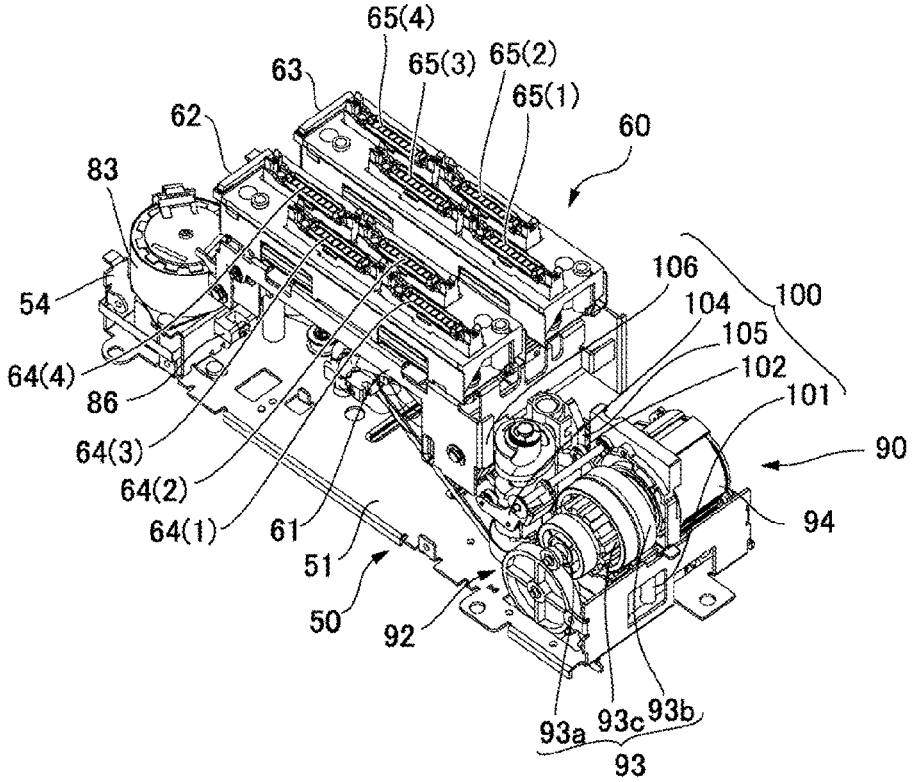
FIG. 8A is an oblique view showing the wiper-pump drive transfer mechanism.
Figure 8B:
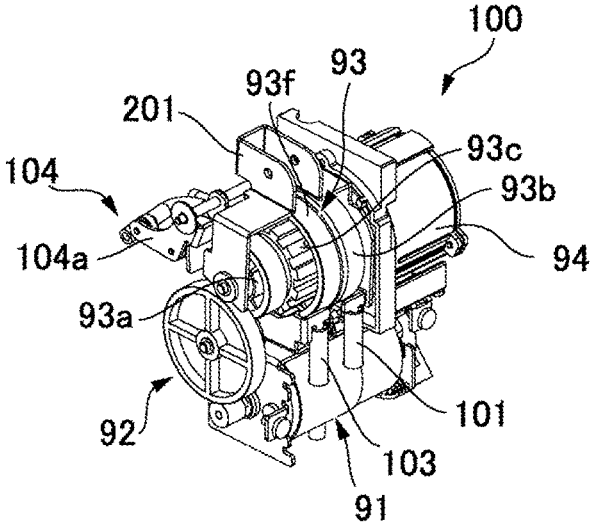
FIG. 8B is an oblique view showing the wiper-pump drive transfer mechanism.
Figure 8C:
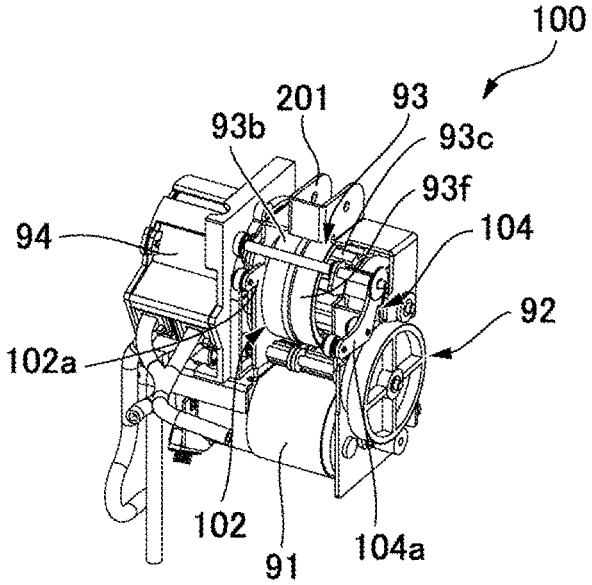
FIG. 8C is an oblique view showing the wiper-pump drive transfer mechanism.
Figure 8D:
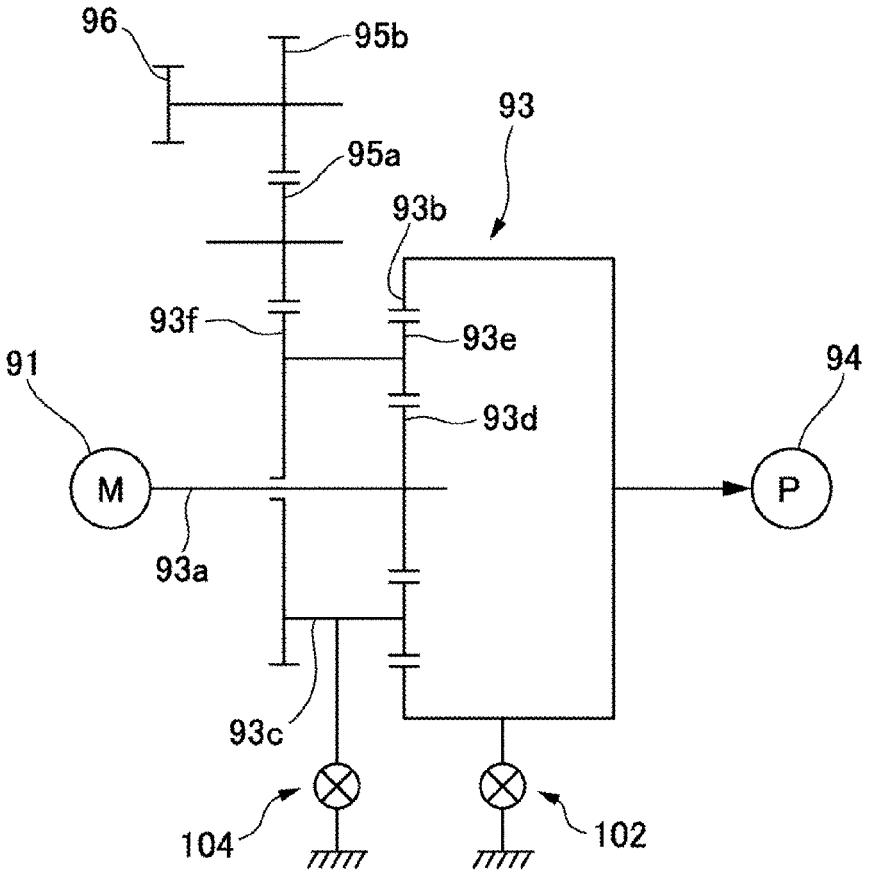
FIG. 8D is a schematic skeleton diagram of the wiper-pump drive transfer mechanism.
Figure 8E:
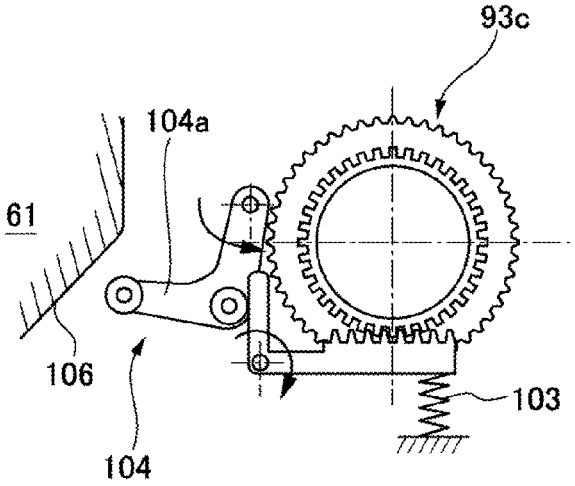
FIG. 8E describes the drive switching mechanism.
Figure 8F:
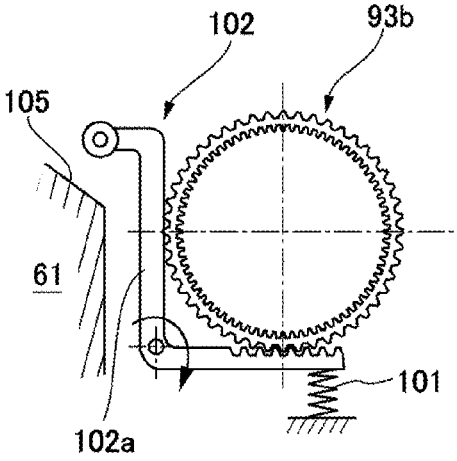
FIG. 8F describes the drive switching mechanism.

FIG. 8A is an oblique view showing the wiper-pump drive transfer mechanism 90 and cap unit 60 installed to the device frame 50, omitting part of the wiper-pump drive transfer mechanism 90 and the side walls 52, 53 of the device frame 50. FIG. 8B and FIG. 8C are oblique views of the wiper-pump drive transfer mechanism 90. FIG. 8D is a schematic skeleton diagram of main parts of the wiper-pump drive transfer mechanism 90, and FIG. 8E and FIG. 8F describe the operation of the drive switching mechanism 100.

Figure 9A:
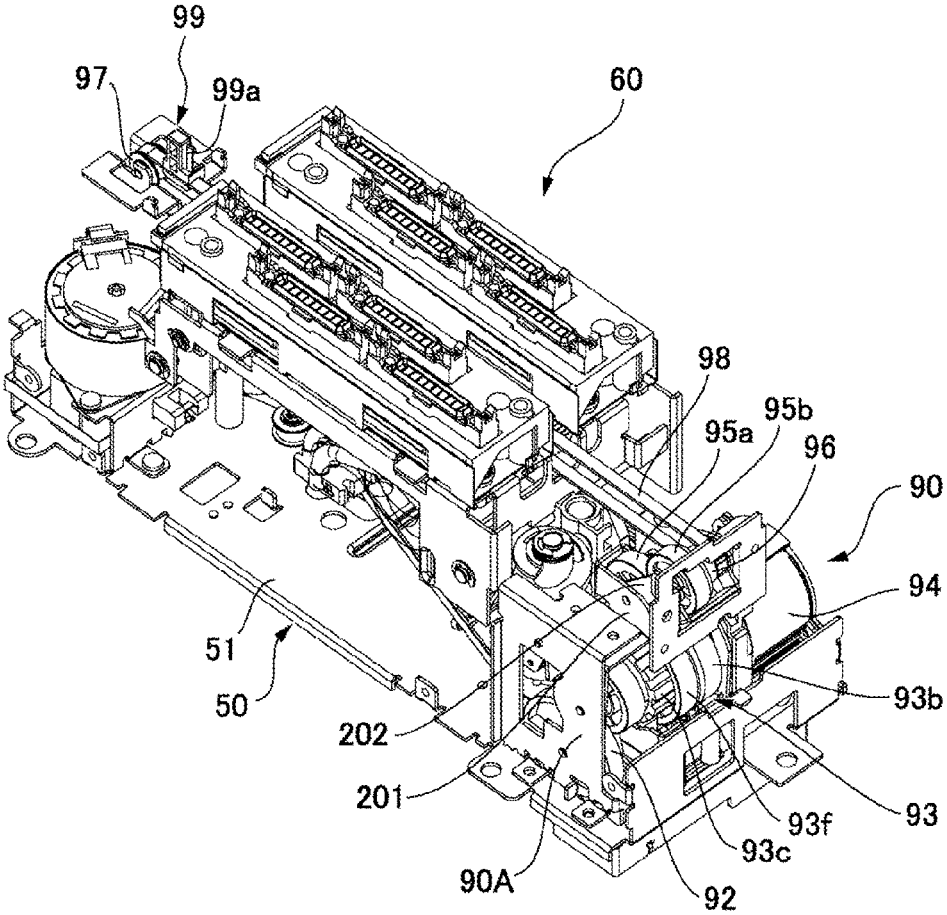
FIG. 9A is an oblique view showing the wiper-pump drive transfer mechanism.
Figure 9B:
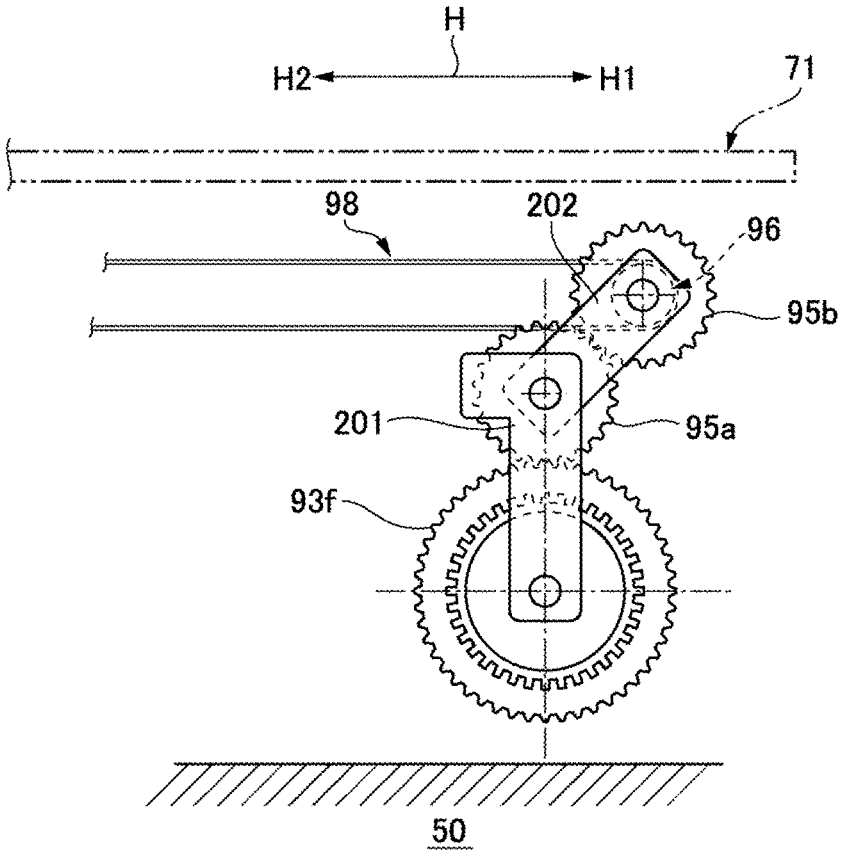
FIG. 9B is an oblique view showing the wiper-pump drive transfer mechanism.
Figure 9C:
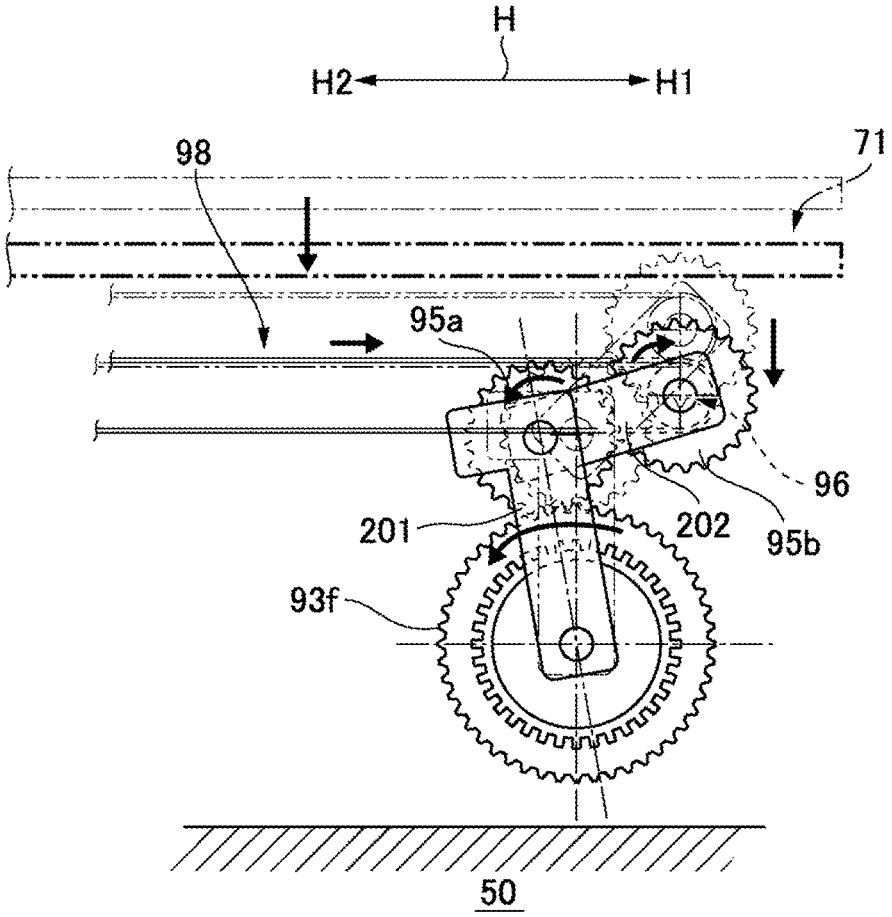
FIG. 9C is an oblique view showing the wiper-pump drive transfer mechanism.

FIG. 9A is an oblique view showing the wiper-pump drive transfer mechanism 90 and cap unit 60 installed to the device frame 50, omitting the side walls 52, 53 of the device frame 50. FIG. 9B and FIG. 9C describe the power transmission path to the wiper side.

Figure 10:
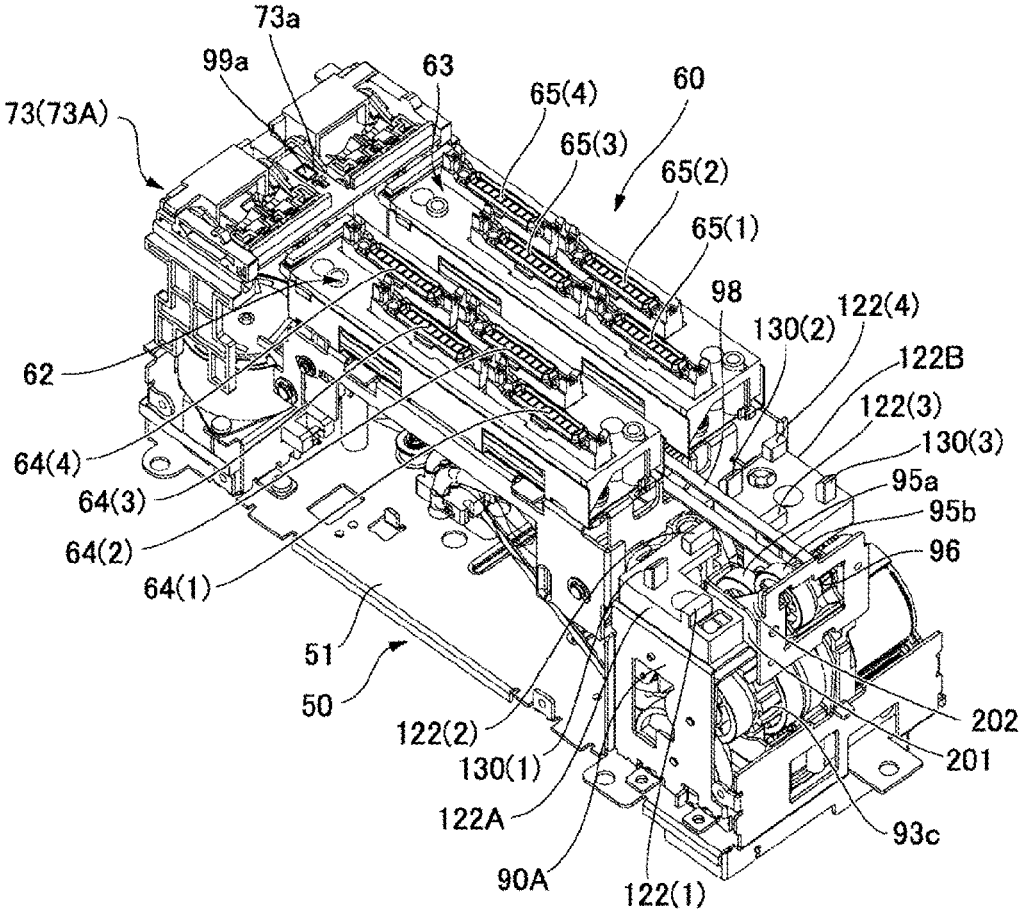
FIG. 10 is an oblique view showing the wiper-pump drive transfer mechanism.

FIG. 10 is an oblique view showing the wiper-pump drive transfer mechanism 90 and cap unit 60 installed to the device frame 50. In this figure, the side walls 52, 53 of the device frame 50 are omitted, and the wiper holder unit 73 of the wiper unit 70 is assembled to the wiper-pump drive transfer mechanism 90.

As shown in FIG. 8A to FIG. 8D, the wiper-pump drive transfer mechanism 90 has a drive motor 91 attached to the bottom panel 51. A motor mounted on the main part of the inkjet printer 1 could be used as the drive source. Rotation of the drive motor 91 is transferred through a transmission gear train 92 to the input shaft 93*a* of a planetary gear speed reducer 93. The planetary gear speed reducer 93 includes a sun gear 93*d* (see FIG. 8D) connected coaxially or formed in unison with the input shaft 93*a*, a planetary gear 93*e* (see FIG. 8D) meshed with the sun gear 93*d*, an internal gear 93*b* meshed with the planetary gear 93*e*, and a planetary carrier 93*c* that supports the planetary gear 93*e* freely rotatably.

The ink suction pump 94 is coaxially disposed behind the planetary gear speed reducer 93. The operating shaft (not shown in the figure) of the ink suction pump 94 is connected coaxially to the internal gear 93*b* of the planetary gear speed reducer 93. The speed reduced rotation extracted from the planetary gear speed reducer 93 rotationally drives the ink suction pump 94 to suction ink.

As shown in FIG. 8D and FIG. 9A, FIG. 9B, and FIG. 9C, a drive-side external gear 93*f* is formed in unison with the planetary carrier 93*c*. The drive-side external gear 93*f* is connected to a drive sprocket 96 for driving a belt through an external transfer gear 95*a* and a follower-side external gear 95*b*. The drive sprocket 96 is rotationally driven by the speed-reduced rotation extracted from the planetary carrier 93*c*.

One lengthwise end of the wiper frame 71 of the wiper unit 70 is the home position 73A of the wiper holder unit 73. As shown in FIG. 6, a driven sprocket 97 is attached freely rotatably to the end of the wiper frame 71 on the home position 73A side. A drive belt 98 is mounted on the drive sprocket 96 and the driven sprocket 97. A slider 99 is affixed to the drive belt 98.

As shown in FIG. 10, a hole 73*a* that engages a protrusion 99*a* formed on the slider 99 is formed in the wiper holder unit 73. When the drive sprocket 96 turns, the drive belt 98 moves, and the slider 99 fastened to the drive belt 98 moves in the wiper movement direction H. The wiper holder unit 73 engaged by the slider 99 moves in the wiper movement direction H. The four wipers 75 (1) to 75 (4) mounted on the wiper holder unit 73 respectively wipe the nozzle faces of head units 1-1, 1-3, head units 1-2, 1-4, head units 2-1, 2-3, and head units 2-2, 2-4.

The wiper drive transfer mechanism unit of the wiper-pump drive transfer mechanism 90 is described in further detail below with reference to FIG. 9A, FIG. 9B, and FIG. 9C. The wiper drive transfer mechanism unit includes the drive-side external gear 93*f* and external transfer gear 95*a* disposed to the device frame 50, and the follower-side external gear 95*b* disposed to the wiper frame 71. The external transfer gear 95*a* meshes with both the drive-side external gear 93*f* and follower-side external gear 95*b*.

The external transfer gear 95*a* is supported freely rotatably on the distal end part of a pivot frame 201. The base end of the pivot frame 201 is supported by the cover 90A of the wiper-pump drive transfer mechanism 90 freely pivotably around the center axis of the drive-side external gear 93*f*. Therefore, the external transfer gear 95*a* can revolve around the center axis of the drive-side external gear 93*f* while remaining meshed with the drive-side external gear 93*f*.

A connector plate 202 connects the shaft part of the external transfer gear 95*a* with the shaft part of the follower-side external gear 95*b*. The external transfer gear 95*a* and follower-side external gear 95*b* are therefore kept always engaged.

As described below, the wiper unit 70 is supported movably in the cap movement direction V by the device frame 50. The wiper unit 70 is also pushed in the capping direction V1 by a tension spring 108*b*, and raised (floats) above the device frame 50.

When the wiper frame 71 moves in the cap movement direction V, the follower-side external gear 95*b* on the wiper frame 71 side moves in the same direction therewith. As shown in FIG. 9B and FIG. 9C, the external transfer gear 95*a* meshed with the follower-side external gear 95*b* revolves around the center axis of the drive-side external gear 93*f* in conjunction with movement of the follower-side external gear 95*b* while remaining meshed with the follower-side external gear 95*b*. Power for moving the wiper can be transferred from the device frame 50 side to the wiper frame 71 side irrespective of movement of the wiper frame 71. This configuration does not require disposing all parts of the wiper drive transfer mechanism unit on the moving wiper frame 71, and is advantageous for reducing the weight of the wiper unit 70.

When the wiper frame 71 moves in the direction away from the nozzle face 11*a* (uncapping direction V2), the drive-side external gear 93*f* of the wiper drive transfer mechanism unit is stopped. The external transfer gear 95*a* meshed with the drive-side external gear 93*f* rotates while also revolving around the center axis of the drive-side external gear 93*f*. Therefore, the follower-side external gear 95*b* meshed with the external transfer gear 95*a* also rotates. When the follower-side external gear 95*b* rotates, the wiper holder unit 73 attached to the drive belt 98 moves slightly in the wiper movement direction H. In this example, the direction indicated by arrow H2 is the wiping direction, and the wiper holder unit 73 moves slightly in the opposite direction H1.

As a result, when the wiper unit 70 moves in the uncapping direction V2, the wiper holder unit 73 moves slightly in the opposite direction as the wiping direction H2. More specifically, the wipers 75 (1) to 75 (4) moves slightly in the opposite direction H1 as the wiping direction H2. As a result, when the wipers 75 (1) to 75 (4) are retracted in the uncapping direction V2, which is perpendicular to the nozzle faces 11*a*, after finishing wiping the nozzle faces 11*a*, each of the wipers 75 (1) to 75 (4) move in the direction H1 opposite the wiping direction H2 in a direction slightly inclined to the direction perpendicular to the nozzle faces. This wiper action can prevent foreign matter such as ink on the wiper from spreading as described below.

Drive Switching Mechanism 100

The drive switching mechanism 100 is disposed to the wiper-pump drive transfer mechanism 90, and can switch between a wiper driving position and a pump driving position. The drive switching mechanism 100 switches according to the position of the cap unit 60. The switching operation therefore depends upon the position of the caps 64 (1) to 64 (4), 65 (1) to 65 (4).

When the cap unit 60 moves a specific amount from the standby position in the capping direction V1, the internal gear 93*b* of the planetary gear speed reducer 93 can rotate freely and the planetary carrier 93*c* cannot turn. Speed-reduced rotation is output from the internal gear 93*b* in this state. As a result, the ink suction pump 94 connected to the internal gear 93*b* is driven, and ink can be suctioned from the caps 64 (1) to 64 (4) and 65 (1) to 65 (4).

Conversely, when the cap unit 60 moves from the capping position a specific distance in the uncapping direction V2 (moves a specific distance in the direction away from the nozzle face), the internal gear 93*b* of the planetary gear speed reducer 93 cannot turn and the planetary carrier 93*c* can turn freely. Speed-reduced rotation is thus output from the planetary carrier 93*c*. As a result, the wipers 75 (1) to 75 (4) mounted on the wiper holder unit 73 connected to the planetary carrier 93*c* can move. The nozzle faces of the head units 1-1 to 1-4, 2-1 to 2-4 can therefore be wiped.

Described with reference to FIG. 8A to FIG. 8F, the drive switching mechanism 100 has a first latch mechanism 102 that latches the internal gear 93*b* so that it cannot turn by means of the spring force of a first tension spring 101, and a second latch mechanism 104 that latches the planetary carrier 93*c* so that it cannot turn by means of the spring force of a second tension spring 103. The first latch mechanism 102 has a first latch lever 102*a*, and the second latch mechanism 104 has a second latch lever 104*a* disposed to a position above the first latch lever 102*a* in the figure (a position on the side in the capping direction V1).

A first cam surface 105 that can push the first latch lever 102*a* in resistance to the spring force due to the movement of the cap unit 60 is formed on the cap frame 61 of the cap unit 60 at a position opposite the first latch lever 102*a*. A second cam surface 106 that can push the second latch lever 104*a* in resistance to the spring force due to the movement of the cap unit 60 is also formed on the cap frame 61 at a position opposite the second latch lever 104*a*.

The first and second cam surfaces 105, 106 are formed at different positions in the cap movement direction V. When the first latch lever 102*a* is pushed against the spring force, the first latch mechanism 102 is disengaged, and the internal gear 93*b* changes to the free rotation state. Conversely, when the second latch lever 104*a* is pushed against the spring force, the second latch mechanism 104 is disengaged, and the planetary carrier 93*c* changes to the free rotation state.

The wiper-pump drive transfer mechanism 90 changes to the pump driving state or the wiper driving state according to the position the cap unit 60 is moved in the cap movement direction V by the drive switching mechanism 100. By changing the position where the latch levers and cam surfaces engage in the cap movement direction V, the timing that the drive switching mechanism 100 changes can be easily adjusted or changed. A switching mechanism that is small and compact compared with a mechanism that changes the drive transfer direction using members such as a cylindrical cam or intermittent gear can therefore be achieved.

Wiper Unit 70 Support Structure

In general, wiping the nozzle face with a constant wiping pressure may not be possible when the nozzle face is long in the nozzle row direction, such as with a line inkjet head. The maintenance device may be tilted in the nozzle row direction (wiper movement direction) relative to the nozzle face of the inkjet head. In this configuration, the wiper pressure on the nozzle face varies while wiping, and the nozzle face of each head unit cannot be wiped with a constant wiping pressure.

To eliminate this problem, providing the maintenance device with a mechanism that can move the wiper parallel to the nozzle face is desirable. Rendering such a mechanism with a simple configuration using few parts is desirable from the perspective of achieving a small, compact maintenance device. As a result, the wiper unit 70 in this example is supported by the device frame 50 as follows.

Figure 11A:
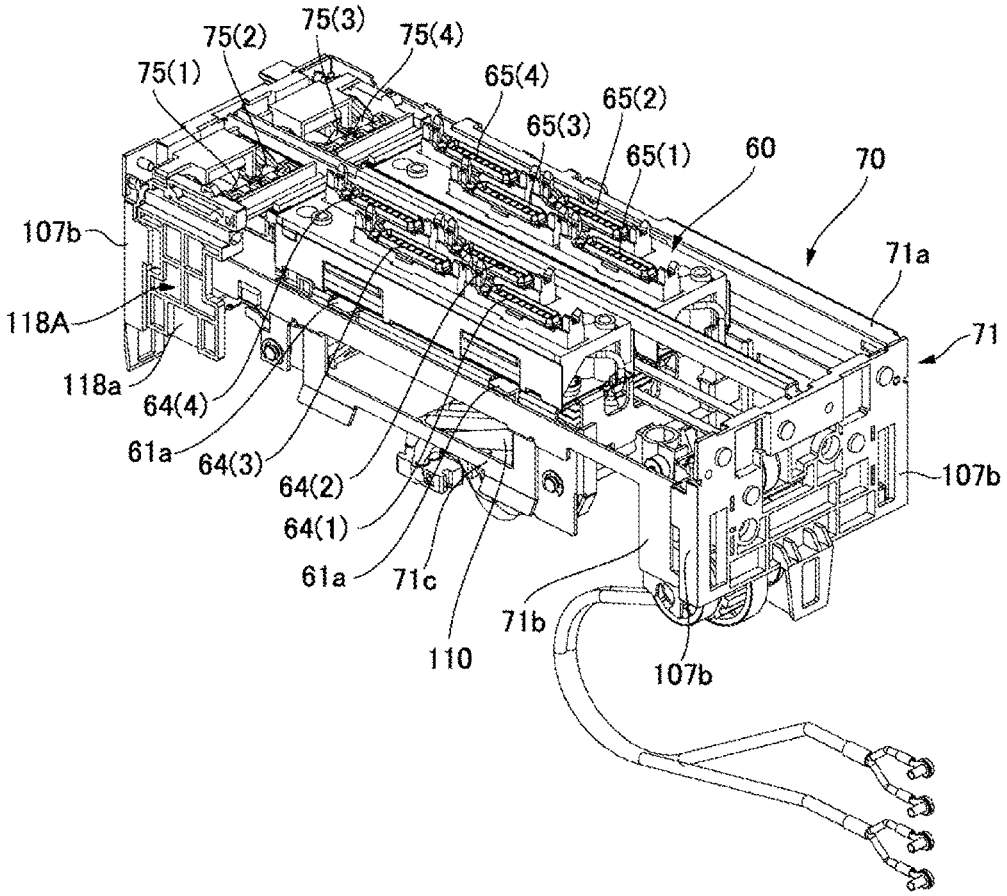
FIG. 11A is an oblique view of the wiper unit.
Figure 11B:
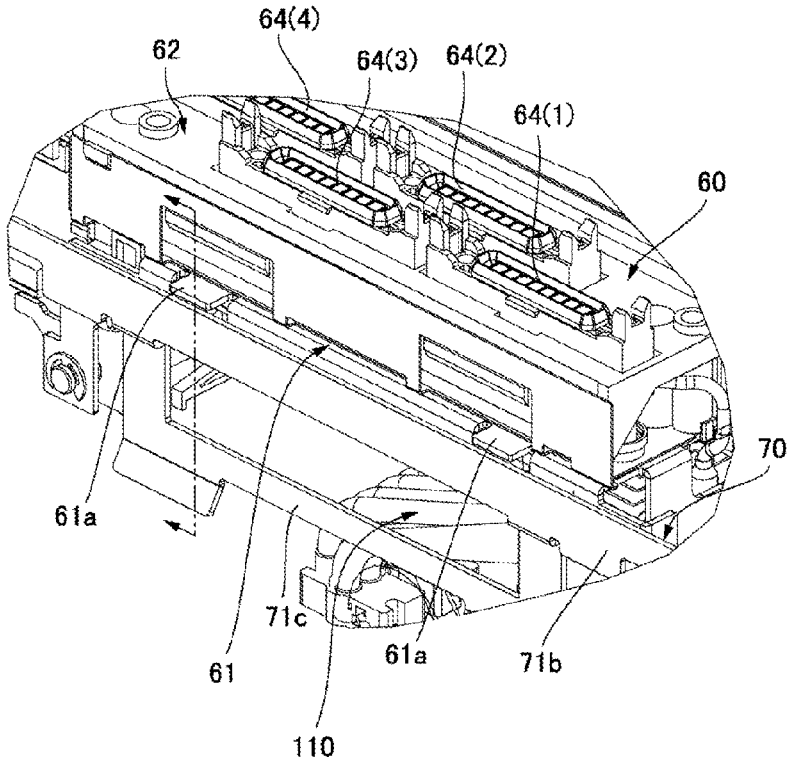
FIG. 11B is an enlarged oblique view of part of the wiper unit.
Figure 11C:
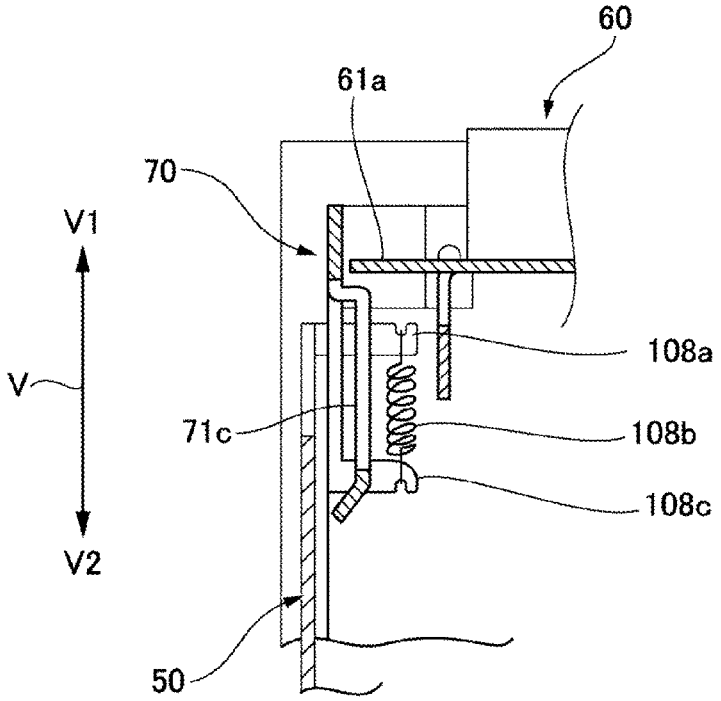
FIG. 11C describes the device frame, cap unit, and wiper frame.

FIG. 11A is an oblique view showing the wiper unit 70 assembled with the cap unit 60. FIG. 11B is an enlarged oblique view showing part of the side. FIG. 11C describes the relationship between the device frame 50, cap unit 60, and wiper frame 71.

The wiper unit 70 is supported by the device frame 50 in a position pulled up (pushed) by spring force in the capping direction. As shown in FIG. 6 and FIG. 11C, a guide 107*a* is formed projecting in the capping direction V1 at each of the four corners of the device frame 50. Each of the four corners of the wiper frame 71 of the wiper unit 70 is a guided part 107*b* that is guided in the cap movement direction V along the inside surface of the corresponding guide 107*a*. A spring catch 108*a* is formed at the top edge of each guide 107*a* of the device frame 50. One end of a tension spring 108*b* is mounted on each spring catch 108*a*. A spring catch 108*c* is also formed at a position on the inside of each of the four corners of the wiper frame 71. The bottom end of the tension spring 108*b* is mounted on this spring catch 108*c*.

The wiper unit 70 is thus held movably in the cap movement direction V relative to the device frame 50, and is attached to the device frame 50 by the four tension springs 108*b* so that the wiper unit 70 floats. More specifically, the wiper unit 70 is constantly pushed up (in the capping direction) by the tension springs 108*b*, and the wiper unit 70 can be pushed down (in the uncapping direction) against the spring force of the tension springs 108*b*.

A stop that regulates the up position (the position in the capping direction V1) of the wiper unit 70 is disposed between the device frame 50 and the wiper frame 71 of the wiper unit 70. As will be known from FIG. 5A, a pair of engaging tabs 109*a* are formed on the end panel 54 of the device frame 50. A pair of engaging frames 109*b* through which the engaging tabs 109*a* pass are formed in the wiper frame 71. As will be known from FIG. 6, an engaging tab 109*c* is also formed on the other end panel 55 of the device frame 50. An engaging frame 109*d* through which the engaging tab 109*c* passes is formed in the wiper frame 71.

The wiper unit 70 that thus floats on the device frame 50 moves together with the cap unit 60 in a specific range in the cap movement direction V. Described with reference to FIG. 11A to FIG. 11C, rectangular frames 71*c* are formed set back to the inside in both side panels 71*b* of the wiper frame 71 of the wiper unit 70. A pair of engaging tabs 61*a* that project to the side are formed on both sides of the cap frame 61 of the cap unit 60.

When the cap unit 60 moves from the capping position in the uncapping direction V2, the wiper unit 70, which is pulled up by the tension spring 108*b*, does not move. When the cap unit 60 moves a specific distance from the capping position in the uncapping direction V2, the engaging tabs 61*a* engage the rectangular frames 71*c*. Thereafter, the wiper unit 70 is moved forcibly in the uncapping direction V2 together with the cap unit 60.

When the cap unit 60 moves in the capping direction V1 from the standby position separated from the nozzle face side, the wiper unit 70 moves in the capping direction with the cap unit 60 due to the spring force of the tension springs 108*b*.

When the cap unit 60 has moved to the end in the capping direction V1, the engaging tabs 61*a* of the cap unit 60 are separated in the capping direction V1 from the rectangular frames 71*c* of the wiper frame 71 as shown in FIG. 11B. The wiper unit 70 is therefore held by the spring force of the tension springs 108*b* at a specific position by the engagement of the engaging tabs 109*a*, 109*c* and engaging frames 109*b*, 109*d*.

A contact surface 71*a* is formed at an elevated position along both lengthwise edges at the top of the wiper frame 71 of the wiper unit 70. When the cap unit 60 moves in the capping direction V1, these contact surfaces 71*a* contact a part on the inkjet head 11 side, specifically the bottom of the head carriage 10 carrying the inkjet head 11 (the rectangular bottom 10*a* surrounding the first and second heads 11A, 11B in FIG. 4) in this example, before the lips (the end surface of the cap opening edge) of the caps 64 (1) to 64 (4) and 65 (1) to 65 (4).

The wiper unit 70 carrying the wipers 75 (1) to 75 (4) is supported in a floating state on the device frame 50. When the cap unit 60 moves in the capping direction V1 approaching the nozzle face, the wiper unit 70 is released from the cap unit 60 and pushed in the capping direction V1 by the spring force of the tension springs 108*b*. Before the caps 64 (1) to 64 (4) and 65 (1) to 65 (4) of the cap unit 60 contact the nozzle face 11*a* of the inkjet head 11, the contact surface 71*a* of the wiper frame 71 of the wiper unit 70 contacts the bottom of the head carriage 10 on the inkjet head 11 side.

As a result, the wiper unit 70 is positioned to the nozzle face 11*a* of the inkjet head 11. Even if the inkjet head 11 is tilted relative to the maintenance device 40, the wiper unit 70 is positioned to follow the slope of the inkjet head 11. Each of the plural wipers 75 (1) to 75 (4) included in the wiper unit 70 is positioned with a specific gap to the corresponding nozzle faces of the head units 1-1 to 1-4, 2-1 to 2-4 of the inkjet head 11.

Each of the wipers 75 (1) to 75 (4) can therefore be pressed with a constant wiping force against the corresponding nozzle faces, and the nozzle faces can be reliably wiped with appropriate pressure. More specifically, when the contact surface 71*a* of the wiper frame 71 is in contact with the bottom of the carriage 10, the wipers 75 (1) to 75 (4) are raised to the upright position as described below. When the wipers 75 (1) to 75 (4) thus positioned are moved in the wiping direction H2, the distal end of each wiper can be pressed with specific pressure against the nozzle faces 1-1*a* to 1-4*a*, 2-1*a* to 2-4*a* of the head units 1-1 to 1-4, 2-1 to 2-4 in the inkjet head 11.

Selective Suction Mechanism

Generally when the inkjet head is composed of plural head units, suctioning ink only from the head units that require maintenance is desirable. Being able to perform selective suctioning with a small, compact mechanism is advantageous for reducing the size and cost of the maintenance device.

The maintenance device 40 in this example has a selective suction mechanism for individually selectively suctioning each of the plural caps 64 (1) to 64 (4) and 65 (1) to 65 (4) using the suction pump 94. In other words, the maintenance device 40 has a selective suction mechanism that selectively suctions ink from the head units 1-1 to 1-4, 2-1 to 2-4 capped by the plural caps 64 (1) to 64 (4) and 65 (1) to 65 (4).

FIG. 12A to FIG. 12D describe the selective suction mechanism. A selective suction mechanism that selects caps 65 (1) to 65 (4) is disposed on the one side wall 52 side of the device frame 50. A selective suction mechanism that selects caps 64 (1) to 64 (4) is disposed on the other side wall 53 side. Because both selective suction mechanisms are basically identical, the selective suction mechanism that selects caps 64 (1) to 64 (4) is described below.

The caps 64 (1) to 64 (4) and the suction port of the suction pump 94 are connected through a suction tube 110 that branches into four parts from the suction port (FIG. 11A), and four valves 112A to 115A disposed on the side wall 53 side of the device frame 50. The valves 112A to 115A are normally-closed valves that are held in a normally closed state by an internal diaphragm (not shown in the figure).

When the operating lever 112*a* to 115*a* of a valve 112A to 115A is pressed, the diaphragm displaces and the valve opens. When pressure on the operating lever 112*a* to 115*a* is released, the valve closes again due to the elastic resilience of the diaphragm. These valves 112A to 115A are arrayed in the wiper movement direction H. When the valves 112A to 115A open, the ink suction path that suctions ink from the caps 64 (1) to 64 (4) opens, and ink can be suctioned by the ink suction pump 94.

A rectangular window that is long in the wiper movement direction H is formed in the side wall 53 opposite the operating levers 112*a* to 115*a* of the valves 112A to 115A. A guide shaft 116*a* extending in the wiper movement direction H is disposed along the top edge of the window. A valve selector 117A is disposed slidably along this guide shaft 116*a* and a guide rail 116*b* formed by the bottom edge of the window.

The valve selector 117A can move along the guide shaft 116*a* to a position opposite the operating levers 112*a* to 115*a* of the valves 112A to 115A. The valve selector 117A has an engaging tab 117*a* protruding in the capping direction along the outside surface of the side wall 53, and a lever operator 117*b* that protrudes to the inside of the side wall 53. When the valve selector 117A moves to the position opposite an operating lever 112*a* to 115*a* of a valve 112A to 115A, the operating lever 112*a* to 115*a* is pushed by the lever operator 117*b* and the valve 112A to 115A opens.

As shown in FIG. 11A, a selector hook 118A protruding in the uncapping direction V2 is disposed to the side of the wiper holder unit 73, which moves in the wiper movement direction H. A recess 118*a* with a shape that complements the engaging tab 117*a* is formed in the selector hook 118A. The engaging tab 117*a* of the valve selector 117A can be inserted in the capping direction to this recess 118*a*. When the engaging tab 117*a* engages the recess 118*a*, the valve selector 117A can be moved along the guide shaft 116*a* in the wiper movement direction H by the wiper holder unit 73.

The selector hook 118A is therefore positioned to the valve selector 117A when the wiper holder unit 73 moves in the wiper movement direction H. The cap unit 60 is then moved a specific distance in the uncapping direction V2. As a result, the wiper unit 70 moves in the same direction, and the selector hook 118A of the wiper unit 70 engages the valve selector 117A. By then moving the wiper holder unit 73 in the wiper movement direction H, the valve selector 117A is positioned in the wiper movement direction H to one of the valves 112A to 115A.

The operating lever 112*a* to 115*a* of the valve 112A to 115A to which the valve selector 117A is positioned is held in the open position by the lever operator 117*b* of the valve selector 117A. Ink can therefore be suctioned by the suction pump 94 from the corresponding cap 65 (1) to 65 (4) through the valve 112A to 115A that is held open.

The valve 112A to 115A that performs the selective suction operation can be selected by moving the cap unit 60 (*cap*) in the cap movement direction V, and moving the wiper holder unit 73 (wiper) in the wiper movement direction H. A selective suction operation can therefore be achieved with a small, compact configuration without using a cylindrical cam, intermittent gear, rocker, or other part for changing the selection.

An all-valve operating lever 119A is disposed to the device frame 50. The all-valve operating lever 119A can simultaneously operate the operating lever 112*a* to 115*a* of each valve 112A to 115A. When the valve selector 117A is positioned adjacent to operating lever 112*a* in the wiper movement direction H, the all-valve operating lever 119A is depressed by the lever operator 117*b* of the valve selector 117A.

When the all-valve operating lever 119A is pressed, the operating levers 112*a* to 115*a* of the valves 112A to 115A are simultaneously depressed by the all-valve operating lever 119A. As a result, all of the valves 112A to 115A open. By the simple configuration of providing an all-valve operating lever 119A, ink can be suctioned simultaneously from all of the caps 64 (1) to 64 (4), or more specifically from all of the head units 1-1 to 1-4 capped thereby.

When the valve selector 117A is positioned away from the valves 112A to 115A and all-valve operating lever 119A, all of the valves 112A to 115A are kept closed.

When the valve selector 117A moves along the guide shaft 116*a*, the lever operator 117*b* interferes with the operating levers 112*a* to 115*a* of the valves 112A to 115A. To avoid this interference and move the valve selector 117A smoothly, a lever depressing operator is formed on the cap unit 60.

As will be understood from FIG. 6, a lever depressing operator 61*c* that protrudes to the inside is formed on the side wall 61*b* of the cap frame 61 of the cap unit 60. The position of this lever depressing operator 61*c* is set as described below in the cap movement direction V. When the valve selector 117A is positioned in the cap movement direction V where it can depress the operating levers 112*a* to 115*a* of the valves 112A to 115A, the lever depressing operator 61*c* is positioned where it can depress the all-valve operating lever 119A.

When the valve selector 117A slides along the guide rail 116*b*, the operating levers 112*a* to 115*a* of the valves 112A to 115A are depressed by the all-valve operating lever 119A, and the valve selector 117A can be slid without interfering with the operating levers 112*a* to 115*a*.

The mechanism for selectively suctioning the other caps 65 (1) to 65 (4) is identically configured. However, the shape of the valve selectors on each side differ slightly so that each of the caps 64 (1) to 64 (4) and 65 (1) to 65 (4) can be selectively suctioned individually.

In the following description, the valves, valve selector, selector hook, and all-valve operating lever disposed on the side wall 52 side for selecting caps 65 (1) to 65 (4) are identified as valves 112B to 115B, valve selector 117B, selector hook 118B, and all-valve operating lever 119B.

When the cap unit 60 moves in the uncapping direction V2 in the cap movement direction V, the selector hook and valve selector on one side are first engaged, and the selector hook and valve selector on the other side are then engaged.

Figure 12A:
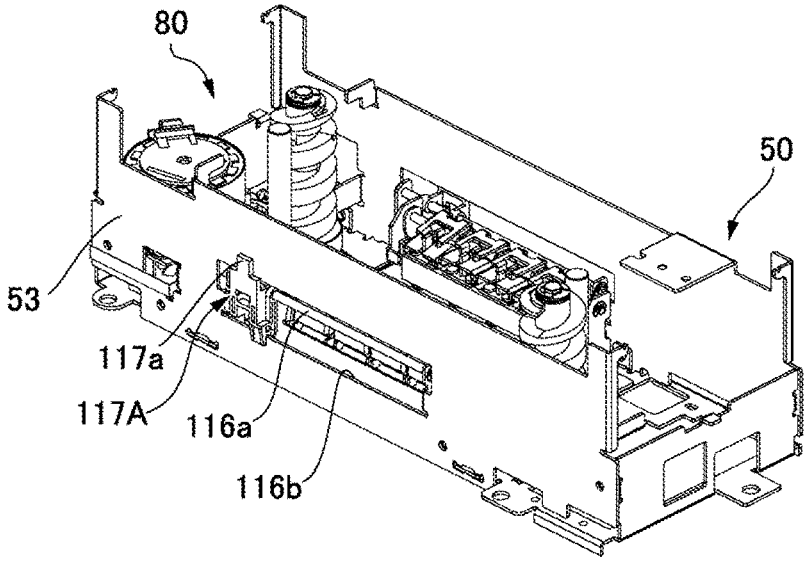
FIG. 12A describes the valve selection mechanism.
Figure 12B:
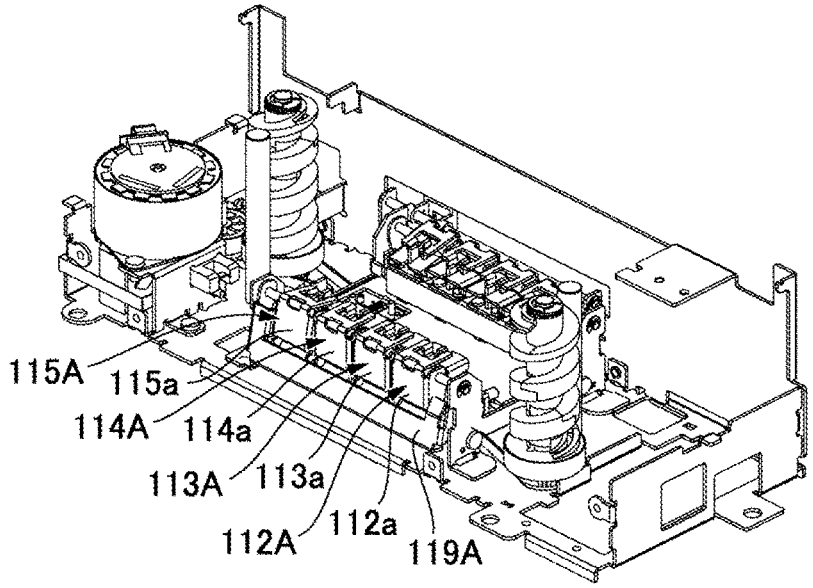
FIG. 12B describes the valve selection mechanism.
Figure 12C:
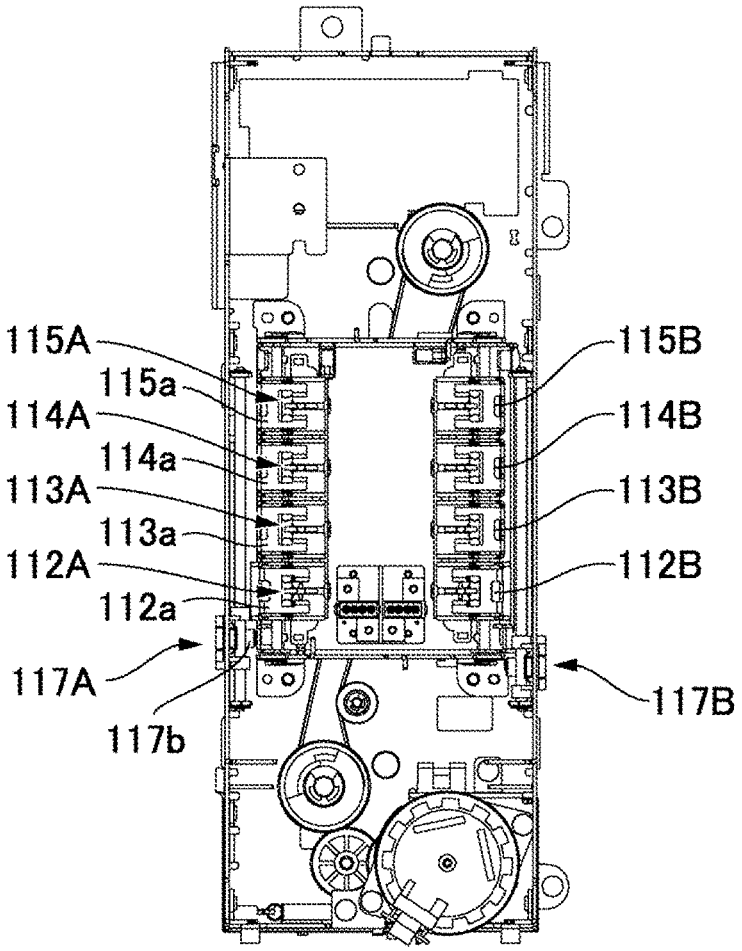
FIG. 12C describes the valve selection mechanism.
Figure 12D:
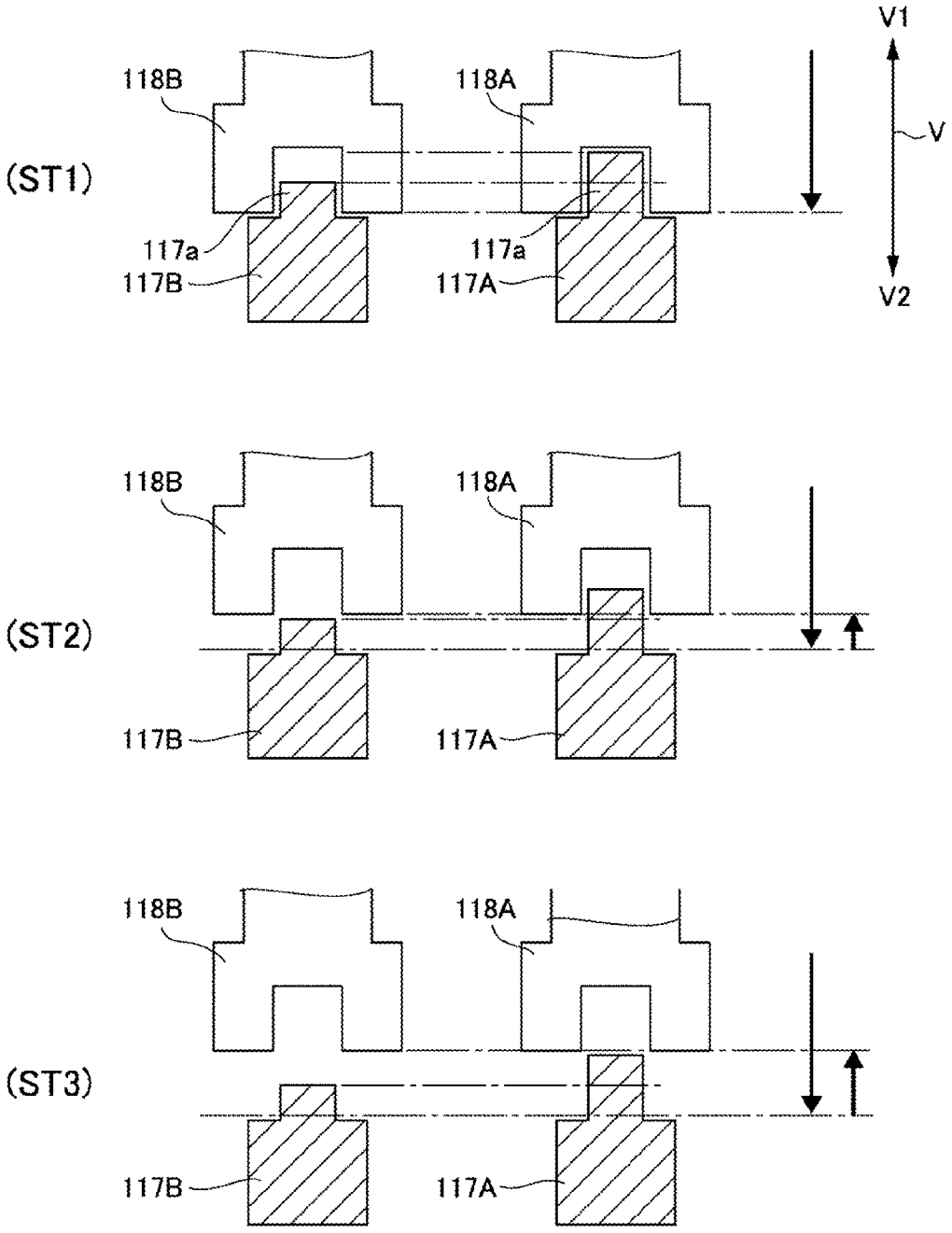
FIG. 12D describes the valve selection mechanism.

For example, as shown in FIG. 12D, the engaging tab 117*a* of the other valve selector 117B is shorter than the engaging tab 117*a* of the one valve selector 117A. When the valve selectors 117A, 117B move in the uncapping direction V2, they respectively engage the selector hooks 118A, 118B (ST1 in FIG. 12D). The wiper holder unit 73 then moves in the wiper movement direction H to move the valve selector 117B with the shorter engaging tab 117*a* to the targeted valve position in the wiper movement direction H. The other valve selector 117A also moves to the same position at the same time.

When both valve selectors 117A, 117B then move in the capping direction V1, the valve selector 117B with the shorter engaging tab 117*a* separates from the selector hook 118B first. At this time, the other valve selector 117A with the longer engaging tab 117*a* is engaged with the selector hook 118A (ST2 in FIG. 12D). If the wiper holder unit 73 is then moved in the wiper movement direction H, only the valve selector 117A that is engaged moves. As a result, the valve selector 117A can be moved to the targeted valve position.

After the targeted valve positions are selected by both valve selectors 117A, 117B, the cap unit 60 is moved in the capping direction. As a result, both valve selectors 117A, 117B separate from the selector hooks 118A, 118B (ST3 in FIG. 12D).

The cap from which ink is to be suctioned can thus be freely selected from the caps 64 (1) to 64 (4) on one side. Without being affected by the selection of caps 64 (1) to 64 (4), the cap from which is to be suctioned can also be freely selected from the caps 65 (1) to 65 (4) on the other side.

Wiper Selection Mechanism of the Wiper Unit 70

Generally when the inkjet head is composed of plural head units, wiping the head units that require maintenance is desirable. Being able to perform selective wiping with a small, compact mechanism is advantageous for reducing the size and cost of the maintenance device.

As described above, the maintenance device 40 in this example has four wipers 75 (1) to 75 (4) for wiping the nozzle faces 1-1*a* to 1-4*a*, 2-1*a* to 2-4*a* of the head units 1-1 to 1-4, 2-1 to 2-4 of the inkjet head 11. These four wipers 75 (1) to 75 (4) are held in a retracted position not contacting the head units. The wiper unit 70 has a wiper selection mechanism, and the wipers 75 (1) to 75 (4) can be individually raised from the retracted position to the upright position where contacting the head units is possible. When the wipers 75 (1) to 75 (4) are raised to the upright position, the head units 1-1 to 1-4, 2-1 to 2-4 can be wiped.

Figure 13:
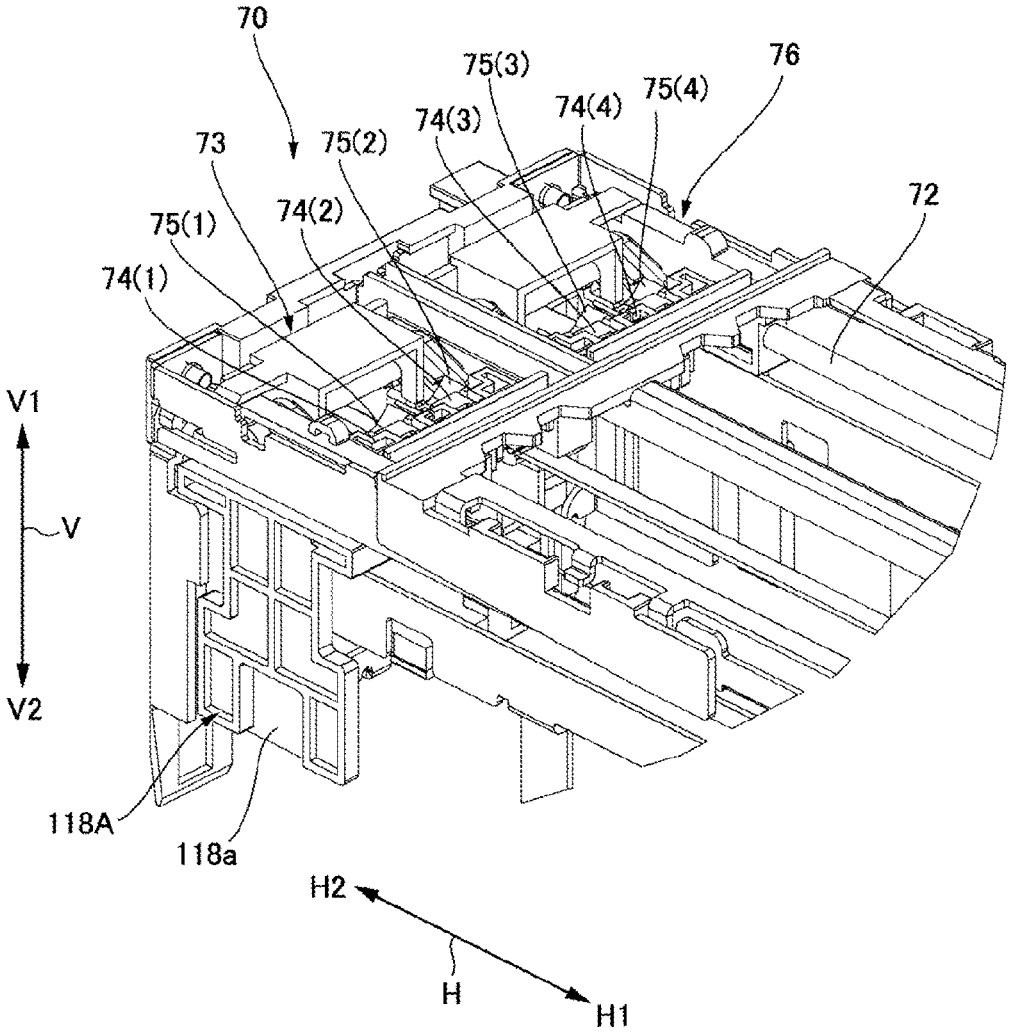
FIG. 13 is a partial oblique view of the wiper holder unit.
Figure 14A:
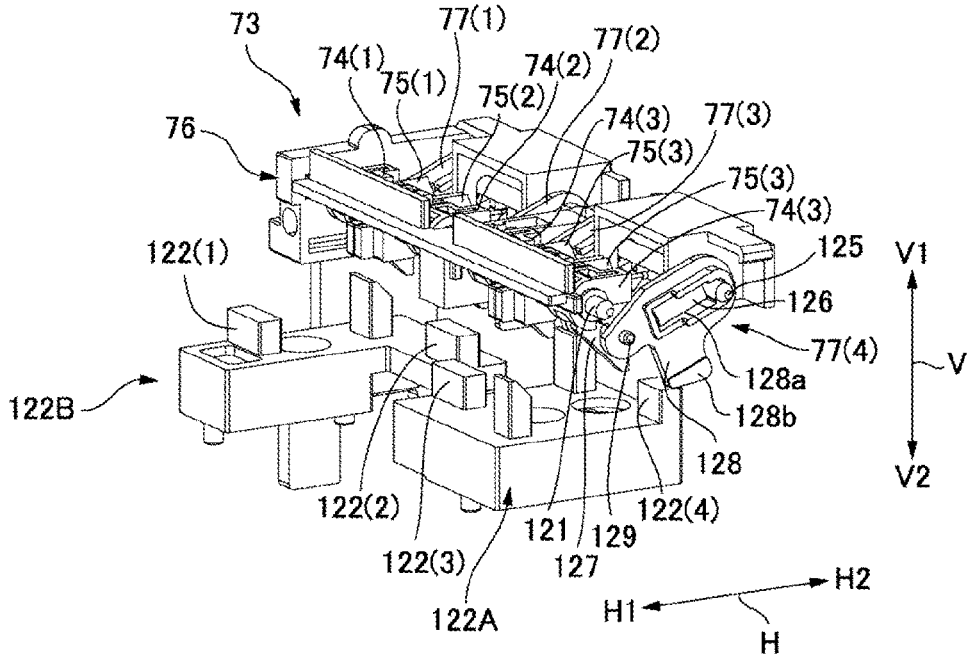
FIG. 14A is an oblique view of the wiper selection mechanism.
Figure 14B:
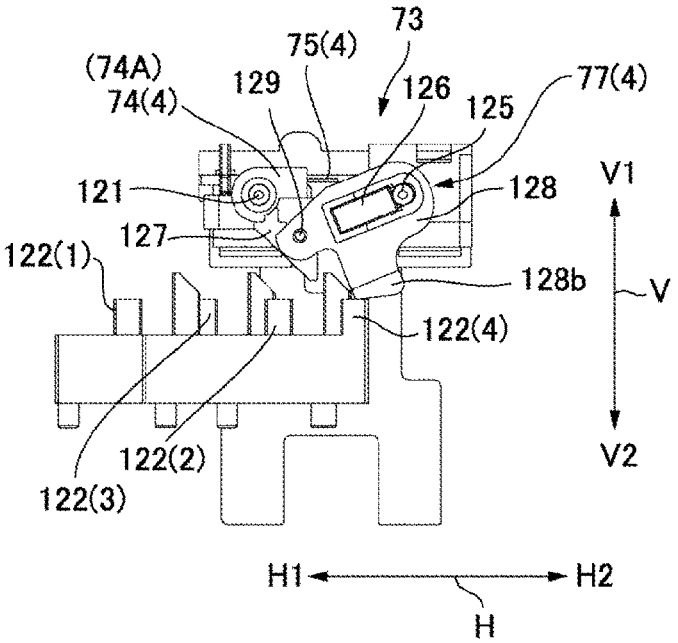
FIG. 14B is a side view of the wiper selection mechanism.
Figure 15A:
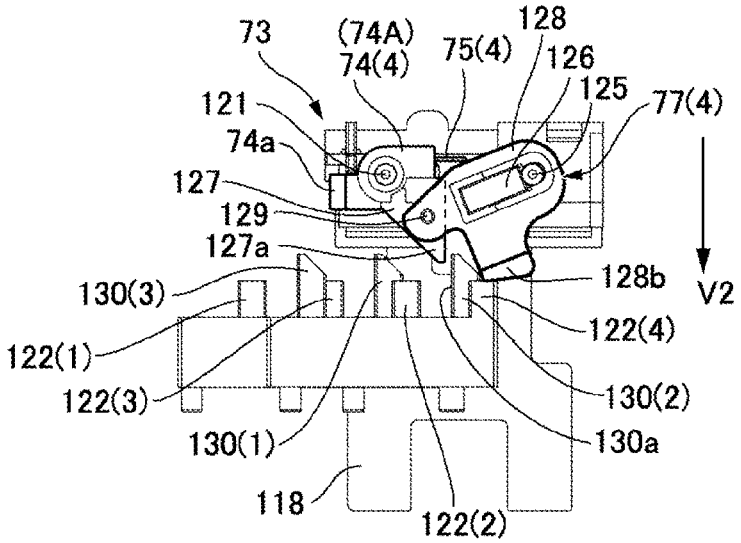
FIG. 15A describes the operation of the wiper raising member.
Figure 15B:
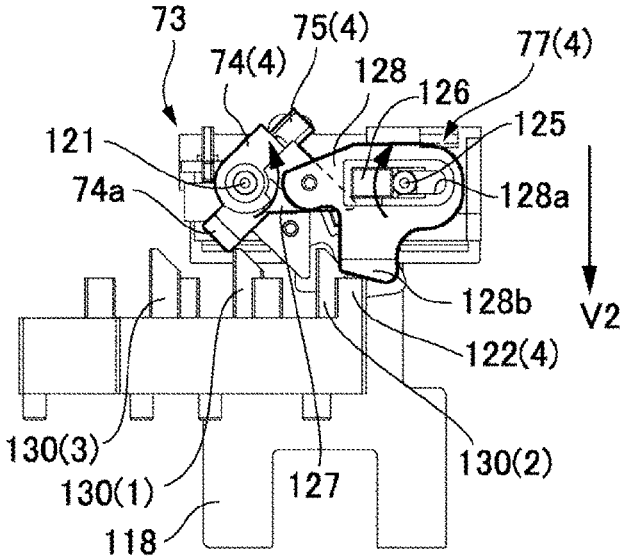
FIG. 15B describes the operation of the wiper raising member.
Figure 15C:
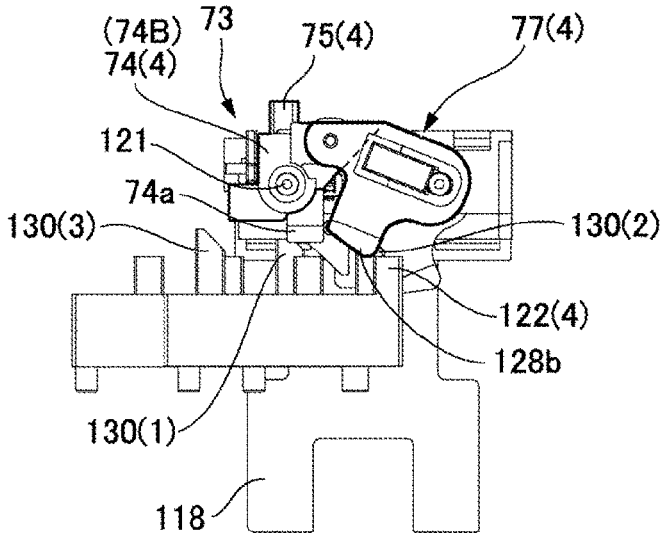
FIG. 15C describes the operation of the wiper raising member.
Figure 16A:
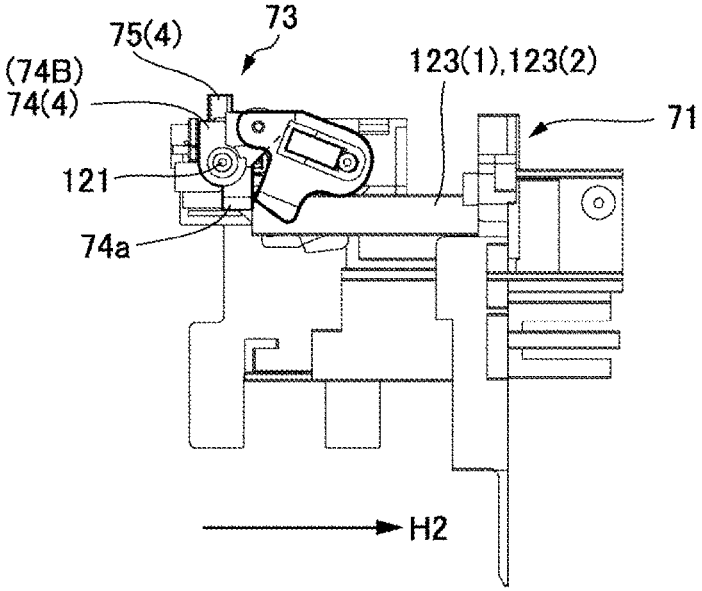
FIG. 16A describes the operation of the wiper retraction member.
Figure 16B:
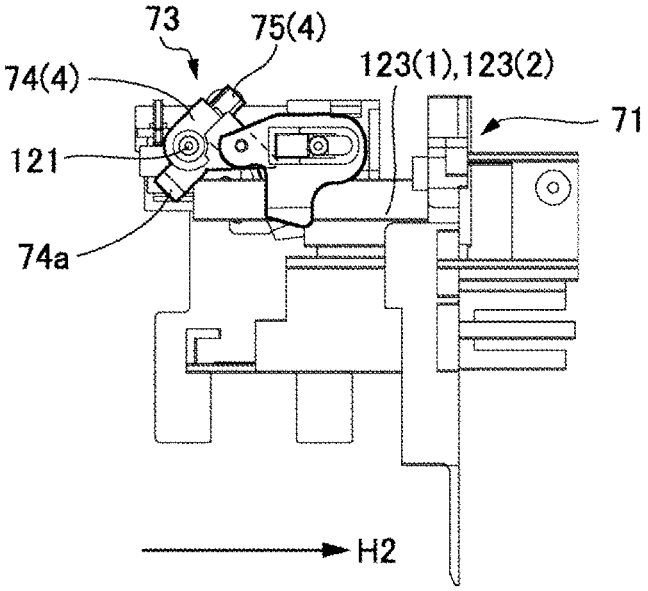
FIG. 16B describes the operation of the wiper retraction member.
Figure 16C:
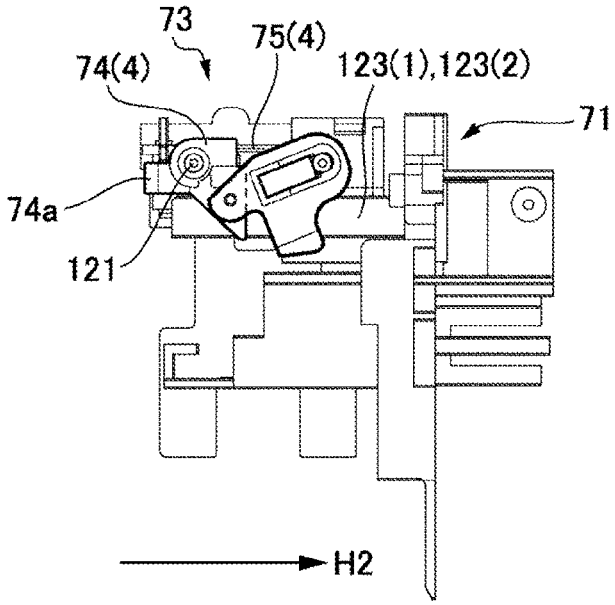
FIG. 16C describes the operation of the wiper retraction member.

FIG. 13 is an oblique view showing part of the wiper holder unit 73 of the wiper unit 70, and FIG. 14A and FIG. 14B are an oblique view and a side view of the wiper selection mechanism. FIG. 15A to FIG. 15C describe the wiper raising operation of the wiper raising member. FIG. 16A to FIG. 16C describe the wiper retracting operation of the wiper retraction member.

As shown in FIG. 13 and FIG. 14A, the wiper holder unit 73 has a slide frame 76 that can slide in the wiper movement direction H along the guide shafts 72 on opposite sides. A pivot shaft 121 spans the slide frame 76 in the direction perpendicular to the wiper movement direction H. The four wiper holders 74 (1) to 74 (4) are disposed along the axis of the pivot shaft 121. The wipers 75 (1) to 75 (4) are disposed to the wiper holders 74 (1) to 74 (4).

The wiper holders 74 (1) to 74 (4) can switch between a first position and a second position around the pivot shaft 121. In this example the wiper holders can pivot from a retracted position 74A, which is the first position shown in FIG. 15A, to an upright position 74B, which is the second position shown in FIG. 15C. In the retracted position 74A, the wipers 75 (1) to 75 (4) are retracted in a direction along the wiper movement direction H, and the distal ends thereof face the home position 73A of the wiper holder unit 73.

In the upright position 74B, the wipers 75 (1) to 75 (4) are upright facing the capping direction V1 in the cap movement direction V. In the upright position, the wipers 75 (1) to 75 (4) protrude in the capping direction V1 from the slide frame 76.

A position holding arm 77 (1) to 77 (4) is attached to each wiper holder 74 (1) to 74 (4). The position holding arm 77 (1) to 77 (4) holds the wiper holder 74 (1) to 74 (4) stably in two positions, the retracted position 74A and the upright position 74B. As will be understood from FIG. 14A, position holding arms 77 (1), 77 (4) are on the outside side of the outside holders 74 (1), 74 (4), and position holding arms 77 (2), 77 (3) are on the inside side of the inside holders 74 (2), 74 (3).

The configuration of the position holding arms 77 (1) to 77 (4) is described next with reference to FIG. 15A. Because the position holding arms 77 (1) to 77 (4) are identical, their configuration is described using position holding arm 77 (4) as an example.

A support shaft 125 is disposed to the slide frame 76 parallel to the pivot shaft 121. The support shaft 125 is on the side of the pivot shaft 121 closer to the home position 73A of the wiper holder unit 73. The position holding arm 77 (4) has a compression spring 126, link 127, and link 128. Link 127 is formed in unison with or affixed to the wiper holder 74 (4), and rotates in unison with the wiper holder 74 (4) on the pivot shaft 121.

Link 128 is supported by the support shaft 125 pivotably around the support shaft 125. The distal end part of link 127 and the distal end part of link 128 are pivotably connected to each other by a connection pin 129.

A long narrow hole 128*a* through which the support shaft 125 passes is formed in link 128. The compression spring 126 constantly urges the link 128 to the connection pin 129 side from the support shaft 125. As shown in FIG. 15A to FIG. 15C, the compression spring 126 must be compressed to cause the wiper holder 74 (4) to pivot from the retracted position 74A to the upright position 74B. Conversely, to return the wiper holder 74 (4) from the upright position 74B to the retracted position 74A, the compression spring 126 must be compressed. As shown in FIG. 15B, the compression spring 126 is compressed the most when the connection pin 129 is positioned on a line between the pivot shaft 121 to the center of the support shaft 125. The position holding arm 77 (4) is therefore pushed by the spring force of the compression spring 126 to either the retracted position 74A or the upright position 74B from this position.

Therefore, the wiper holder 74 (4) is held stably in one of these positions. More specifically, the wipers 75 (1) to 75 (4) are held reliably in the upright position while wiping, and can wipe reliably. In addition, the wipers 75 (1) to 75 (4) will not rise unnecessarily from the retracted position.

The wiper selection mechanism that moves the wiper holders 74 (1) to 74 (4) individually to the retracted position 74A and the upright position 74B is described next.

Disposed to the wiper unit 70 at the end of the wiper holder unit 73 on the opposite side as the home position 73A are a plurality of wiper raising members, which function as wiper engaging members that change the wipers from the first position to the second position. Four wiper raising members 122 (1) to 122 (4) that are used to raise the wiper holders 74 (1) to 74 (4) from the retracted position 74A to the upright position 74B are disposed in this example as shown in FIG. 10. Wiper raising members 122 (1), 122 (2) protrude vertically from the top of base 122A, and wiper raising members 122 (3), 122 (4) protrude vertically from the top of base 122B. These bases 122A, 122B are fastened to the top of the wiper-pump drive transfer mechanism 90 cover 90A of a specific height attached to the bottom panel 51 of the device frame 50.

As shown in FIG. 10 and FIG. 14A, the wiper raising members 122 (1) to 122 (4) are disposed at different positions in the wiper movement direction H. In the widthwise direction of the wiper unit 70 perpendicular to the wiper movement direction H, the wiper raising members 122 (1) to 122 (4) are disposed to positions corresponding to the position holding arms 77 (1) to 77 (4) of the wiper holders 74 (1) to 74 (4). As shown in FIG. 14A and FIG. 14B, an engaging tab 128*b* protruding in the uncapping direction V2 is formed on the link 128 of each position holding arm 77 (1) to 77 (4).

The wiper holder unit 73 moves in the wiper movement direction H to the position where a wiper raising member 122 (1) to 122 (4) is disposed. As a result, the engaging tab 128*b* of the position holding arm 77 (1) to 77 (4) of one of the four wiper holders 74 (1) to 74 (4) can be positioned opposite the corresponding wiper raising member 122 (1) to 122 (4) in the cap movement direction V. From this position, the cap unit 60 is moved in the uncapping direction V2. As a result, the wiper unit 70 moves in the uncapping direction, and the engaging tab 128*b* contacts one of the wiper raising members 122 (1) to 122 (4).

FIG. 15A shows this position. When the cap unit 60 moves further in the uncapping direction V2, the engaging tab 128*b* is pushed relatively up in the capping direction V1 by the wiper raising member 122 (1) to 122 (4). As a result, as shown in FIG. 15B and FIG. 15C, the position holding arm 77 (1) to 77 (4) raises the wiper holder 74 (1) to 74 (4) from the retracted position 74A to the upright position 74B in resistance to the spring force of the compression spring 126.

The wiper holder unit 73 is then moved in the wiper movement direction H and positioned to a position before the head unit 1-1 to 1-4, 2-1 to 2-4 to be wiped. From this position, the cap unit 60 is moved in the capping direction V1, and the upright wiper 75 (1) to 75 (4) is set to the position where the nozzle face 21*a* to 24*a*, 31*a* to 34*a* of the head unit 1-1 to 1-4, 2-1 to 2-4 can be wiped. The wiper holder unit 73 is then moved in the wiper movement direction H and the wiper 75 (1) to 75 (4) disposed thereto wipes the nozzle face 1-1*a* to 1-4*a*, 2-1*a* to 2-4*a* of the corresponding head unit 1-1 to 1-4, 2-1 to 2-4.

Referring next to FIG. 16A to FIG. 16C, a plurality of wiper retraction members that function as wiper engaging members that change the wiper from the second position to the first position are disposed to the wiper frame 71 of the wiper unit 70 on the inside surface on the home position 73A side of the wiper holder unit 73. Two wiper retraction members 123 (1), 123 (2) extending in the wiper movement direction H are disposed in this example. Wiper retraction member 123 (1) is a member that returns wiper holders 74 (1) and 74 (2) from the upright position 74B to the retracted position 74A, and wiper retraction member 123 (2) is a member that returns wiper holders 74 (3), 74 (4) from the upright position 74B to the retracted position 74A. Four wiper retraction members corresponding to the individual wiper holders 74 (1) to 74 (4) can obviously be disposed.

Each of the wiper holders 74 (1) to 74 (4) has an engaging tab 74*a* that extends in the uncapping direction when the wiper holder is in the upright position 74B. In this example, the engaging tabs 74*a* of wiper holders 74 (1) and 74 (2) are formed at adjacent positions. These engaging tabs 74*a* can simultaneously contact one wiper retraction member 123 (1) when they move to the home position 73A side of the wiper holder unit 73 in the wiper movement direction H. The engaging tabs 74*a* of wiper holders 74 (3) and 74 (4) are likewise formed at adjacent positions, and can simultaneously contact one wiper retraction member 123 (2).

Therefore, when the wiper holders 74 (1) to 74 (4) move in the wiper movement direction H toward the home position 73A, the engaging tabs 74*a* of the wiper holders 74 (1) to 74 (4) in the upright position as shown in FIG. 16A contact one of the wiper retraction members 123 (1), 123 (2). The wiper holders 74 (1) to 74 (4) are then pushed by the wiper retraction members 123 (1), 123 (2) as shown in FIG. 16B and FIG. 16C. As a result, the wiper holders 74 (1) to 74 (4) return from the upright position 74B to the retracted position 74A.

One of the plural wipers 75 (1) to 75 (4) can be selected in the wiper selection operation (in other words, the operation selecting the head unit to wipe) by movement of the cap unit 60 (*cap*) in the cap movement direction V and movement of the wiper holder unit 73 (wiper) in the wiper movement direction H. As a result, the head units 1-1 to 1-4, 2-1 to 2-4 can be selectively wiped.

Three stops 130 (1) to 130 (3) are formed on the bases 122A, 122B on which the wiper raising members 122 (1) to 122 (4) are formed. Stop 130 (1) prevents wiper holder 74 (1) from pivoting to the upright position with wiper holder 74 (2), and stop 130 (3) prevents wiper holder 74 (3) from pivoting to the upright position B with wiper holder 74 (4). Stop 130 (2) prevents wiper holder 74 (4) from pivoting to the upright position B with wiper holder 74 (3). The stop that prevents wiper holder 74 (2) from pivoting with wiper holder 74 (1) to the upright position is not shown in the figures.

These stops 130 (1) to 130 (3) protrude vertically in the capping direction V1 from the top of the bases 122A, 122B, and have an engaging surface 130*a* that extends in the cap movement direction V. An engaging surface 127*a* that extends in the cap movement direction V when in the retracted position 74A is formed on the link 127 of each wiper holder 74 (1) to 74 (4).

As shown in FIG. 15A, when wiper holder 74 (3) is raised, the engaging surface 127*a* of the link 127 of wiper holder 74 (4) is opposite the engaging surface 130*a* of stop 130 (2) with a slight gap therebetween in the wiper movement direction H. When wiper holder 74 (3) pivots toward the upright position 74B, the engaging surface 127*a* contacts the engaging surface 130*a* of stop 130 (2). As a result, wiper holder 74 (3) does not pivot with wiper holder 74 (4) toward the upright position 74B.

When ink is in the gap of wiper holders 74 (3), 74 (4), the wiper holders 74 (3), 74 (4) stick together. If one wiper holder 74 (4) is then raised, the other wiper holder 74 (3) could rise therewith. The stop 130 (2) can reliably prevent the wiper holder that is not selected from rising.

Wiper and Wiper Cleaner Unit

Ink and other foreign matter wiped from the nozzle face generally sticks to the wipers of the maintenance device. The wiping ability of the wiper drops when ink or other foreign matter remains on the wiper. Ink or other foreign matter on the wiper can stick to the nozzle face and soil the nozzle face. A wiper cleaner is therefore desirably provided to remove ink or other foreign matter from the wiper after wiping the nozzle face.

When the nozzle face of the inkjet head is wiped using a flat wiper, both ends of the distal end of the wiper that is pressed to the nozzle face can easily deform greatly. Wiping ink or other foreign matter reliably from the part of the nozzle face contacted by the ends of the distal end of the wiper may also not be possible. If the flat wiper is bent into an arc to increase rigidity, ink or other foreign matter on the nozzle face can be reliably wiped off even at both ends of the distal end of the wiper.

However, the need for a wiper cleaner suitable for cleaning a wiper bent in an arc has not been addressed in the related art. Such a wiper cleaner has also not been proposed. A wiper cleaner for a flat wiper is not suited to wiping a wiper bent into a curved shape. If a curved wiper is moved while pressed against the wiper cleaner, the middle part of the wiper can easily bend greatly. As a result, reliably wiping ink or other foreign matter from the middle of the wiper may not be possible. With consideration for this problem, the maintenance device 40 according to this example has a wiper and a wiper cleaner unit configured as described below.

Figure 17:
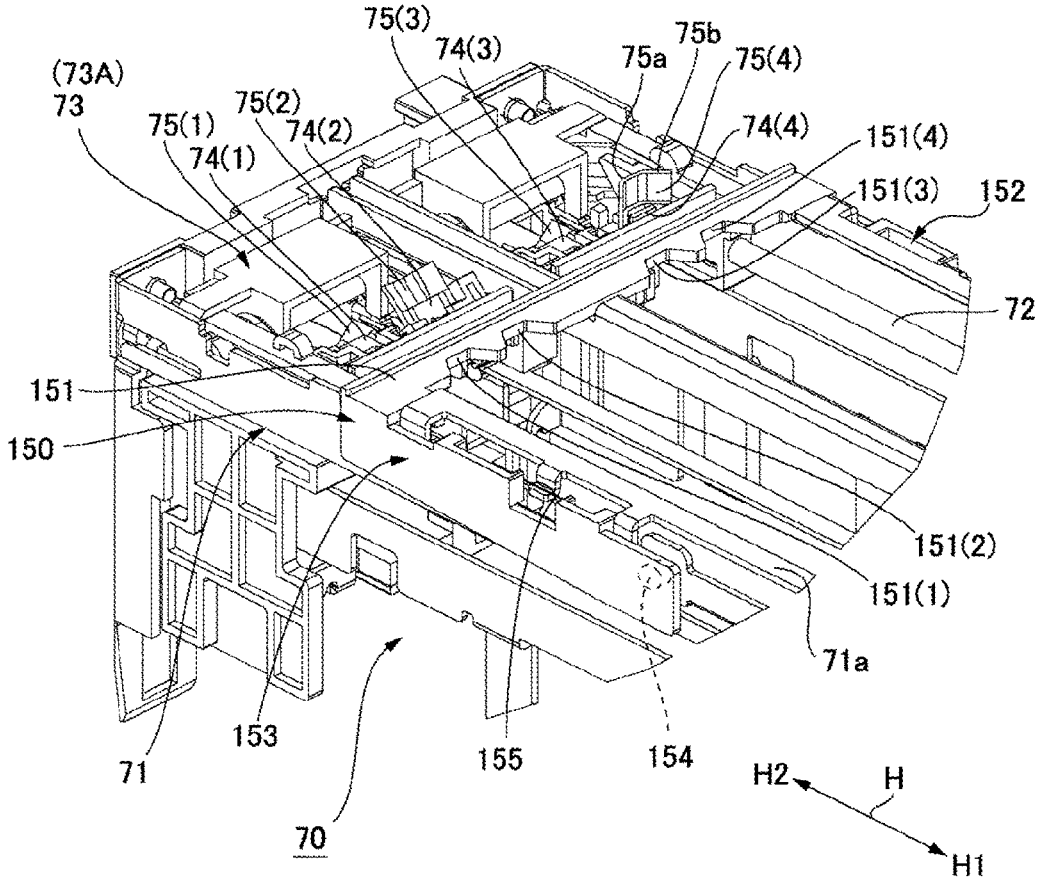
FIG. 17 is an oblique view of part of the wiper cleaner unit.

FIG. 17 shows the end of the wiper unit 70 on the home position side. When the wiper holder unit 73 is in the home position 73A, the four wipers 75 (1) to 75 (4) are retracted to the retracted position by the wiper retraction members 123 (1), 123 (2). To describe the shape of the wiper more easily, wiper 75 (4) is shown in the upright position, and wiper 75 (2) is shown at an intermediate position while pivoting from the retracted position to the upright position, in FIG. 17.

As shown in the figure, wiper 75 (1) is a flat, rectangular rubber piece that is curved into an arc and attached to the wiper holder 74 (1). When in the upright position, the wiping surface 75*a* of the wiper 75 (1) facing the wiping direction H2 is a curved convex surface 75*a*. Therefore, the distal end 75*b* of the wiper 75 (1) that slides over the nozzle faces 1-1*a*, 1-3*a* of the head units 1-1, 1-3 to wipe is also a shape that is curved convexly in the wiping direction H2.

A wiper 75 (1) with a curved shape that is convex in the wiping direction H2 has higher rigidity when wiping than a flat wiper. In addition, when sliding pressed to the nozzle face 1-1*a*, 1-3*a*, both ends of the distal end part of a flat wiper may deform greatly, and not be able to appropriately wipe the nozzle face 1-1*a*, 1-3*a*. The curved distal end parts 75*b* of the wiper 75 (1) slide over the nozzle face 1-1*a*, 1-3*a* while uniformly contacting the nozzle face 1-1*a*, 1-3*a*, and can therefore wipe more appropriately than a flat wiper.

The other wipers 75 (2) to 75 (4) are configured identically to wiper 75 (1), and further description thereof is thus omitted.

A wiper cleaner unit 150 is also disposed to the wiper unit 70. Described with reference to FIGS. 5A and 5B, FIG. 6, and FIG. 17, the wiper cleaner unit 150 has a flat wiper cleaner 151. The wiper cleaner 151 extends across the short side of the wiper frame 71 on the top of the wiper frame 71. The location of the wiper cleaner 151 is between the cap unit 60 and the wiper holder unit 73 in the home position 73A.

Cleaner support panels 152, 153 extending in the opposite direction H1 (wiper advancing direction) as the wiping direction H2 are formed in unison with the ends of the wiper cleaner 151. The distal ends of the cleaner support panels 152, 153 are attached to the wiper frame 71 movably to and away from the top of the wiper frame 71 on respective support pins 154 (only one support pin 152 shown in the figure).

The cleaner support panels 152, 153 are pushed normally up from the top of the wiper frame 71 by a rod-shaped spring member 155 supported on the wiper frame 71 side. As a result, the wiper cleaner 151 floats at approximately the same height as the contact surface 71*a* of the wiper frame 71.

At the edge of the wiper cleaner 151 on the wiper advancing direction (H1) side, a recessed edge to 151 (4) (wiper cleaning surface) for wiper cleaning is formed at four locations. The recessed edges to are shaped according to the curved shape of the distal ends 75*b* of the wipers 75 (1) to 75 (4). The recessed edges to are located on the path of the distal ends 75*b* of the wipers 75 (1) to 75 (4) in the upright position.

After finishing wiping the nozzle faces 1-1*a* to 1-4*a*, 2-1*a* to 2-4*a* of the head units 1-1 to 1-4, 2-1 to 2-4, the wipers 75 (1) to 75 (4) return from the wiping end position to the home position 73A. When returning, the wipers 75 (1) to 75 (4) pass the wiper cleaner 151. When passing the wiper cleaner 151, the distal ends 75*b* of the wipers 75 (1) to 75 (4) slide over the corresponding recessed edge to. As a result, ink or other foreign matter on the distal ends 75*b* of the wipers 75 (1) to 75 (4) is wiped off by the recessed edge to.

By wiping the cured wipers 75 (1) to 75 (4) with a recessed edge to of a corresponding shape, ink or other foreign matter can be reliably wiped from each part of the wiping surface 75*a* of the wiper 75 (1) to 75 (4).

The wiper cleaner unit 150 has a pair of ink recovery units 156, 157 that hold the ink or other foreign matter wiped off by the wiper cleaner 151. Described with reference to FIG. 6, the ink recovery units 156, 157 are disposed to one end of the first and second cap bases 62, 63 of the cap unit 60. The ink recovery units 156, 157 have a flat ink sponge 156*a*, 157*a*, and a compartment 156*b*, 157*b* in which the sponge is held.

When the cap unit 60 moves in the capping direction, the contact surface 71*a* on each side of the wiper unit 70 contacts the bottom 10*a* of the head carriage 10 (see FIG. 4) surrounding the nozzle face 11*a* of the inkjet head 11. The wiper cleaner 151 is disposed to a position adjacent to the head carriage 10, and the wiper cleaner 151 also contacts the bottom 10*a* of the head carriage 10. As a result, the wiper cleaner 151 is pushed to the wiper frame 71 side.

When the wiper cleaner 151 is depressed, the part including the recessed edge to is pressed against the ink sponges 156*a*, 157*a* of the ink recovery units 156, 157. As a result, ink or other foreign matter on the recessed edges to of the wiper cleaner 151 is absorbed and recovered on the ink sponge 156*a*, 157*a* side.

When the cap unit 60 returns from the capping position to the standby position, the wiper cleaner 151 separates from the bottom 10*a* of the head carriage 10. As a result, the wiper cleaner 151 again floats above the top of the wiper frame 71. More specifically, the wiper cleaner 151 returns to the wiper cleaning position where the recessed edges to can contact the wiping surfaces 75*a* of the wipers 75 (1) to 75 (4) that move in the upright position.

Ink or other foreign matter on the wipers 75 (1) to 75 (4) can thus be wiped off by the wiper cleaner 151 in each wiping operation. The wipers 75 (1) to 75 (4) can therefore be maintained in a good wiping condition. In addition, ink or other foreign matter on the wiper cleaner 151 is absorbed and removed by the ink sponges 156*a*, 157*a* of the ink recovery units 156, 157 in each capping operation. As a result, the wiper cleaning performance of the wiper cleaner 151 can be maintained in a constantly good condition.

Diagonal Cap Removal Mechanism

Generally when the nozzle face is capped by the cap of the maintenance device, an ink film may be formed between the nozzle face and the lip by ink or other foreign matter left on the lip (open edge) of the cap. If the cap in parallel contact with the nozzle face is removed from the nozzle face while remaining parallel to the nozzle face, the ink film formed between the nozzle face and the lip will break. When the ink film breaks, the ink forming the ink film may be scattered to the nozzle face side and stick to the nozzle face. If ink sticks to the nozzle face, ejecting ink droplets desirably from the ink nozzles may not be possible.

Therefore, when separating the cap from the nozzle face of the inkjet head, part of the lip is first separated from the nozzle face, and the rest of the lip continuous to that part is then gradually separated from the nozzle face instead of separating the entire lip of the cap from the nozzle face at one time. To accomplish this, a cap that is parallel to the nozzle face when capping the nozzle face is preferably removed from the nozzle face while being tilted to the nozzle face so that one edge of the cap separates from the nozzle face first. The operation of tilting the cap while removing it from the nozzle face is called "diagonal cap removal," and the mechanism therefor is called the "diagonal cap removal mechanism," in this embodiment of the disclosure. Therefore, the cap being diagonal to the nozzle face means that the lip surface of the cap contacting the nozzle face is tilted to the nozzle face. Rendering this diagonal cap removal mechanism with few parts and a simple configuration is desirable from the perspective of achieving a small, compact maintenance device.

More specifically, a fluid ejection head composed of plural head units, such as a line inkjet head, has multiple head units aligned in the nozzle row direction. The same number of caps as head units are used to individually cap the nozzle face of each head unit. This configuration requires incorporating a mechanism that can execute the diagonal removal operation on each of the plural caps, thus increasing the cost. Rendering the diagonal cap removal mechanism with a small, compact configuration is therefore extremely advantageous for reducing the size and cost of the maintenance device.

A diagonal cap removal mechanism 160 is therefore disposed to the cap unit 60 in this example. When capping the nozzle faces 1-1*a* to 1-4*a*, 2-1*a* to 2-4*a* of the head units 1-1 to 1-4, 2-1 to 2-4 with the caps 64 (1) to 64 (4), 65 (1) to 65 (4), the diagonal cap removal mechanism 160 holds the lip surface (the surface of the cap opening edge) parallel to the nozzle face 11*a*. In the operation that uncaps the nozzle faces, the diagonal cap removal mechanism 160 gradually tilts the lip surface to the nozzle face 11*a*.

Figure 19:
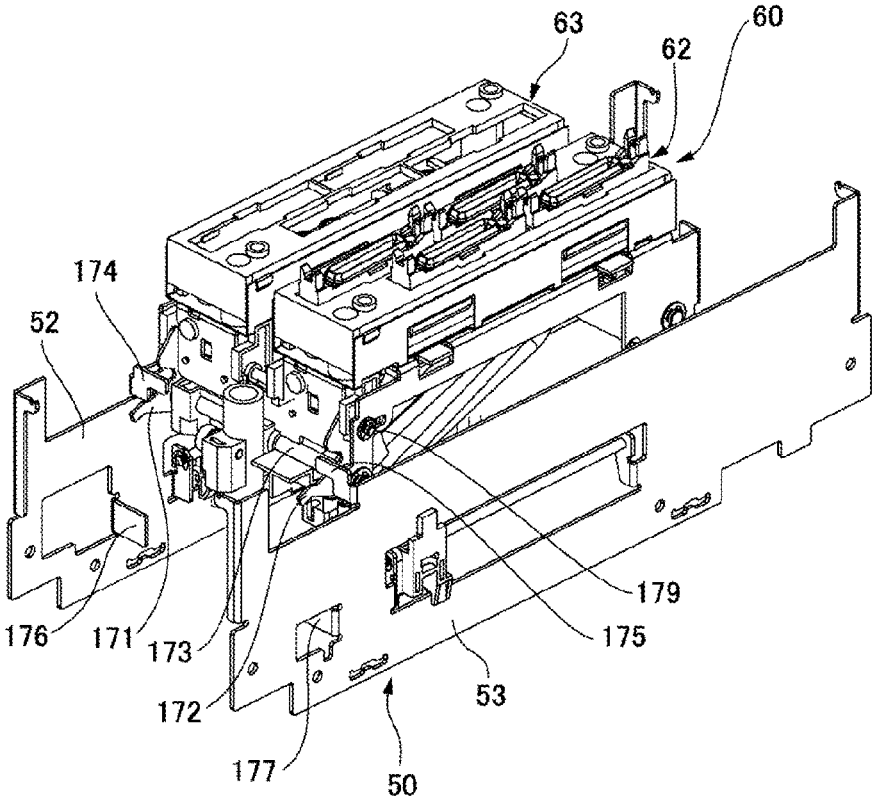
FIG. 19 describes the diagonal cap removal mechanism.
Figure 20:
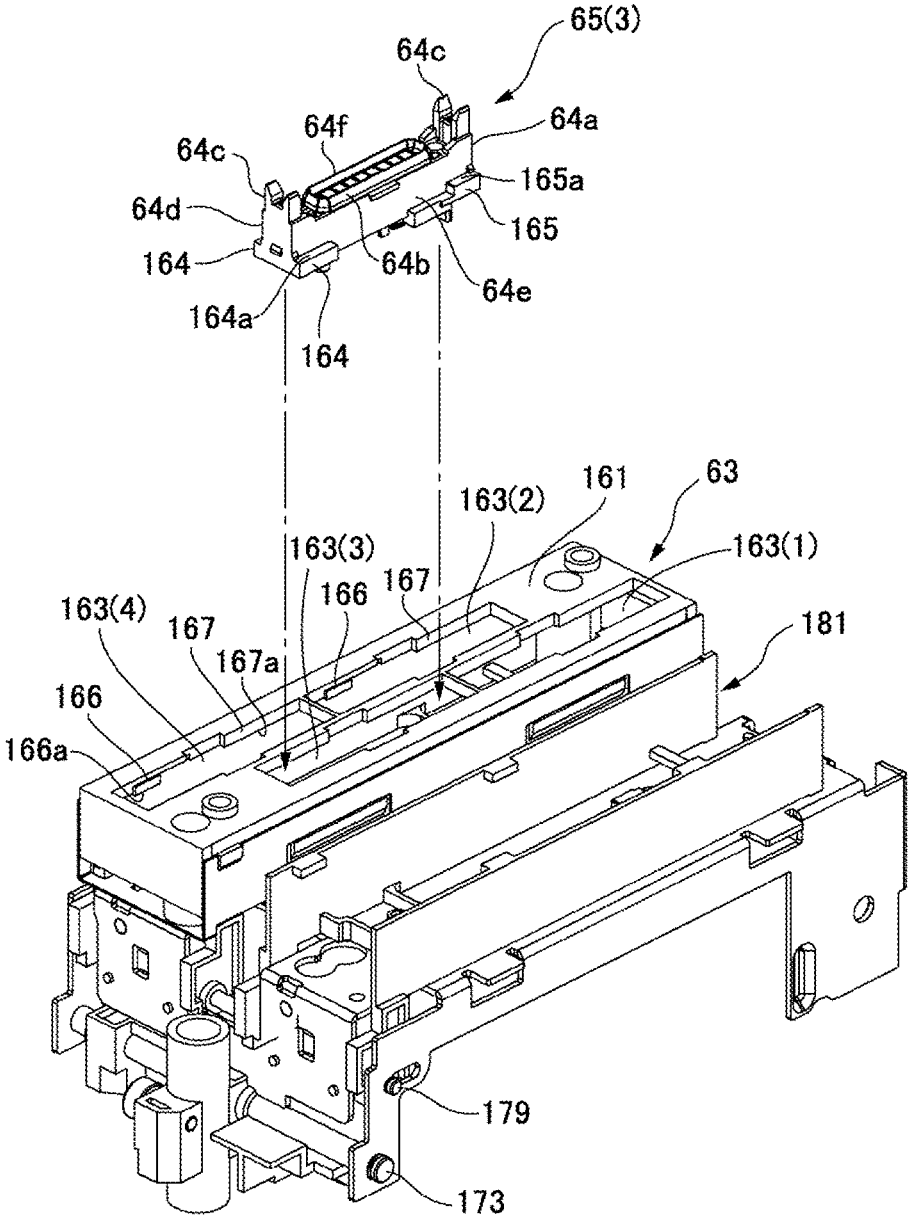
FIG. 20 is an oblique view of the cap unit and cap.
Figure 21:
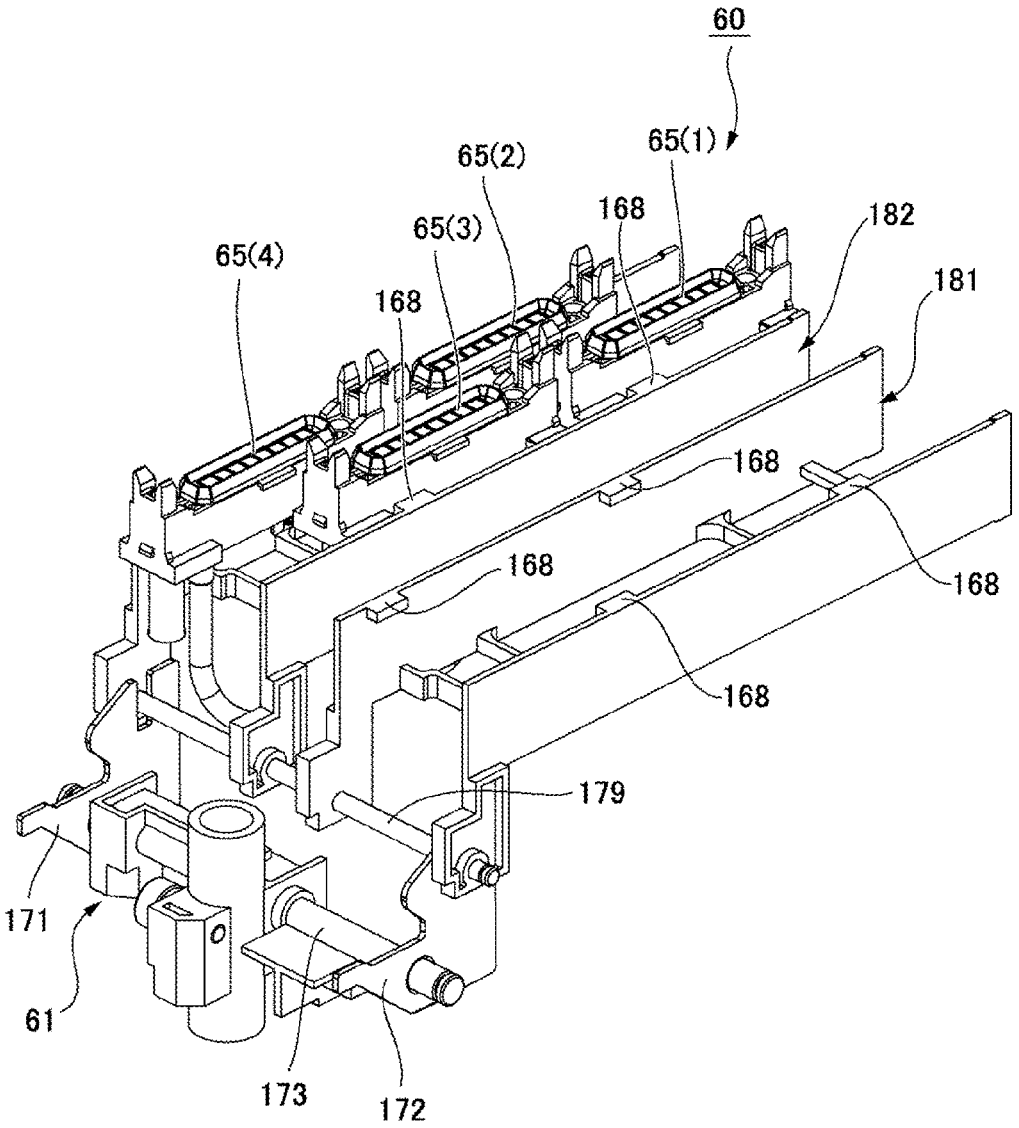
FIG. 21 is an oblique view of the sliding mechanism of the moving members.

The configuration of the diagonal cap removal mechanism 160 is described with reference to FIG. 18A to FIG. 21. FIG. 18A to FIG. 18C schematically describe the configuration and operation of the diagonal cap removal mechanism 160. FIG. 19 is an oblique view showing the cap unit 60 and both side walls 52, 53 of the device frame 50 without the caps 64 (1) to 64 (4). FIG. 20 is an oblique view of the cap unit 60 and cap 64 (2) without the cap base 63 and caps 64 (1), 64 (3), 64 (4), and 65 (1) to 65 (4). FIG. 21 is an oblique view showing the slide mechanism of the moving member used to achieve the diagonal removal operation of the caps in the cap unit 60.

Because the configuration of parts disposed to each of the caps 64 (1) to 64 (4) and 65 (1) to 65 (4) to remove the caps diagonally is the same, cap 65 (3) disposed to the cap base 63 is used as an example below.

As will be understood from FIG. 20, cap 65 (3) has a narrow, rectangular cap body 64*a*, and an open lip 64*b* with a rectangular or oval contour on the top of the cap body 64*a*. Positioning tabs 64*c* that protrude up are formed on both ends of the long sides of the top of the cap body 64*a*. The lip 64*b* located between these tabs 64*c* protrudes up from the top of the cap body 64*a*. The cap body 64*a* is made of a hard plastic material, for example. The lip 64*b* is made from a soft plastic or rubber material.

As shown in FIG. 19 and FIG. 20, the cap base 63 has a narrow rectangular shape overall, and four rectangular openings 162 (1) to 162 (4) (collectively referred to as openings 162 below) in which the four caps 65 (1) to 65 (4) are installed are formed in the top 161 of the cap base 63. The cap 65 (3) installed in the opening 162 is supported by a pair of compression springs 63*a*. As shown in FIG. 18A to FIG. 18C, the pair of compression springs 63*a* is disposed between the cap body 64*a* of the cap 65 (3), and the bottom 163 of the cap base 63. The pair of compression springs 63*a* support both ends of the long side of the cap body 64*a*, and push the cap 65 (3) in capping direction V1 (up in the figure) relative to the cap base 63.

As shown in FIG. 18A to FIG. 18C and FIG. 20, a pair of cap-side engaging members 164, 165 are respectively formed on one side wall 64*d* and the opposite side wall 64*e* of the cap body 64*a* (the engaging members on the side wall 64*d* are not shown). The engaging members 164, 165 protrude perpendicularly to the side walls 64*d*, 64*e*, and are located at positions on the opposite ends of the long side of the cap body 64*a*. The tops of the engaging members 164, 165 are cap-side engaging surfaces 164*a*, 165*a* parallel to the lip surface 64*f* of the cap 64. The engaging surfaces 164*a*, 165*a* are on the same plane.

A pair of base-side engaging parts 166, 167 that can engage the cap-side engaging members 164, 165 are formed on both open edges of the long side of the opening 162 in the top 161 of the cap base 63. The backs of these engaging parts 166, 167 are base-side engaging surfaces 166*a*, 167*a* located on the same plane.

The cap 65 (3) is pushed in the capping direction by the compression springs 63*a*. The engaging surfaces 164*a*, 165*a* of the cap 65 (3) are pressed from the uncapping direction V2 side (the bottom in the figure) to the base-side engaging surfaces 166*a*, 167*a*. As a result, the cap 65 (3) is held parallel to the nozzle face 2-3*a*. More specifically, the lip surface 64*f* is held parallel to the nozzle face 2-3*a*.

A base-side engaging surface 166*b* that is recessed a specific amount in the capping direction V1 is formed on the base-side engaging surface 166*a* of the one engaging part 166. In this example, the base-side engaging surface 166*b* is formed at a position close to the base-side engaging surface 167*a* side of the base-side engaging surface 166*a*.

A moving member 168 of a constant thickness is disposed to the cap base 63 slidably in the direction of the long side. The thickness of the moving member 168 is greater than the height between base-side engaging surface 166*a* and base-side engaging surface 166*b*.

Figure 18A:
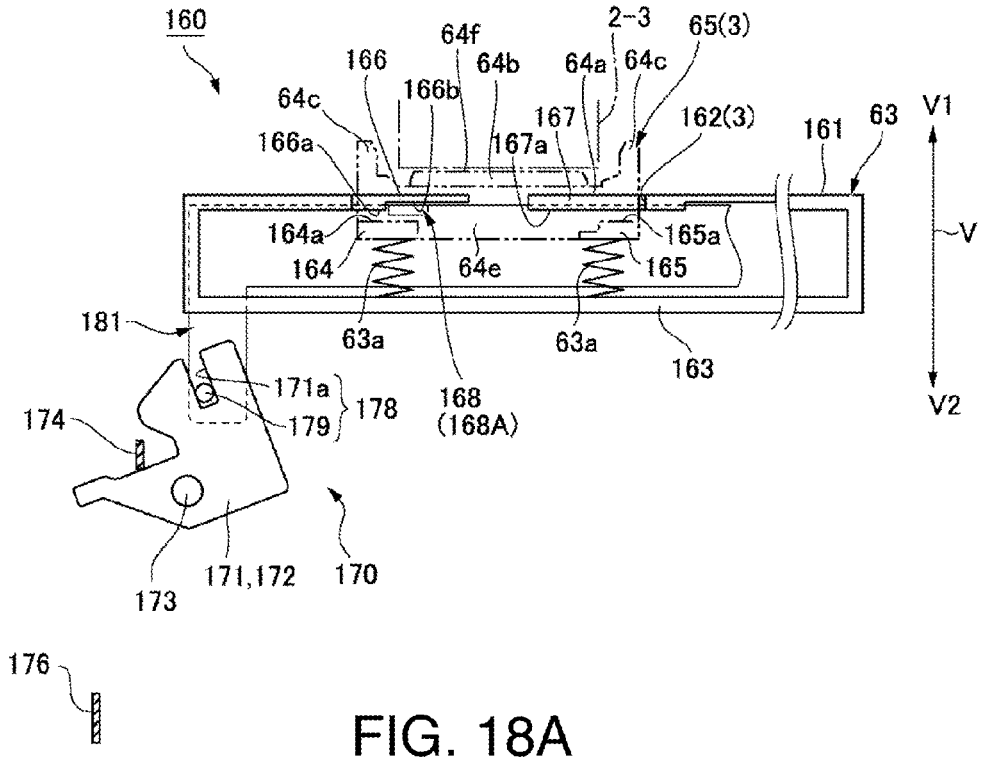
FIG. 18A describes the diagonal cap removal mechanism.
Figure 18B:
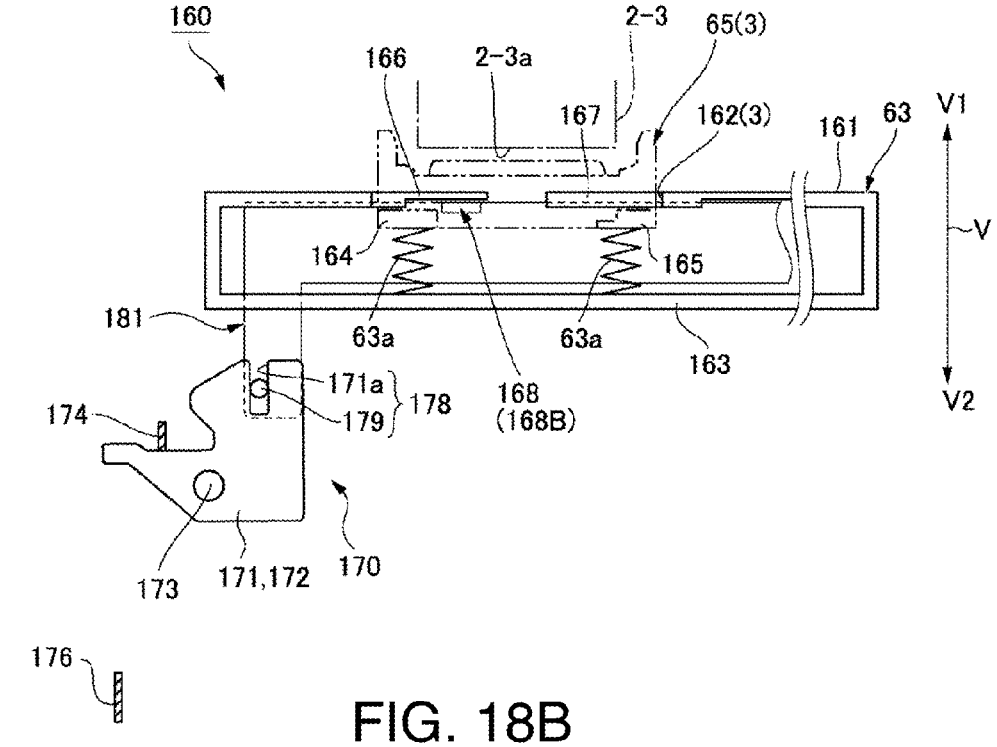
FIG. 18B describes the diagonal cap removal mechanism.
Figure 18C:
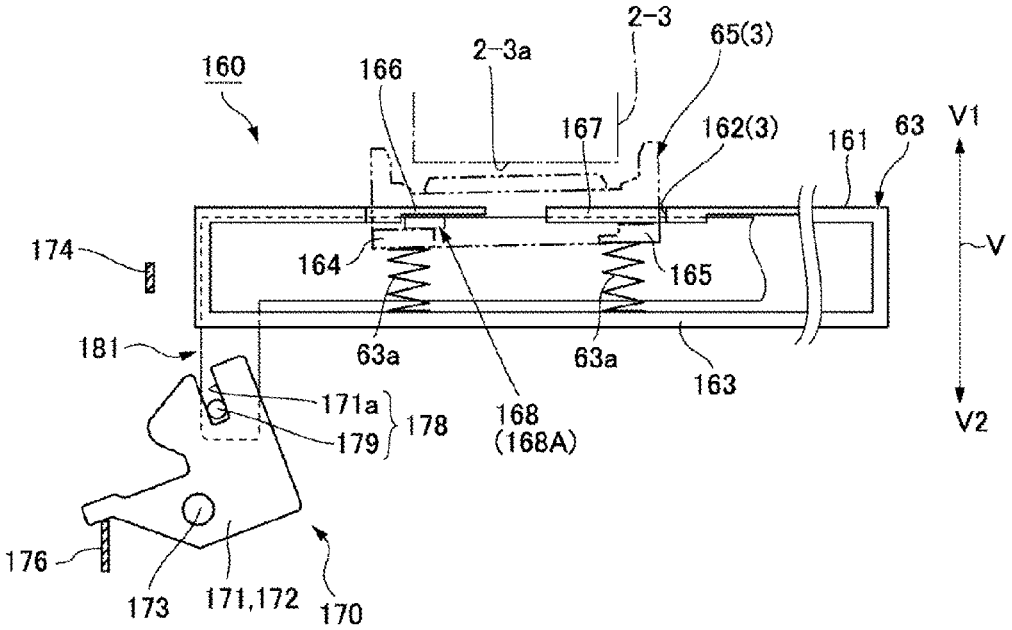
FIG. 18C describes the diagonal cap removal mechanism.

The moving member 168 can slide between the advanced position 168A shown in FIG. 18A and FIG. 18C, and the retracted position 168B shown in FIG. 18B. In the advanced position 168A, the moving member 168 is located between the base-side engaging surface 166*b* and the cap-side engaging surface 164*a*. In the retracted position 168B, the moving member 168 is located in a retracted position removed from therebetween.

When the cap 65 (3) is in the capping position capping the nozzle face 2-3*a*, the cap 65 (3) is pressed in the uncapping direction V2 by the nozzle face 2-3*a*. As a result, as shown in FIG. 18A, a gap in which the moving member 168 can enter is formed between the base-side engaging surface 166*b* and the cap-side engaging surface 164*a*.

When the cap-side engaging surfaces 164*a*, 165*a* are pressed against the base-side engaging surfaces 166*a*, 167*a*, the cap 65 (3) is held parallel to the nozzle face 2-3*a* as shown in FIG. 18B. However, when the cap-side engaging surface 164*a* is pushed to the base-side engaging surface 166*b* with the moving member 168 therebetween, the cap 65 (3) tilts the thickness of the moving member 168 to the nozzle face 2-3*a* as shown in FIG. 18C. More specifically, because the cap-side engaging surface 164*a* at one end of the long side of the cap 65 (3) is pressed to the base-side engaging surface 166*b* with the moving member 168 therebetween, and the cap-side engaging surface 165*a* is pressed to the base-side engaging surface 167*a* at the other end of the long side of the cap 65 (3), the cap 65 (3) is tilted the thickness of the moving member 168 along the long side to the nozzle face 2-3*a*.

The slide mechanism that slides the moving member 168 to the advanced position 168A and retracted position 168B is described next. The slide mechanism converts movement of the cap unit 60 by the cap drive transfer mechanism 80 in the capping direction V1 to movement of the moving member 168 from the retracted position 168B to the advanced position 168A. It also converts movement of the cap unit 60 in the uncapping direction V2 to movement of the moving member 168 from the advanced position 168A to the retracted position 168B.

By moving the moving member 168 using movement of the cap unit 60 by the cap drive transfer mechanism 80, a separate drive source for moving the moving member 168 is not required. In addition, the moving member 168 can be moved appropriately according to the position of the cap 65 (3), and movement can be controlled simply and reliably.

The specific configuration of the slide mechanism in this example is described next with reference to FIG. 18A to FIG. 18C to FIG. 20. The slide mechanism 170 has a pair of pivotable levers 171, 172 disposed to the cap unit 60. The levers 171, 172 are disposed to the ends of the support shaft 173, and can pivot on the support shaft 173. The support shaft 173 is supported by the cap frame 61 and extends along the short side thereof.

As will be understood from FIG. 19, a pair of first engaging tabs 174, 175 that can engage the levers 171, 172, and a pair of second engaging tabs 176, 177, are formed on the side walls 52, 53 of the device frame 50. The first engaging tabs 174, 175 engage the levers 171, 172 moving in the capping direction V1, and cause the levers to pivot to a first position shown in FIG. 18A and FIG. 18B. In this example, the levers 171, 172 contact the first engaging tabs 174, 175 and pivot to the first position just before the cap 64 reaches the capping position.

The second engaging tabs 176, 177 engage the levers 171, 172 moving in the uncapping direction V2, and pivot the levers from the first position to the second position shown in FIG. 18C. In this example, when the cap 65 moves in the uncapping direction, the levers 171, 172 contact the second engaging tabs 176, 177 and pivot to the second position just before the cap 65 reaches the retracted position.

The levers 171, 172 are connected through a linkage unit 178 to slide units 181, 182. Slide unit 181 is supported by cap base 62 slidably in the direction of the long side. Slide unit 182 is supported by cap base 63 slidably in the direction of the long side. A moving member 168 is formed at four locations on slide unit 181. The moving members 168 are located at positions corresponding to the base-side engaging surfaces 166*b* of caps 64 (1) to 64 (4). A moving member 168 is likewise formed at four locations on slide unit 182. The moving members 168 are located at positions corresponding to the base-side engaging surfaces 166*b* of caps 65 (1) to 65 (4).

The linkage unit 178 converts movement between the levers 171, 172 and slide units 181, 182 from the pivoting action of the levers 171, 172 to the sliding action of the slide units 181, 182. More specifically, the linkage unit 178 has slide channels 171*a*, 172*a* formed in the levers 171, 172, and a connecting rod 179 passing through the slide units 181, 182. The connecting rod 179 passes through the slide channels 171*a*, 172*a* slidably in the slide channels 171*a*, 172*a*.

When the levers 171, 172 are in the first position, the slide units 181, 182 are in the first position, and the moving members 168 formed thereon are in the advanced position 168A. When the levers 171, 172 pivot to the second position, the slide units 181, 182 slide to the second position, and the moving members 168 formed thereon retract to the retracted position 168B.

Next, FIG. 22A to FIG. 22E describe the operation of the diagonal removal mechanism accompanying movement of the caps 64. Referring primarily to these figures, the operation of the diagonal removal mechanism is described below.

Figure 22A:
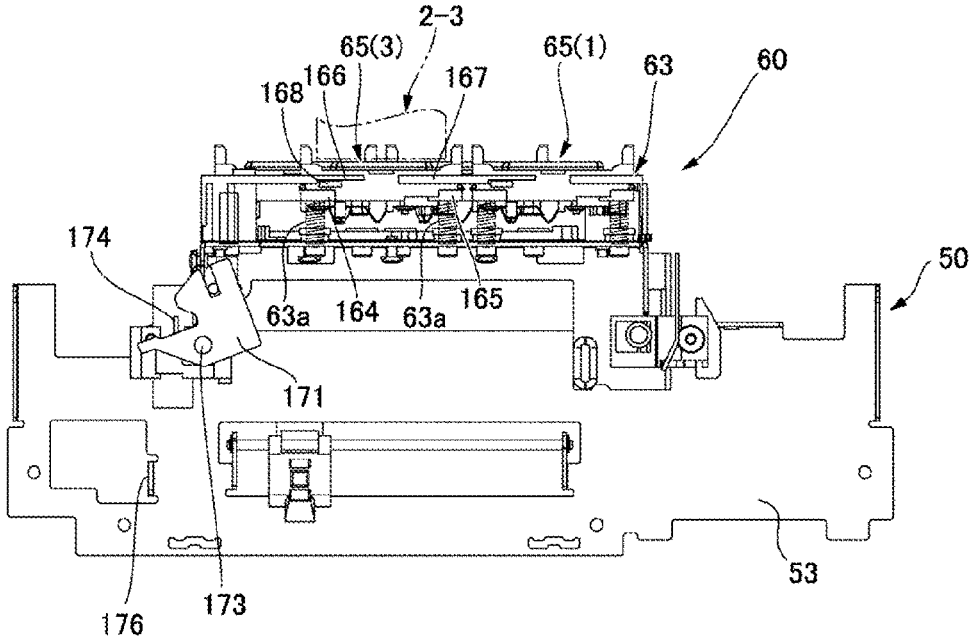
FIG. 22A describes the operation of the diagonal removal mechanism.

When the cap 65 (3) has capped the nozzle face 2-3*a*, the cap 65 (3) is pushed by the nozzle face 2-3*a* to the cap base 63 side against the spring force of the compression springs 63*a* as shown in FIG. 22A (FIG. 18A). As a result, a gap in which the moving members 168 can be inserted is formed between the cap-side engaging surface 164*a* and the base-side engaging surface 166*b*. Therefore, when or just before the nozzle face is capped, the moving members 168 are advanced and the moving members 168 are positioned between the cap-side engaging surface 164*a* and the base-side engaging surface 166*b*.

When the moving members 168 are advanced and the cap unit 60 is moved in the uncapping direction V2 by the cap drive transfer mechanism 80, the cap 65 (3) can be removed from the nozzle face 2-3*a*. The cap 65 (3) is released from pressure by the nozzle face 2-3*a*, and pushed in the capping direction V1 relative to the cap base 63. As a result, the cap-side engaging surface 164*a* is pushed to the base-side engaging surface 166*b* side with the moving members 168 in the advanced position 168A therebetween.

Next, the cap 65 (3) then becomes tilted to the nozzle face 2-3*a* as the cap unit 60 moves in the uncapping direction V2. More specifically, the side wall 64*d* of the cap 65 (3) separates from the nozzle face 2-3*a* from one end of the long side to the other end. When the entire lip of the cap 65(3) separates from the nozzle face 2-3*a*, the cap 65 (3) inclines the thickness of the moving members 168 to the nozzle face 2-3*a*.

Figure 22B:
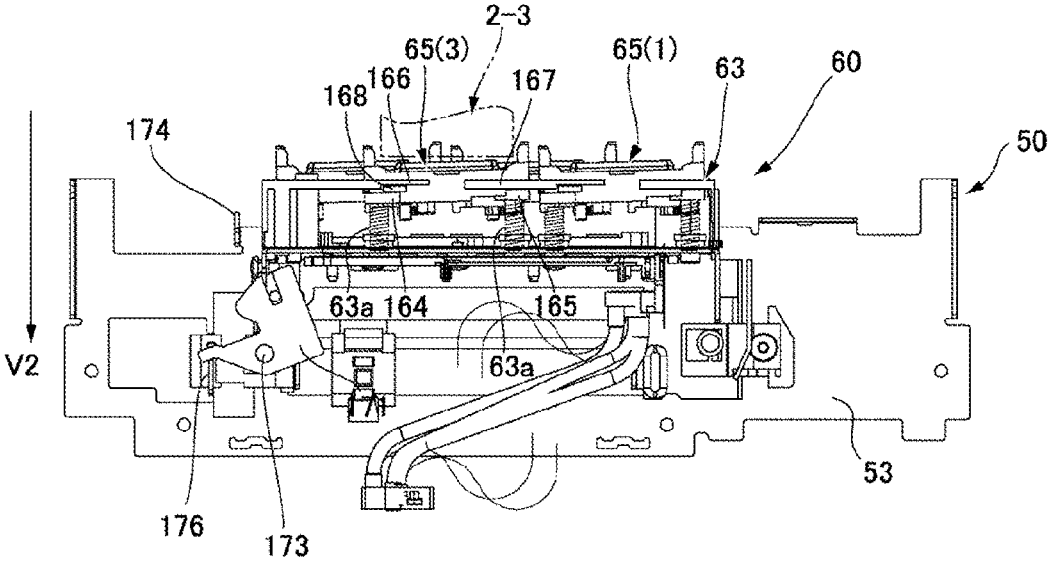
FIG. 22B describes the operation of the diagonal removal mechanism.

Next, as shown in FIG. 22B (FIG. 18C), the cap 65 (3) moves with the cap base 63 in the uncapping direction V2, and separates from the nozzle face 2-3*a* while remaining inclined to the nozzle face 2-3*a*.

Figure 22C:
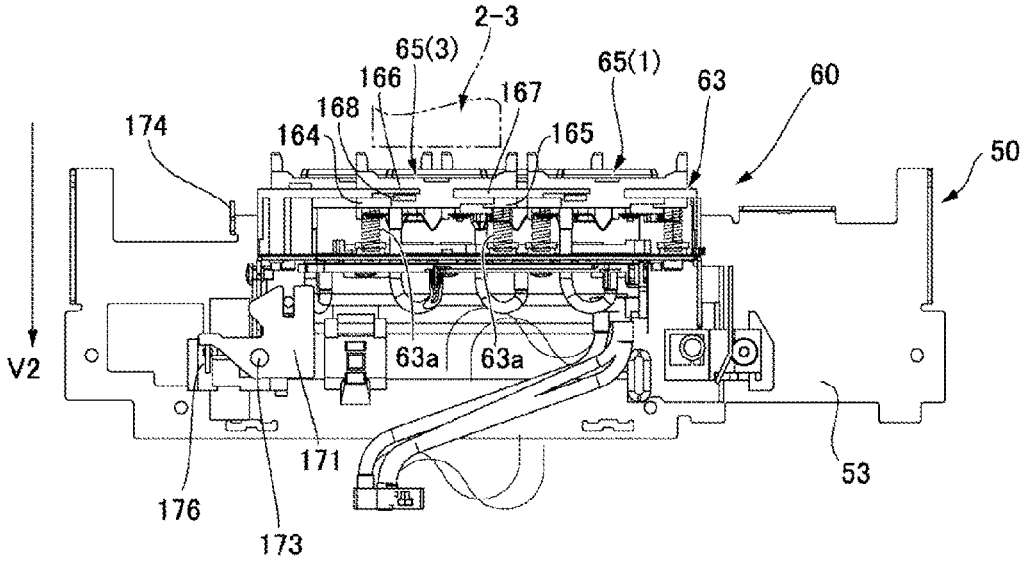
FIG. 22C describes the operation of the diagonal removal mechanism.

After the cap 65 (3) separates from the nozzle face 2-3*a*, the moving members 168 move to the retracted position 168B. More specifically, the moving members 168 return to the retracted position 168B just before the cap unit 60 moving in the uncapping direction V2 reaches the standby position. As a result, as shown in FIG. 22C, the cap-side engaging surface 164*a* returns to the position pressed directly against the base-side engaging surface 166*a*. The cap 65 (3) thus returns to the position parallel to the nozzle face 2-3*a*.

Figure 22D:
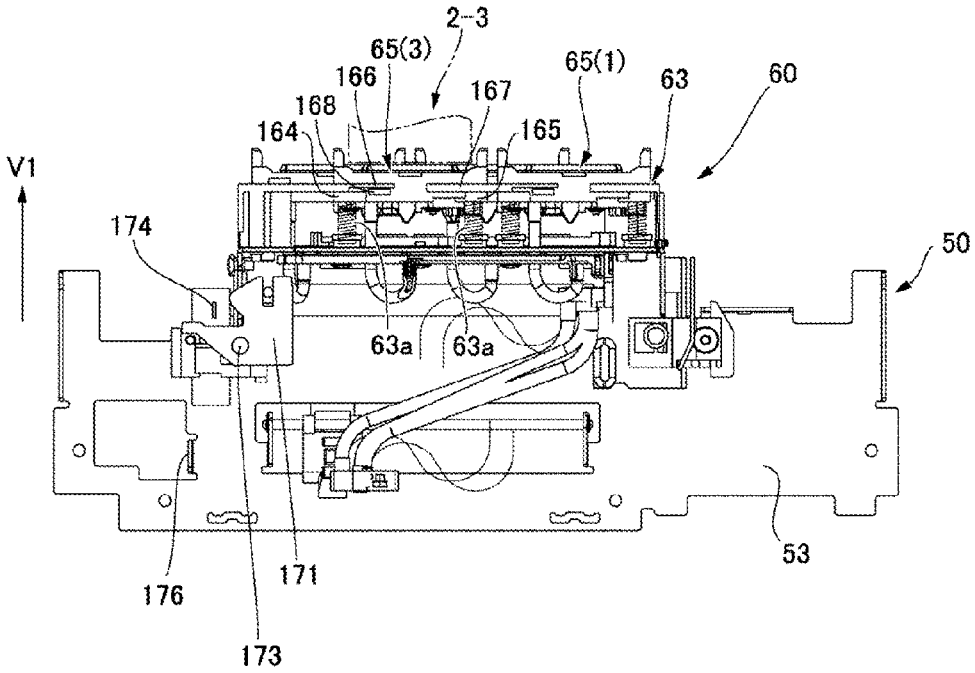
FIG. 22D describes the operation of the diagonal removal mechanism.

When the cap unit 60 moves from the retracted position in the capping direction V1, the cap-side engaging surfaces 164*a*, 165*a* of the cap 65 (3) are pressed against the engaging surfaces 166*a*, 167*a*. Therefore, as shown in FIG. 22D (FIG. 18C), the cap 65 (3) goes parallel to the nozzle face 2-3*a*.

Figure 22E:
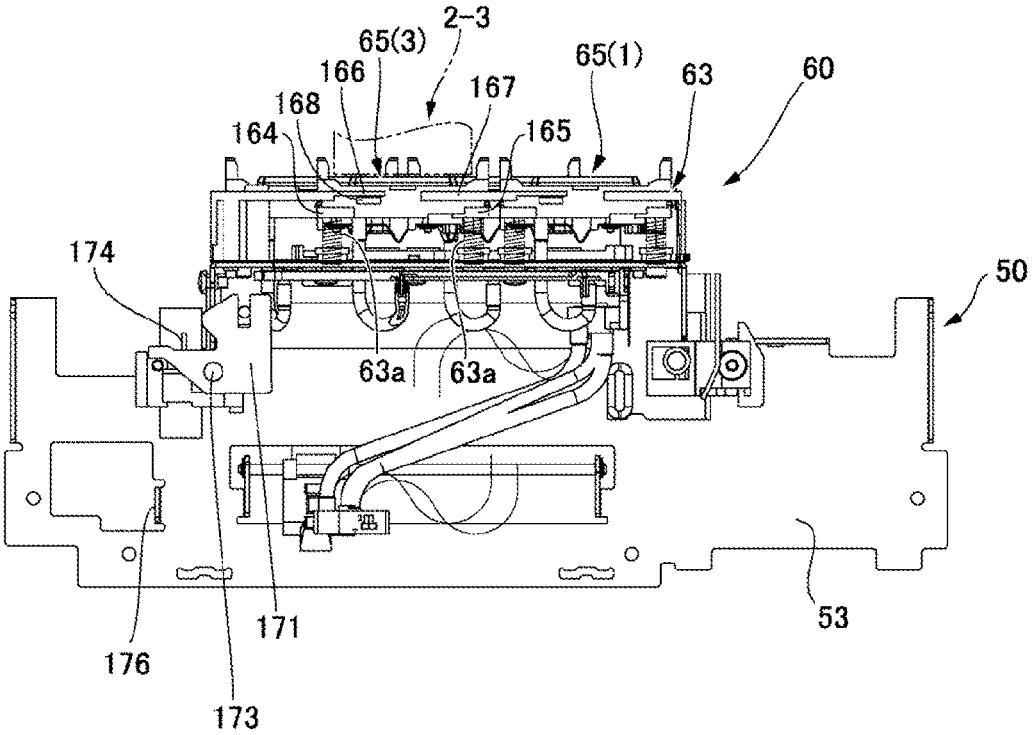
FIG. 22E describes the operation of the diagonal removal mechanism.

When the cap unit 60 is moved in the capping direction V1 by the cap drive transfer mechanism 80, the cap 65 (3) contacts the nozzle face 2-3*a* parallel to the nozzle face 2-3*a*. When the cap unit 60 moves further in the capping direction V1, the cap 65 (3) supported by the compression springs 63*a* is pushed relatively by the nozzle face 2-3*a* in the uncapping direction V2. As a result, just before the cap unit 60 finishes moving in the capping direction V1, a gap in which the moving members 168 can be inserted can be formed between the cap-side engaging surface 164*a* and the base-side engaging surface 166*b* as shown in FIG. 22E. The capping state shown first in FIG. 22A is thus restored.

As described above, the cap 65 (3) can be removed at an angle from the nozzle face 2-3*a* by moving the moving members 168. When an ink film is formed between the nozzle face 2-3*a* and the lip surface 64*d* of the cap 65 (3) when capped, the ink film can be prevented from bursting by removing the cap 65 (3) at an angle. The ink can therefore be prevented from sticking to the nozzle face 2-3*a* due to the ink film breaking.

Furthermore, by retracting the moving members 168 after separating the cap 65 (3) from the nozzle face 2-3*a*, the cap 65 (3) can be returned to the position parallel to the nozzle face 2-3*a*. For example, a detection mechanism that detects the ejection state of ink droplets from the nozzles of the head unit 1-1 to 1-4, and 2-1 to 2-4 using change in the capacitance between an electrode in the cap and an electrode on the nozzle face side may be used. If the nozzle face 2-3*a* and cap 65 (3) are not parallel in this configuration, the condition of each nozzle may not be detectable with good precision. This problem can be avoided with this embodiment of the disclosure. Furthermore, if the nozzle face 2-3*a* is capped with the cap 65 (3) at an angle, the position of the cap 65 (3) to the nozzle face 2-3*a* may be shifted, and reliably capping the nozzle face 2-3*a* may not be possible. The cap 65 (3) may also be offset, and forming a tight seal between the lip surface 64*d* of the cap 65 (3) and the nozzle face 2-3*a* may not be possible. This problem can also be eliminated.

A plurality of moving members 168 can also be moved simultaneously by sliding the slide units 181, 182. Furthermore, because the mechanism that slides the slide units 181, 182 can be configured using movement of the cap drive transfer mechanism 80, providing a separate drive source is not necessary. A mechanism that diagonally removes a plurality of caps that cap a plurality of head units can be achieved with a small, simple configuration.

Printer Control System

Figure 23:
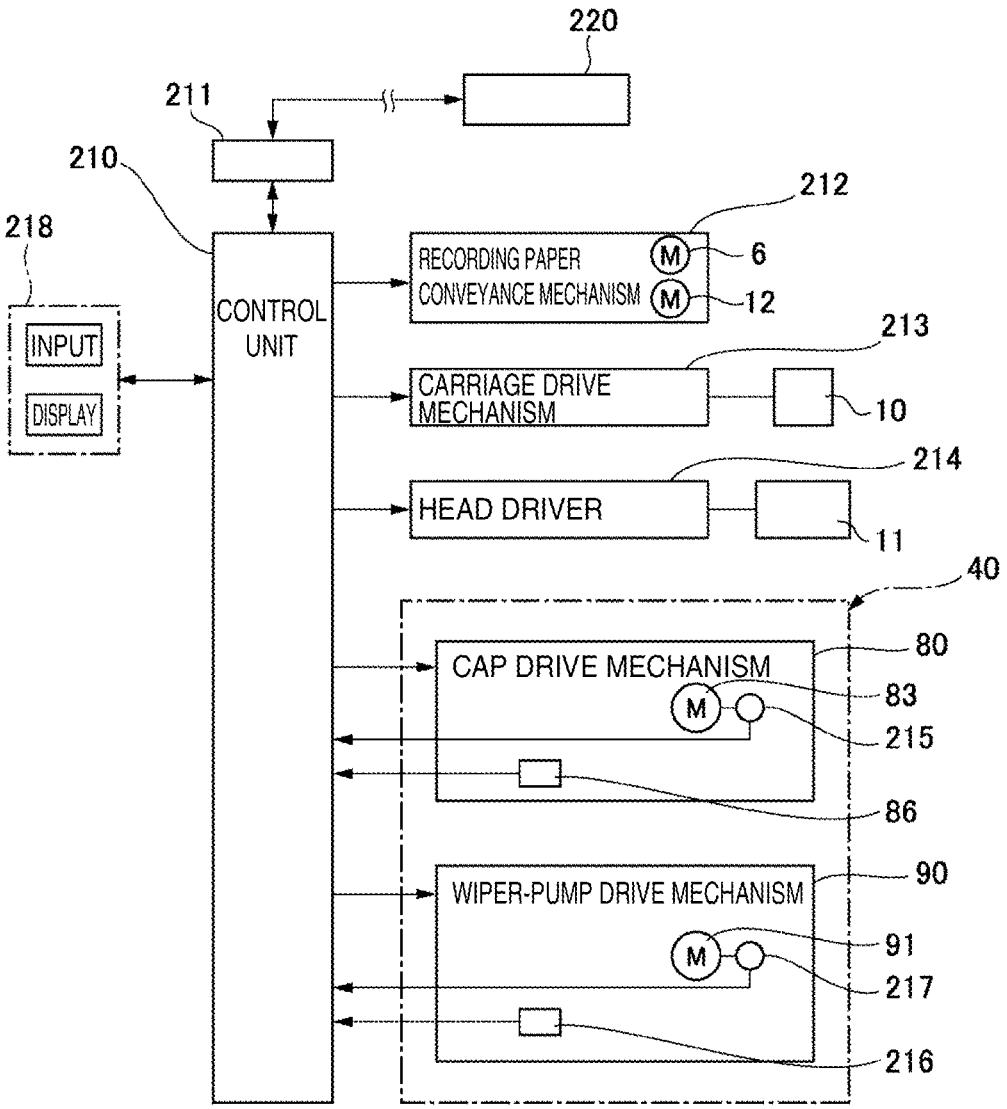
FIG. 23 is a block diagram of the control system of the printer.

FIG. 23 is a schematic block diagram showing the control system of the printer 1. The control system of the printer 1 includes a control unit 210 configured around a computer. Print commands including print data are supplied from a host computer 220, for example, to the control unit 210 through an input/output unit 211. The control unit 210 controls driving a recording paper conveyance mechanism 212 including a paper feed motor 12 and feed roller 6 to convey the recording paper P. The control unit 210 also controls driving a carriage drive mechanism 213 to move the carriage 10. The control unit 210 also controls driving the head driver 214 to print with the inkjet head 11.

When the power turns off and when in the printing standby mode, the control unit 210 controls driving the carriage drive mechanism 213 to return the carriage 10 to the home position B. In the home position B, the control unit 210 controls driving parts of the maintenance device 40 to perform specific maintenance operations on the inkjet head 11.

The control unit 210 controls driving the cap drive transfer mechanism 80 to execute the capping operation in the maintenance operation. The positions of the caps 64, 65 are controlled based on the cap standby position (home) detected by a position detector 86 and the output of a rotary encoder 215 disposed to the motor 83. Driving the wiper-pump drive transfer mechanism 90 is also controlled to execute the nozzle face 11*a* wiping operation.

The position of the wipers 75 is controlled based on the home position 73A (home) of the wiper holder unit 73 detected by a position detector 216 and the output of a rotary encoder 217 disposed to the motor 91. The position detector 216 is disposed between the wiper frame 71 and the wiper holder unit 73. The position detector 216 can be configured using a photocoupler attached to the wiper frame 71, and an interruption detector disposed to the wiper holder unit 73. The operating status of the printer 1 is displayed on an operating/display unit 218.

Positions of Parts of the Maintenance Device 40

The positions to which parts of the maintenance device 40 of the printer 1 move are shown in FIG. 24 to FIG. 27C. Note that in FIG. 24 to FIG. 27C, "head 1" means head units 1-1 to 1-4, and "head 2" means head units 2-1 to 2-4.

Cap Unit 60 Movement Positions

FIG. 24 is a table showing the cap positions. Cap position numbers 1 to 12 are positions in the cap movement direction V of the cap unit 60. The cap home detection position at cap position 9 is the normal standby position of the cap unit 60. The cap unit 60 is positioned to the standby position when the power is off, while waiting to print, and during printing. This position is the position detected by the position detector 86.

In the valve selection operation for selective suctioning, the cap unit 60 moves to valve selection position (head 2) (cap position 10) and valve selection position (head 1) (cap position 12) in the uncapping direction V2 from the cap home detection position (standby position).

Valve selection position (head 1) is the position of the cap unit 60 when selecting valves 112A to 115A for suctioning head units 1-1 to 1-4 (caps 64 (1) to 64 (4)). Valve selection position (head 2) is a position further in the uncapping direction V2, and is the position of the cap unit 60 when selecting valves 112B to 115B for suctioning head units 2-1 to 2-4 (caps 65 (1) to 65 (4)). The wiper raising position (cap position 11) is the position of the cap unit 60 when the wipers 75 are raised to wipe nozzle faces 1-1*a* to 1-4*a*, 2-1*a* to 2-4*a*.

Wiper Holder Unit 73 Movement Positions for Valve Selection

Figure 25A:
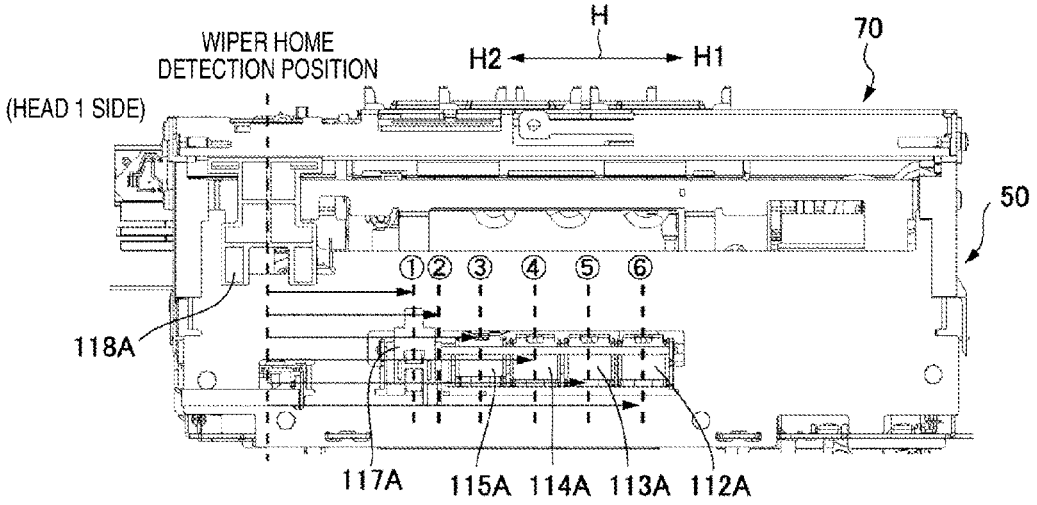
FIG. 25A describes wiper positions in the wiper movement direction.
Figure 25B:
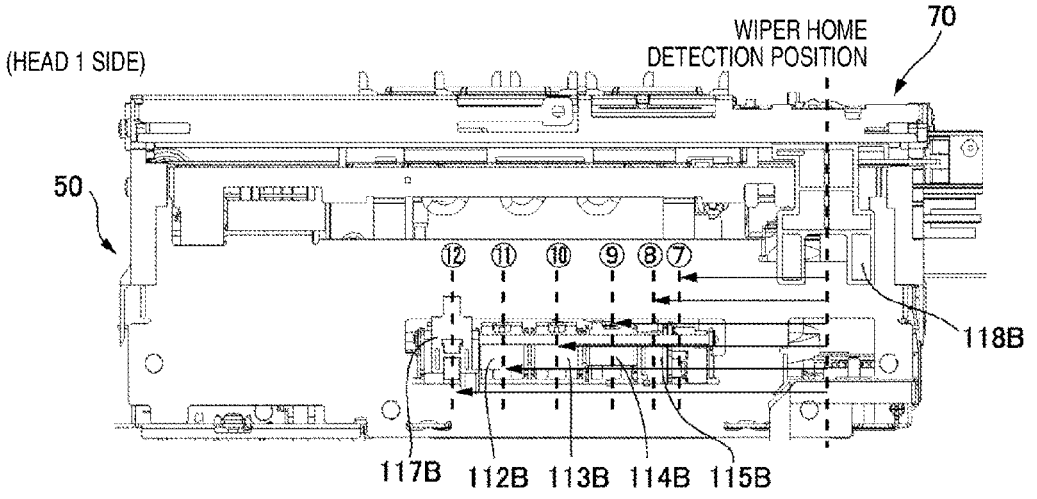
FIG. 25B describes wiper positions in the wiper movement direction.
Figures 25C, 26A:
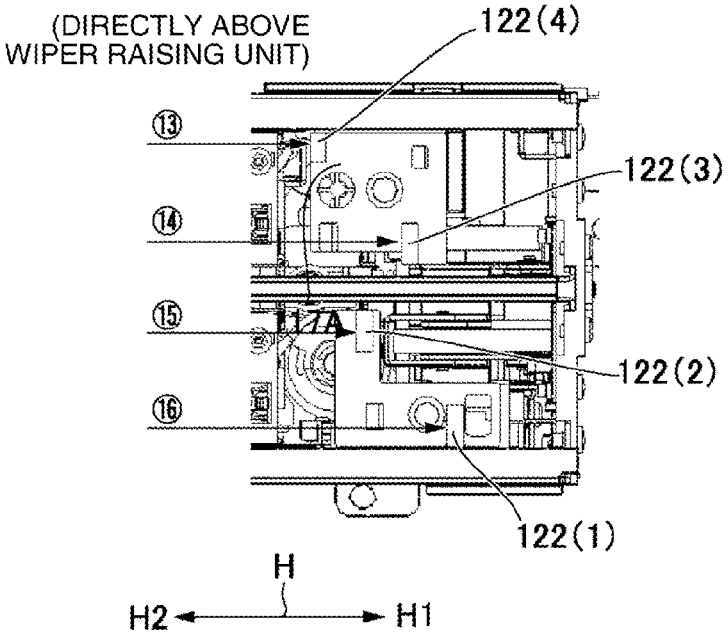
FIG. 25C describes wiper positions in the wiper movement direction.
FIG. 26A describes the upright positions of the wiper.

FIG. 25A, FIG. 25B, and FIG. 25C describe the positions of the wiper holder unit 73 (wiper positions) during valve selection. As shown in FIG. 25A and FIG. 25C, position numbers 1 to 6 show the positions of valve selector 117A in the wiper movement direction H for selective suctioning by valves 112A to 115A (head units 1-1 to 1-4). These positions are managed using the distance of wiper holder unit 73 movement from the home position 73A (wiper home detection position).

As shown in FIG. 25B and FIG. 25C, position numbers 7 to 11 show the positions of valve selector 117B in the wiper movement direction H for selective suctioning by valves 112B to 115B (head units 2-1 to 2-4). Positions 7 to 11 are the same positions as wiper positions 1 to 6.

Wiper Holder Unit 73 Movement Positions for Wiper Selection

Figures 26B, 27A:
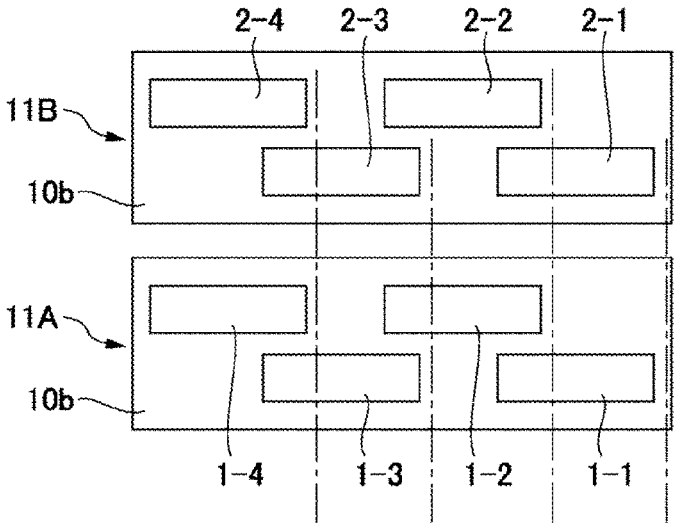
FIG. 26B is a table of the upright positions of the wiper.
FIG. 27A describes the wiping start positions.

FIG. 26A and FIG. 26B describe the positions of the wiper holder unit 73 during wiper selection. The position denoted position 13 is the position where wiper raising member 122 (1) raises wiper 75 (1) for wiping head units 1-1, 1-3. Likewise, the position denoted position 14 is the position where wiper raising member 122 (2) raises wiper 75 (2) for wiping head units 1-2, 1-4. The position denoted position 15 is the position where wiper raising member 122 (3) raises wiper 75 (3) for wiping head units 2-1, 2-3. The position denoted position 16 is the position where wiper raising member 122 (4) raises wiper 75 (4) for wiping head units 2-2, 2-4.

Wiping Start Position

Figures 27B, 27C:
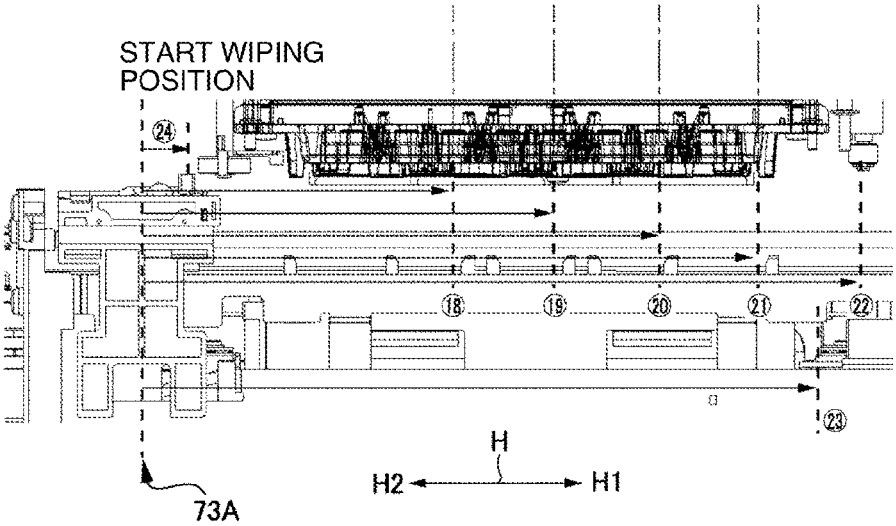
FIG. 27B describes the wiping start positions.
FIG. 27C is a table of the describes the wiping start positions.

FIG. 27A, FIG. 27B, and FIG. 27C describe the positions of the wiper holder unit 73 when wiping starts. Position 18 is the position where wiper 75 (3) starts wiping head units 1-1 and head unit 2-1. Position 19 is the position where wipers 75 (2), 75 (4) start wiping head units 1-2, 2-2. Position 20 is the position where wipers 75 (1), 75 (3) start wiping head units 1-3, 2-3. Position 21 is the position where wipers 75 (2), 75 (4) start wiping head units 1-4, 2-4.

Position 22 is the standby position of the wipers 75 during ink suction. Position 23 is the position of the wiper holder unit 73 when initializing the ink suction selection operation. Position 24 is the position where the wiper cleaner 151 cleans the wipers 75.

Example of Maintenance Device 40 Operation

An example of maintenance device 40 states and operation is described below with reference primarily to FIG. 24 to FIG. 27C.

When Power is Off, and while Waiting to Print: Capping Position

When the printer 1 power is off and while waiting to print, the inkjet head 11 is in home position B.

The position of the cap unit 60 is the capping position closest to the nozzle face 11*a* (FIG. 24). Caps 64 (1) to 64 (4) and caps 65 (1) to 65 (4) disposed to the cap unit 60 are in the capping positions capping the corresponding nozzle faces 1-1*a* to 1-4*a* of head units 1-1 to 1-4 and nozzle faces 2-1*a* to 2-4*a* of head units 2-1 to 2-4.

Horizontal cam surfaces 82*c*, 82*d* parallel to nozzle faces 11*a* are formed contiguous to the distal end of the cam surfaces 82*a*, 82*b* of the spiral cams 81*a*, 81*b* of the cap drive transfer mechanism 80 (see FIG. 7A). When the cap unit 60 moves to the capping position closest to nozzle face 11*a* in the cap movement direction V, the rollers (cam followers) 66 on the cap unit 60 side are on the horizontal cam surfaces 82*c*, 82*d*. As a result, the cap unit 60 is held stably in the capping position. The cap unit 60 will not move away from the nozzle face 11*a* if the maintenance device 40 vibrates.

The wiper unit 70 is in the contact position in contact with the carriage 10. In this contact position, the contact surface 71*a* of the wiper frame 71 is pressed by the spring force of the tension spring 108*b* to the bottom 10*a* of the carriage 10 of the inkjet head 11. The wiper holder unit 73 waits in the home position 73A (FIG. 25A to FIG. 25C: wiper home detection position) at one lengthwise end of the wiper unit 70. The wipers 75 on the wiper holder unit 73 are in the retracted position.

The wiper cleaner 151 of the wiper unit 70 is pushed to the wiper frame 71 side by the bottom 10*a* of the carriage 10. Therefore, the wiper cleaner 151 is pressed to the ink sponges 156*a*, 157*b* of the ink recovery units 156, 157. Ink or other foreign matter on the wiper cleaner 151 is absorbed by the ink sponge 156*a*, 157*b*.

The wiper-pump drive transfer mechanism 90 is changed to the ink suction pump 94 drive state (state enabling ink suction).

The valves 112*a* to 115A, 112B to 115B disposed between the caps 64 (1) to 64 (4), 65 (1) to 65 (4) and the ink recovery unit of the ink cartridge 14 are all held open to protect the ink meniscus. More specifically, the all-valve operating levers 119A, 119B are depressed by the valve selectors 117A, 117B (FIG. 25A to FIG. 25C: all valves open position). As a result, the nozzles are open to the air through valves 112*a* to 115A, 112B to 115B.

The moving members 168 are advanced to the advanced position 168A. In the capping position, there is a gap between the moving members 168 and the cap-side engaging surface 164*a*, and between the moving members 168 and the base-side engaging surface 166*b*. Therefore, the caps 64 (1) to 64 (4) and 65 (1) to 65 (4) are parallel to the nozzle face of the corresponding head unit and tight to the nozzle face.

Preparing to Print: Uncapping Operation

When starting to print, the printer 1 retracts the cap unit 60 in the uncapping direction V2. As a result, the nozzle face 11*a* is uncapped, and the carriage 10 can be moved from the home position B to the printing position A. The carriage 10 then moves to the printing position A.

In the uncapping operation, the motor 83 drives and turns the spiral cams 81*a*, 81*b*. As a result, the cap unit 60 moves in the cap movement direction V in the uncapping direction V2 (retraction direction). The caps 64 (1) to 64 (4), 65 (1) to 65 (4) are pressed a specific amount against the nozzle faces 1-1*a* to 1-4*a*, 2-1*a* to 2-4*a*. While the cap unit 60 moves a specific amount in the uncapping direction V2, the lip surfaces 64*f* of the caps 64 (1) to 64 (4) and 65 (1) to 65 (4) are pressed by the spring force of the spring members 62*a*, 63*a* against the nozzle faces 1-1*a* to 1-4*a*, 2-1*a* to 2-4*a*.

The moving members 168 are in the advanced position 168A. The cap-side engaging surfaces 164*a* of the caps 64 (1) to 64 (4), 65 (1) to 65 (4) oppose the base-side engaging surfaces 166*b* of the cap bases 62, 63 with the moving members 168 therebetween. The other cap-side engaging surface 165*a* is opposite the base-side engaging surface 167*a*.

The cap unit 60 (cap bases 62, 63) moves in the uncapping direction V2, and one base-side engaging surface 166*b* contacts the moving members 168, and presses the moving members 168 to the cap-side engaging surface 164*a*.

As the cap unit 60 continues moving, the cap unit 60 is pushed in the uncapping direction V2 from the corner on the moving member 168 side of the caps 64 (1) to 64 (4) and 65 (1) to 65 (4). The caps 64 (1) to 64 (4) and 65 (1) to 65 (4) therefore gradually change from parallel to tilted to the nozzle faces 1-1*a* to 1-4*a*, 2-1*a* to 2-4*a* as the cap unit 60 moves. As a result, the lip surface 64*f* of each cap first separates from the nozzle face from the corner on the moving member 168 side. The part of the lip surface 64*f* separating from the nozzle face gradually moves to the other end of the lip surface 64*f*.

When the cap unit 60 (cap bases 62, 63) moves further in the uncapping direction V2, the other base-side engaging surface 167*a* of the cap bases 62, 63 directly contacts the cap-side engaging surface 165*a* (as shown in FIG. 18B, FIG. 22B). At this point the entire lip surface 64*f* of each cap is separated from the corresponding nozzle face, and the diagonal cap removal operation ends. The position of the cap unit 60 at this time is the position between the flushing position and the pump suction position in FIG. 24. The caps then move at an angle with the cap unit 60 in the uncapping direction V2.

When the cap unit 60 moves further in the uncapping direction V2, the levers 171, 172 contact the second engaging tabs 176, 177 on the device frame 50 side. The levers 171, 172 then pivot and the slide units 181, 182 slide in conjunction with cap unit 60 movement. The moving members 168 formed on the slide units 181, 182 move away from between the base-side engaging surface 166*b* and cap-side engaging surface 164*a* to the retracted position. As a result, the caps return to parallel to the nozzle faces (see FIG. 22C).

When the cap unit 60 then moves further in the uncapping direction V2, the drive switching mechanism 100 changes the drive state of the wiper-pump drive transfer mechanism 90. First, when the cap unit 60 reaches the pump suction position (FIG. 24), the latch lever 102*a* of the first latch mechanism 102 separates from the cam surface 106 on the device frame 50 side. The internal gear 93*b* of the planetary gear speed reducer 93 is latched by the first latch mechanism 102 and prevented from turning (see FIG. 8F).

When the cap unit 60 reaches the wiper moving position (FIG. 24), the latch lever 104*a* of the second latch mechanism 104 is pressed by the cam surface 105 on the device frame 50 side. The planetary carrier 93*c* is unlatched by the second latch mechanism 104, and the planetary carrier 93*c* can turn. As a result, the wipers 75 can be moved by the wiper-pump drive transfer mechanism 90. Note that the drive motor 91 does not operate in the unstable state when the drive mode is being changed.

The wiper unit 70 is held floating to the device frame 50 by the tension spring 108*b*. The wiper unit 70 does not follow movement of the cap unit 60, and stays in the same cap position in the cap motion direction H. More specifically, the contact surface 71*a* of the wiper frame 71 is pressed against the bottom 10*a* of the carriage 10 and held in this position by the spring force of the tension spring 108*b*.

The cap unit 60 moves further in the uncapping direction to the wiping position (FIG. 24). In this position, the lip surfaces 64*f* of the caps reach a position in the uncapping direction V2 from the wiper holder unit 73. In this position, the wiper holder unit 73 can be moved in the cap movement direction V above the cap unit 60 (the capping direction V1 side).

The cap unit 60 then moves further in the uncapping direction V2. When the cap unit 60 reaches the start vertical movement position of the wiper unit (FIG. 24), the engaging tabs 61*a* of the cap frame 61 contact the rectangular frames 71*c* of the wiper frame 71. The wiper unit 70 then moves with the cap unit 60 from the wiper unit contact position 70A in the uncapping direction V2. The contact surface 71*a* of the wiper frame 71 of the wiper unit 70 gradually separates from the bottom 10*a* of the carriage 10.

When the cap unit 60 reaches the carriage movement position (FIG. 24), the carriage 10 can move. The wiper cleaner 151 of the wiper unit 70 is released from pressure by the bottom 10*a* of the carriage 10, and returns to the position floating above the wiper frame 71.

The wiper unit 70 then moves to and waits at the cap home detection position (FIG. 24), which is the standby position. The maintenance device 40 thus waits in the capping position. The carriage 10 is then moved to position the inkjet head 11 in the printing position A, enabling printing.

Operation when Printing: Flushing, Defective Nozzle Inspection

When printing, the carriage 10 is regularly returned to the home position B for inkjet head 11 flushing and defective nozzle inspection. Flushing is an operation that ejects ink droplets into the caps 64 (1) to 64 (4) and 65 (1) to 65 (4) from the nozzles of the head units 1-1 to 1-4, 2-1 to 2-4 of the inkjet head 11. Nozzle clogging can be prevented by removing ink left in unused nozzles. Defective nozzle inspection ejects ink droplets from each nozzle into the cap, and detects whether or not ink droplets were ejected. Based thereon, nozzles that do not eject ink droplets, and nozzles that do not eject the appropriate amount of ink, are identified.

For nozzle flushing, the cap unit 60 moves from the standby position (cap home detection position) in the capping direction V1 and stops at the flushing position (FIG. 24). In this position, the lip surface 64*f* of each cap is at a position near the nozzle face without touching the nozzle face. When inspecting for defective nozzles, the cap unit 60 in the standby position moves to and stops at the defective nozzle inspection position (FIG. 24). This position is a position slightly to the capping direction V1 from the flushing position.

In the standby position, the caps of the cap unit 60 are held parallel to the nozzle faces. The caps move to the flushing position and defective nozzle inspection position while remaining parallel. A defective nozzle inspection mechanism known from the literature determines the ink droplet ejection status based on change in capacitance between electrodes disposed on the head side and the cap side. Detection accuracy is assured in this configuration by keeping the electrodes parallel. In this example, when moving from the standby position in the capping direction, the caps are held parallel to the nozzle face, and defective nozzle inspection is performed in this condition. Inspection with good accuracy is therefore possible when defective nozzles are inspected based on change in capacitance.

Selective Suction Operation

When a defective nozzle is detected, for example, a selective suction operation that selects the head unit with the defective nozzle and suctions ink from the nozzles of the head unit is performed. Selective suctioning of head unit 1-1 is described as an example below.

The valve selectors 117A, 117B on both sides are in the all valves open position (FIG. 25A to FIG. 25C). In this event, the cap unit 60 moves from the defective nozzle inspection position or the flushing position (FIG. 24) in the uncapping direction V2, and stops at the cap home detection position, which is the standby position (FIG. 24).

The wiper holder unit 73 moves from the wiper home detection position (FIG. 25A to FIG. 25C), which is the home position 73A, in the wiper advancing direction H1 and stops at the all valves open position. As a result, the selector hooks 118A, 118B on the sides of the wiper holder unit 73 are positioned to the valve selectors 117A, 117B in the wiper movement direction H.

Next, the cap unit 60 stops at the position farthest in the uncapping direction V2, the valve selection position (head 1) (FIG. 24). The wiper unit 70 moves with the cap unit 60, and the selector hooks 118A, 118B engage the corresponding valve selectors 117A, 117B (ST1 in FIG. 12D).

The wiper holder unit 73 then moves in the wiper advancing direction H1 and stops at the valve 1-1 position (valve 2-1 position) (FIG. 25A to FIG. 25C). The valve selectors 117A, 117B engaged with the selector hooks 118A, 118B also move, and are positioned to the valve 1-1 position (valve 2-1 position). As a result, valves 112A, 112B open, and can suction ink from the caps 64 (1), 65 (1) capping head units 1-1, 2-1.

Next, the cap unit 60 moves in the capping direction V1, and stops at valve selection position (head 2) (FIG. 24). The wiper unit 70 moves with the cap unit 60, and the selector hook 118A disengages the valve selector 117A. The other selector hook 118B remains engaged with the valve selector 117B (ST2 in FIG. 12D).

In this position the wiper holder unit 73 moves in the wiping direction H2, and stops in the all valves closed position 1 (all valves open position 7). The valve selector 117B engaged with the selector hook 118B also moves in the same direction and is positioned to the all valves closed position (FIG. 25A to FIG. 25C). As a result, all valves 112B to 115B return to the closed position.

Only valve 112A thus opens, and valve 112A is selected. More specifically, opening only the valve 112A corresponding to the head unit 1-1 from which ink is to be suctioned is possible.

The cap unit 60 then moves in the capping direction V1 and stops at the standby position (FIG. 24: cap home detection position. The wiper holder unit 73 then moves in the wiper advancing direction H1, stops at the suction standby position (FIG. 27A to FIG. 27C), and waits at this position.

The cap unit 60 then moves in the capping direction V1, and stops at the capping position (FIG. 24). At the pump suction position (FIG. 24), which is a cap unit 60 movement position, the wiper-pump drive transfer mechanism 90 switches and can drive the ink suction pump 94.

The head units 1-1, 2-1 30 are capped by the caps 64, 65. The ink suction pump 94 is then driven to suction ink. Ink is thus suctioned only from head unit 1-1 through the open valve 112A.

The printer 1 may also stop due to a power failure. In this event, the positions of the valve selectors 117A, 117B are unknown. In this situation, the wiper holder unit 73 is first moved to the suction selection initialization position (FIG. 27A to FIG. 27C). Next, the cap unit 60 moves in the uncapping direction V2. The wiper holder unit 73 moves in the wiping direction H2.

The selector hooks 118A, 118B of the wiper holder unit 73 move from a position separated in the wiper movement direction H from the valves 112*a* to 115A, 112B to 115B. While moving, the ends of the selector hooks 118A, 118B therefore contact the ends of the valve selectors 117A, 117B. The valve selectors 117A, 117B can therefore be returned to the initial position. The valve selection operation can therefore be appropriately performed.

After the ink suction operation ends, the cap unit 60 starts moving in the uncapping direction V2. The diagonal cap removal operation is performed in conjunction with cap unit 60 movement (see FIG. 18A to FIG. 18C).

Selective Wiping

Operation when selective wiping is performed after the caps 64 (1) to 64 (4), 65 (1) to 65 (4) are removed from the nozzle faces 1-1*a* to 1-4*a* of the head units 1-1 to 1-4 and the nozzle faces 2-1*a* to 2-4*a* of the head units 2-1 to 2-4 by the diagonal removal operation is described next. Wiping the nozzle face 1-1*a* of head unit 1-1 from which ink was suctioned is described below.

The cap unit 60 moves in the uncapping direction V2 and stops at the wiping position (FIG. 24). At the wiper moving position (FIG. 24) before this wiping position, the wiper-pump drive transfer mechanism 90 changes to the wiper drive side.

In the wiping position, the wiper holder unit 73 waiting at the suction standby position (FIG. 27A to FIG. 27C) moves in the wiper advancing direction H1, and stops at the wiper raising position of wiper raising member 122 (1) (FIG. 26A, FIG. 26B).

In this position, the cap unit 60 moves in the uncapping direction V2 and stops at the wiper moving position (FIG. 24). The wiper unit 70 moves with the cap unit 60. This movement causes wiper 75 (1) of the wiper holder unit 73 of the wiper unit 70 to be pushed up by the wiper raising member 122 (1), and change from the retracted position to the upright position. The other wipers 75 (2) to 75 (4) remain in the retracted position.

Next, the cap unit 60 moves in the capping direction V1, and stops at the wiper avoidance position (FIG. 24). At this position, the wiper holder unit 73 moves in the wiping direction H2, and is positioned to the start wiping position (FIG. 27A to FIG. 27C) before the nozzle face 1-1*a* of the head unit 1-1 to be wiped.

The cap unit 60 then moves in the capping direction V1 and stops at the wiping position (FIG. 24). In this position, the distal ends 75*b* of the wiper 75 (1) protrude slightly to the capping direction V1 from the nozzle face 1-1*a* of the head unit 1-1. Preparation for wiping is thus completed.

The wiper holder unit 73 then moves in the wiping direction H2 at the set speed. The nozzle face 1-1*a* is wiped by the wiper 75 (1) in the upright position on the wiper holder unit 73.

When the wiper 75 (1) moves to the head cover surface 10*b* (see FIG. 4, FIG. 27A) surrounding the outside of the nozzle face 1-1*a*, the wiper 75 (1) stops (the wiper holder unit 73 stops).

The cap unit 60 then moves, passes the wiper avoidance position, and stops at the wiper moving position (FIG. 24). If the wiper 75 (1) elastically returns with force to the original shape after separating from the nozzle face 1-1*a*, ink or other foreign matter on the distal ends 75*b* of the wiper 75 (1) may scatter. The scattered ink or other foreign matter then sticks to surrounding parts and soils them.

The plural head units are arrayed densely in a narrow space in a fluid ejection head having a plurality of head units, such as a line inkjet head. If ink or other foreign matter scatters from the wiper after the wiper wipes the nozzle face of one head unit, the scattered ink or other foreign matter may stick to the nozzle face of another head unit and soil that nozzle face. Therefore, ink or other foreign matter must be reliably prevented from being sprayed from the wiper when it separates from the wiper after wiping is completed.

In this example, after wiping the nozzle face 1-1*a*, the deflected wiper 75 (1) moves slightly in the direction away from the nozzle face 1-1*a* side (the uncapping direction V2). By appropriately setting the speed of movement, the distal ends 75*b* of the wiper 75 (1) gradually recover elastically. As a result, ink or other foreign matter does not scatter.

As described with reference to FIG. 9A to FIG. 9C, when the wiper unit 70 moves in uncapping direction V2 with the cap unit 60, the wiper holder unit 73 moves slightly in the direction opposite the wiping direction H2. The wiper 75 (1) therefore moves at an angle to the uncapping direction of the nozzle face 1-1*a* toward the direction in which the distal ends 75*b* are deflected. As a result, the distal ends 75*b* separate from the nozzle face 1-1*a* side with substantially no movement at the points of contact between the distal ends 75*b* of the wiper 75 (1) and the nozzle face 1-1*a* side. As a result, ink or other foreign matter on the distal ends 75*b* can be reliably prevented from scattering.

More particularly, the inkjet head 11 in this example is configured with a plurality of head units 1-1 to 1-4, 2-1 to 2-4 arrayed at a small interval. If ink or other foreign matter scatters from the wiper 75 (1) after wiping the nozzle face 1-1*a*, the scattered ink or other foreign matter will stick to the nozzle face 1-2*a* of head unit 1-2 or the nozzle face 1-3*a* of head unit 1-3, possibly causing a nozzle defect. Therefore, moving the wiper 75 (1) in a different direction than the wiping direction (wiper retraction direction) when wiping ends so that the distal ends 75*b* of the wiper do not rebound elastically with force is effective.

When the cap unit 60 moves to the wiper moving position (FIG. 24), the contact surface 71*a* of the wiper unit 70 separates from the bottom 10*a* of the carriage 10. As a result, the wiper cleaner 151 of the wiper unit 70 rises, and the distal ends 75*b* of the wipers 75 can be cleaned.

The wiper holder unit 73 then moves in the wiping direction H2 and returns to the home position 73A (wiper home detection position). While the wiper holder unit 73 moves, the distal ends 75*b* of the wiper 75 (1) in the upright position slide and pass over the recessed edge of the wiper cleaner 151 (FIG. 27A to FIG. 27C: wiper cleaning position). Ink or other foreign matter on the distal ends 75*b* is wiped off by the wiper cleaner 151 side at this time.

At a position before the wiper holder unit 73 reaches the home position 73A, the upright wiper 75 (1) is pushed by the wiper retraction member 123 (1) and returns to the retracted position. As a result, selective wiping of the nozzle face 1-1*a* of head unit 1-1 ends.

REFERENCE SIGNS LIST

1 inkjet printer
2 roll paper compartment
3 paper roll
4 paper exit
5 recording paper conveyance path
6 feed roller
7 paper guide
8 conveyance roller pair
9 platen
10 carriage
10*a* bottom
10*b* head cover surface
11 inkjet head
11*a* nozzle face
11A first head
11B second head
12 paper feed motor
13 ink cartridge holder
14 ink cartridge
1-1 to 1-4 head unit
1-1*a* to 1-4*a* nozzle face
2-1 to 2-4 head unit
2-1*a* to 2-4*a* nozzle face
40 maintenance device
50 device frame
51 bottom panel
52, 53 side wall
54, 55 end wall
56*a*, 56*b* guide posts
60 cap unit
61 cap frame
61*a* engaging tabs
61*b* side wall
61*c* lever depressing operator
62 cap base
62*a* spring members
63 cap base
63*a* spring member
64 (1) to 64 (4) cap
64*a* cap body
64*b* lip
64*c* tabs
64*d* side wall
64*e* side wall
64*f* lip surface
65 (1) to 65 (4) cap
66 roller
70 wiper unit
71 wiper frame
71*a* contact surface
71*b* side panels
71*c* rectangular frames
72 guide shafts
73 wiper holder unit
73*a* hole
73A home position
74 (1) to 74 (4) wiper holders
74*a* engaging tab
74A retracted position
74B upright position
75 (1) to 75 (4) wiper
75*a* wiping surface
75*b* distal ends
76 slide frame
77 (1) to 77 (4) position holding arm
80 cap drive transfer mechanism
81*a*, 81*b* spiral cams
82*a*, 82*b* cam surfaces
83 motor
84 power transfer mechanism
85*a*, 85*b* guide hole
86 position detector
90 wiper-pump drive transfer mechanism
90A cover
91 drive motor
92 transmission gear train
93 planetary gear speed reducer
93*a* input shaft
93*d* sun gear
93*e* planetary gear
93*b* internal gear
93*c* planetary carrier
93*f* drive-side external gear
94 ink suction pump
95*a* external transfer gear
95*b* follower-side external gear
96 drive sprocket
97 driven sprocket
98 drive belt
99 slider
99*a* protrusion
100 drive switching mechanism
101 first tension spring
102 first latch mechanism
102*a* first latch lever
103 second tension spring
104 second latch mechanism
104*a* second latch lever
105 first cam surface
106 second cam surface
107*a* guide
107*b* guided parts
108*a* spring catch
108*b* tension spring
108*c* spring catch
109*a* engaging tabs
109*b* engaging frames
109*c* engaging tab
109*d* engaging frame
110 suction tube
112 to 115 valves
112*a* to 115*a* operating levers
116*a* guide shaft
116*b* guide rail
117A valve selector
117B valve selector
117*a* engaging tab
117*b* lever operator

118A selector hook
118B selector hook
118*a* recess
119 all-valve operating levers
121 pivot shaft
122A base
122B base
122 (1) to 122 (4) wiper raising member
123 (1), 123 (2) wiper retraction member
125 support shaft
126 compression spring
127 link
127*a* engaging surface
128 link
128*a* hole
128*b* engaging tab
129 connection pin
130 (1) to 130 (3) stops
130*a* engaging surface
150 wiper cleaner unit
151 wiper cleaner
to recessed edge
152, 153 cleaner support panels
154 support pins
155 spring member
156, 157 ink recovery units
156*a*, 157*a* ink sponges
156*b*, 157*b* compartments
160 diagonal cap removal mechanism
161 top
162 (1) to 162 (4) openings
164, 165 cap-side engaging members
164*a*, 165*a* cap-side engaging surfaces
166, 167 base-side engaging parts
166*a*, 167*a* base-side engaging surfaces
166*b* base-side engaging surface 166*b*
168 moving members
168A advanced position
168B retracted position
170 slide mechanism
171, 172 levers
171*a*, 172*a* slide channels
173 support shaft
174, 175 first engaging tabs
176, 177 second engaging tabs
178 linkage unit
179 connecting rod
181, 182 slide units
201 pivot frame
202 connector plate
210 control unit
211 input/output unit
212 recording paper conveyance mechanism
213 carriage drive mechanism
214 head driver
215 rotary encoder
216 position detector
217 rotary encoder
218 operating/display unit
220 host computer
P recording paper
A printing position
B home position
V cap movement direction
V1 capping direction
V2 uncapping direction
H wiper motion direction
H1 wiper advancing direction
H2 retraction direction (wiping direction)

The invention claimed is:

1. A maintenance device for a fluid ejection head comprising:
a cap that caps a nozzle face of the fluid ejection head;
a wiper that wipes the nozzle face;
a suction pump that suctions ink from the cap;
a cap drive transfer mechanism that moves the cap relative to the nozzle face;
a wiper-pump drive transfer mechanism that moves the wiper and drives the suction pump;
a drive switching mechanism that changes driving by the wiper-pump drive transfer mechanism to drive the suction pump or to move the wiper according to the position of cap movement;
the drive switching mechanism includes a drive motor that rotates a drive shaft,
a planetary gear speed reducer that has an internal gear or a planetary gear, and speed reduces rotation of the drive shaft of the drive motor and causes the internal gear or planetary gear to turn, and
a latch mechanism that stops rotation of the internal gear or planetary gear of the planetary gear speed reducer according to the position of cap movement.

2. The maintenance device for the fluid ejection head described in claim 1, further comprising:
a wiper frame that supports and moves the wiper;
a device frame that supports the wiper frame;
an elastic member that is disposed to the device frame and supports the wiper frame;
a cap support member that supports the cap and is moved by the cap drive transfer mechanism; and
an engaging unit that is disposed to the wiper frame, engages the cap support member, and moves the wiper frame with the cap support member.

3. The maintenance device for the fluid ejection head described in claim 2, further comprising:
a second wiper that wipes a nozzle face at a different position than the nozzle face wiped by the wiper; and
a wiper holder that is disposed to the wiper frame and supports and moves the wiper and the second wiper;
wherein the wiper-pump drive transfer mechanism moves the wiper holder.

4. The maintenance device for the fluid ejection head described in claim 3, further comprising:
a first wiper engaging member that is disposed to a first position in the direction the wiper moves, engages the wiper when the wiper frame moves in a direction away from the nozzle face, and changes the wiper from a first position to a second position that differs from the first position;
a second wiper engaging member that is disposed to a second position different from the first position in the direction the wiper moves, engages the wiper when moving in a direction away from the nozzle face, and changes the wiper from a first position to a second position that differs from the first position; and
a third wiper engaging member that is disposed to a third position different from the first position and the second position in the direction the wiper moves, engages the wiper and the second wiper when the wiper moves to the third position, and changes the first and second wipers from the second position to the first position.

5. The maintenance device for the fluid ejection head described in claim 3, wherein:

the wiper has a convex surface; and the maintenance device has a wiper cleaner with a concave surface that contacts the convex surface of the wiper and cleans the convex surface of the wiper.

6. The maintenance device for the fluid ejection head described in claim 5, wherein:

the second wiper has a convex surface; and the wiper cleaner has a concave surface that contacts the convex surface of the second wiper.

7. The maintenance device for the fluid ejection head described in claim 6, further comprising:

a wiper cleaner elastic support member that is disposed to the wiper frame and supports the wiper cleaner.

8. The maintenance device for the fluid ejection head described in claim 2, further comprising:

a second cap that caps a nozzle face at a different position than the nozzle face capped by the cap;

the cap support member supporting the cap and the second cap.

9. The maintenance device for the fluid ejection head described in claim 8, wherein:

the cap support member supports a first cap pressure member that presses the cap to the nozzle face, and a second cap pressure member that presses the second cap to the nozzle face.

10. The maintenance device for the fluid ejection head described in claim 8, further comprising:

a first ink suction path that moves ink suctioned in the cap;

a second ink suction path that moves ink suctioned in the second cap;

a first valve that opens and closes the first ink suction path;

a second valve that is disposed to a different position than the first valve in the wiper movement direction, and opens and closes the second ink suction path; and a valve selector that moves in the wiper movement direction, moves to a position opposite the first valve or a position opposite the second valve, and opens and closes the first valve or second valve.

11. The maintenance device for the fluid ejection head described in claim 2, further comprising:

a control unit that drives the cap drive transfer mechanism and separates the wiper from the nozzle face after driving the wiper-pump drive transfer mechanism and wiping the nozzle face with the wiper.

12. The maintenance device for the fluid ejection head described in claim 11, wherein:

the wiper-pump drive transfer mechanism has a wiper drive transfer mechanism unit including a drive-side external gear disposed to the device frame, a follower-side external gear disposed to the wiper frame, a pivot member that pivots on the axis of the drive-side external gear, an external transfer gear that is supported by the pivot member and revolves around the axis of the drive-side external gear while remaining meshed with the drive-side external gear, and a connecting member that meshes with the follower-side external gear and the external transfer gear.

13. A fluid ejection device comprising:

a fluid ejection head having a nozzle face in which nozzles that eject ink are disposed;

a maintenance device including a cap that caps the nozzle face of the fluid ejection head, and a wiper that wipes the nozzle face;

a suction pump that suctions ink from the cap;

a cap drive transfer mechanism that moves the cap relative to the nozzle face;

a wiper-pump drive transfer mechanism that moves the wiper and drives the suction pump;

a drive switching mechanism that changes driving by the wiper-pump drive transfer mechanism to drive the suction pump or to move the wiper according to the position of cap movement;

the drive switching mechanism includes a drive motor that rotates a drive shaft, a planetary gear speed reducer that has an internal gear or a planetary gear, and speed reduces rotation of the drive shaft of the drive motor and causes the internal gear or planetary gear to turn, and a latch mechanism that stops rotation of the internal gear or planetary gear of the planetary gear speed reducer according to the position of cap movement.

14. A printer comprising:

an inkjet head that has a nozzle face in which nozzles that eject ink are disposed, and ejects ink onto a recording medium;

a maintenance device including a cap that caps the nozzle face of the inkjet head, and a wiper that wipes the nozzle face;

a suction pump that suctions ink from the cap;

a cap drive transfer mechanism that moves the cap relative to the nozzle face;

a wiper-pump drive transfer mechanism that moves the wiper and drives the suction pump;

a drive switching mechanism that changes driving by the wiper-pump drive transfer mechanism to drive the suction pump or to move the wiper according to the position of cap movement;

the drive switching mechanism includes a drive motor that rotates a drive shaft, a planetary sear speed reducer that has an internal gear or a planetary gear, and speed reduces rotation of the drive shalt of the drive motor and causes the internal gear or planetary gear to turn, and a latch mechanism that stops rotation of the internal gear or planetary gear of the planetary gear speed reducer according to the position of cap movement a conveyance path that conveys the recording medium; and a conveyance mechanism that conveys the recording medium through the conveyance path.

* * * * *